US011079711B2

(12) United States Patent
Miyake et al.

(10) Patent No.: US 11,079,711 B2
(45) Date of Patent: Aug. 3, 2021

(54) IMAGE FORMING APPARATUS

(71) Applicant: Hewlett-Packard Development Company, L.P., Spring, TX (US)

(72) Inventors: Koji Miyake, Yokohama (JP); Satoru Furuya, Yokohama (JP); Kensuke Nakajima, Yokohama (JP); Shun Ikeura, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/449,957

(22) Filed: Jun. 24, 2019

(65) Prior Publication Data

US 2019/0310581 A1 Oct. 10, 2019

Related U.S. Application Data

(63) Continuation of application No. PCT/KR2017/007142, filed on Jul. 5, 2017.

(30) Foreign Application Priority Data

Dec. 27, 2016 (JP) ..... JP2016-254054

(51) Int. Cl.
*G03G 21/00* (2006.01)
*G03G 15/16* (2006.01)
(Continued)

(52) U.S. Cl.
CPC ..... *G03G 21/0035* (2013.01); *A46B 5/00* (2013.01); *B41F 35/04* (2013.01); *G03G 15/00* (2013.01); *G03G 15/16* (2013.01); *G03G 15/161* (2013.01); *G03G 15/168* (2013.01); *G03G 15/1675* (2013.01); *G03G 21/00* (2013.01);
(Continued)

(58) Field of Classification Search
CPC ..... G01G 15/161; G01G 15/168; G01G 21/0035; G01G 21/007; G01G 2215/1647; G01G 2215/1652–1661; B08B 1/002
See application file for complete search history.

(56) References Cited

U.S. PATENT DOCUMENTS

2008/0298864 A1 12/2008 Murao
2014/0294432 A1 10/2014 Yonemoto
2016/0209786 A1 7/2016 Kojima

FOREIGN PATENT DOCUMENTS

CN 103513554 A 1/2014
JP 59-005257 A 1/1984
(Continued)

OTHER PUBLICATIONS

Takayanagi, JP 2012-083479 A, Apr. 2012, JPO Computer Translation (Year: 2012).*

*Primary Examiner* — Erika J Villaluna
(74) *Attorney, Agent, or Firm* — Jefferson IP Law, LLP

(57) ABSTRACT

An image forming apparatus includes a rotatable cylindrical component to be cleaned, and a bar brush having a base substrate and bristles. The base substrate of the bar brush is located at a fixed position relative to the component to be cleaned. The bristles extend from the base substrate to contact the component to be cleaned. The bristles have free ends that form a tip end surface of the bar brush. The tip end surface has a curved shape that conforms with a surface of the component, when the bristles are not in contact with the surface to be cleaned.

18 Claims, 41 Drawing Sheets

(51) Int. Cl.

| | |
|---|---|
| ***A46B 5/00*** | (2006.01) |
| ***B41F 35/04*** | (2006.01) |
| ***G03G 15/00*** | (2006.01) |
| *B41F 16/00* | (2006.01) |

(52) U.S. Cl.
CPC ..... *G03G 21/007* (2013.01); *B41F 16/00* (2013.01); *G03G 2215/1647* (2013.01); *G03G 2221/0005* (2013.01); *G03G 2221/1627* (2013.01)

(56) References Cited

FOREIGN PATENT DOCUMENTS

| | | | | | |
|---|---|---|---|---|---|
| JP | 9-90784 | A | | 4/1997 | |
| JP | 10-142930 | A | | 5/1998 | |
| JP | 2000-187405 | A | | 7/2000 | |
| JP | 2002-123127 | A | | 4/2002 | |
| JP | 2006-30930 | A | | 2/2006 | |
| JP | 2006-039455 | A | | 2/2006 | |
| JP | 2007-58022 | A | | 3/2007 | |
| JP | 2012083479 | A | * | 4/2012 | ..... G03G 15/168 |
| JP | 2012-189645 | A | | 10/2012 | |
| JP | 2012-189646 | A | | 10/2012 | |
| JP | 2013105145 | A | * | 5/2013 | |
| JP | 2014-190994 | A | | 10/2014 | |
| JP | 2015-87647 | A | | 5/2015 | |
| JP | 2015-187673 | A | | 10/2015 | |
| JP | 2015-187723 | A | | 10/2015 | |
| JP | 2016-133652 | A | | 7/2016 | |

* cited by examiner

*Fig.13*

| Paper type | 30° 85%RH | 22°C 55%RH | 10°C 10%RH |
|---|---|---|---|
| Plain paper [80g/m$^2$] | 0.004 | 0.003 | 0.002 |
| Thick paper [250g/m$^2$] | 0.005 | 0.003 | 0.002 |
| Single coated paper [250g/m$^2$] | 0.005 | 0.003 | 0.002 |
| Double coated paper [80g/m$^2$] | 0.008 | 0.005 | 0.003 |
| Double coated paper [Matt] [210g/m$^2$] | 0.006 | 0.004 | 0.003 |

*Fig.15*

| Paper type | 30° 85%RH | 22℃ 55%RH | 10℃ 10%RH |
|---|---|---|---|
| Plain paper [80g/m$^2$] | 0.002 | 0.001 | 0.001 |
| Thick paper [250g/m$^2$] | 0.002 | 0.001 | 0.001 |
| Single coated paper [250g/m$^2$] | 0.002 | 0.001 | 0.001 |
| Double coated paper [80g/m$^2$] | 0.004 | 0.002 | 0.002 |
| Double coated paper [Matt] [210g/m$^2$] | 0.002 | 0.001 | 0.001 |

*Fig.17*

| Paper type | 30° 85%RH | 22℃ 55%RH | 10℃ 10%RH |
|---|---|---|---|
| Plain paper [80g/m$^2$] | 0.001 | 0.001 | 0.001 |
| Thick paper [250g/m$^2$] | 0.001 | 0.001 | 0.001 |
| Single coated paper [250g/m$^2$] | 0.001 | 0.001 | 0.001 |
| Double coated paper [80g/m$^2$] | 0.002 | 0.001 | 0.001 |
| Double coated paper [Matt] [210g/m$^2$] | 0.001 | 0.001 | 0.001 |

IMAGE FORMING APPARATUS

BACKGROUND

Various techniques have been devised for cleaning a transfer roller in image forming apparatuses to remove debris on the transfer roller. For example, some techniques relate to suppressing the transfer of toner onto a transfer roller by applying a reverse bias, which is a bias having a polarity opposite to that of a transfer bias, to the transfer roller during a non-image printing period in which printing of images is not made. Some techniques relate to diffusing toner adhered onto a transfer roller by using a brush roller that contacts the transfer roller.

BRIEF DESCRIPTION OF THE DRAWINGS

FIG. 13 is a table of measurement results taken in a comparative example.

FIG. 15 is a table of measurement results taken in a comparative example.

FIG. 17 is a table of measurement results of an example conducted with the example image forming apparatus illustrated in FIG. 2.

DETAILED DESCRIPTION

Figure 1:
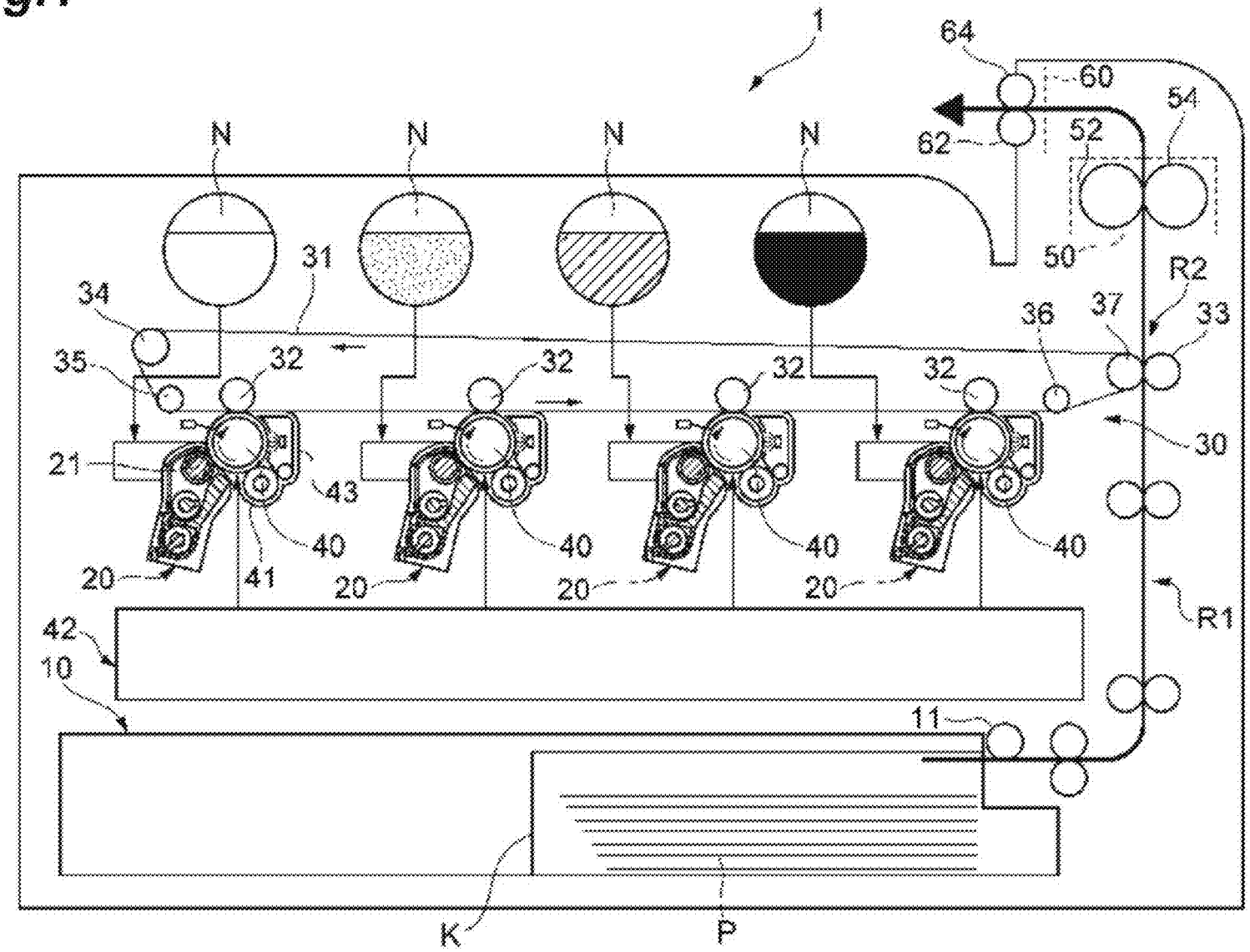
FIG. 1 is a schematic diagram of an example image forming apparatus.

In using some techniques for cleaning a transfer roller in image forming apparatuses, the transfer roller may not be cleaned sufficiently when a high-density toner image is transported from an upstream side, or when an image carrier or other components to be cleaned are cleaned.

An example image forming apparatus comprises a component to be cleaned in a cylindrical shape being rotatable and cylindrical; and a bar brush that contacts the component to be cleaned. The bar brush comprises a base substrate having a position that is fixed relative to the component to be cleaned and a plurality of bristles provided in the base substrate and making contact with the component to be cleaned. A tip end surface of the plurality of bristles forms a curved shape that conforms with a surface of the component to be cleaned in a state when the plurality of bristles are not making contact with the component to be cleaned.

Accordingly, when the bar brush contacts (e.g., through pressure contact) the component to be cleaned, such as a transfer roller, toner adhered onto the transfer roller can be diffused and removed by the plurality of bristles of the bar brush.

As the tip end surface formed by the plurality of bristles is curve-shaped and conforms with a surface of the transfer roller, the bar brush can make pressure contact with the transfer roller over the entire region of the tip end surface of the bar brush along a circumferential direction (rotation direction) of the transfer roller. As such, toner adhered onto the transfer roller can be better diffused, to improve a cleaning property.

In some examples, the bristles may be provided substantially vertically in the base substrate and the base substrate may be bent to a curved shape that conforms with a surface of the transfer roller.

Accordingly, as the bristles may be provided substantially vertically in the base substrate, the bar brush can be manufactured relatively easily and at a low cost. In some examples, the base substrate is bent to a curved shape that conforms with a surface of the transfer roller, to more easily form the tip end surface of the plurality of bristles into a curved shape that conforms with the surface of the transfer roller.

In some examples, the lengths of the plurality of bristles may be substantially uniform (e.g., approximately the same length of bristles), in order to improve the manufacture, in that the bar brush can be manufactured more easily and at a lower cost.

The difference between a maximum bite amount and a minimum bite amount of the bristles, into the transfer roller may be 1.0 mm or less. Accordingly, the bar brush can make pressure contact with the transfer roller, substantially uniformly, over the entire region of the bar brush in a circumferential direction (rotation direction) of the transfer roller, while allowing for some manufacturing errors of the bar brush and some mounting errors of the bar brush.

In some examples, the bar brush have a structure in which the bite amount of the bristles into the transfer roller is larger in an upstream side than in a downstream side of the transfer roller. Toner adhered onto the transfer roller is first flicked by the bristles upon entry into the bar brush. Accordingly, the bite amount of the bristles into the transfer roller may be larger in an upstream side than in a downstream side of the transfer roller, to improve a flicking force of the bristles and to reduce an amount of toner flowing downstream, in order to diffuse toner more efficiently.

In some examples, the tip end surface of the plurality of bristles may have a length of 10 mm or more, in the circumferential direction of the transfer roller, to improve the diffusing effect of the toner by the bar brush.

In some examples, the length of the bristles may be 2 mm or more and 10 mm or less, to impart the bristles with a suitable resilience without requiring an excessive driving torque for the transfer roller.

In some examples, the bristles may have a thickness of 2 dtex or more and 10 dtex or less, to impart the bristles with a suitable resilience without requiring an excessive driving torque for the transfer roller.

In some examples, a relation of $300 \leq D \times W1d \leq 850$ may be satisfied, where D represents the thickness of the bristles (in dtex) and W1*d* represents a plant density of the bristles per inch, to improve diffusion of the toner by the bar brush without requiring an excessive driving torque for the transfer roller.

In some examples, a relation of $350 \leq D \times W2d \leq 1050$ may be satisfied, where D represents the thickness of the bristles (in dtex) and W1*d* represents a where D represents the thickness of the bristles (in dtex) and W2*d* represents a density at the tip end surface of the bristles per inch, to improve diffusion of toner by the bar brush without requiring an excessive driving torque for the transfer roller.

The bar brush may have length L of the bristles and a bite amount n of the bristles into the transfer roller, where a relation of $L/10 \leq n \leq L/2$ may be satisfied, to diffuse and remove toner adhered onto the transfer roller by flexure of the bristles. In some examples, the bite amount n is 1/10 or more of the length L of the bristles, for sufficient flexibility of the bristles. In some examples, the bite amount n is 1/2 or less of the length L of the bristles, to prevent the bristles from breaking at the roots, and consequently, prevent the bristles from losing flexure.

The material of the bristles may include PET, nylon and/or acrylic, or a mixture of these, to better diffuse toner by the bar brush, while maintaining easy manufacturability.

In some examples, the image carrier may carry an adjusting toner image to perform an image adjustment operation. The bar brush may be disposed, along the axial direction of the transfer roller, in a position at which the adjusting toner image passes through the transfer nip region, to improve an efficiency of the cleaning.

In some examples, a plurality of adjusting toner images may be carried on the image carrier and spaced apart along the axial direction of the image carrier. The bar brush may be disposed discontinuously along the axial direction of the transfer roller, to improve an efficiency of the cleaning when a plurality of adjusting toner images are spaced apart and carried on the image carrier.

In some examples, the transfer roller may include a cylindrical core metal (or cylindrical metal core) and a cylindrical foam layer disposed around the outer circumference of the core metal, wherein, in a cross section of the foam layer, the diameter of cells in the foam layer may be 500 μm or less, and a static coefficient of friction of the foam layer to the image carrier may be 10.6 or less at a temperature of 30° C. and a humidity of 85%. The diameter of cells in the foam layer of 500 μm or less may impart the transfer roller with a suitable transferability. The static coefficient of friction of the foam layer to the image carrier of 10.6 or less at a temperature of 30° C. and a humidity of 85%, may impart the surface of the transfer roller with a suitable releasability.

In some examples, the image carrier that forms the transfer nip region with the transfer roller may be a photosensitive body, and the image forming apparatus may be provided with a bias application device for applying a transfer bias to the transfer roller to transfer toner images to a transfer material.

In some examples, the image forming apparatus may be provided with a plurality of photosensitive bodies, an intermediate transfer body to which toner images carried on the plurality of photosensitive bodies are successively primarily transferred, a transfer device defining a transfer nip region with the intermediate transfer body for passing a transfer material therethrough to secondary transfer the toner images primarily transferred on the intermediate transfer body onto the transfer material, and a bias application device for applying a transfer bias to the transfer device to transfer the toner images to the transfer material. The transfer device may include a support roller disposed on a side of the intermediate transfer body to which the toner images are not transferred and a transfer roller disposed on a side of the intermediate transfer body to which the toner images are transferred and holding the intermediate transfer body together with the support roller. The image carrier that forms the transfer nip region with the transfer roller may be the intermediate transfer body and the bias application device may apply the transfer bias to either one of the support roller and the transfer roller.

In some examples, the image forming apparatus may be operable in a normal mode, in which toner images are carried by the image carrier and those toner images are transferred to the transfer material, and in an image adjustment mode, in which the image adjustment operation is performed by carrying by the image carrier adjusting toner images to perform image adjustment. The bias application device may apply a reverse bias of a polarity opposite to that of the normal mode to the transfer roller at least during the image adjustment mode. During the image adjustment mode, transfer materials are not passed through the transfer nip region. Accordingly, when the reverse bias is applied to the transfer roller during the image adjustment mode, adherence of toner to the transfer roller can be suppressed more efficiently.

In some examples, the image adjustment mode may be executed during successive runs, where toner images are successively transferred to a plurality of transfer materials, in a period in which a transfer material is not passing through the transfer nip region, and the bias application device may apply a constant reverse bias to the transfer roller during the image adjustment mode. As the image adjustment mode may be executed with a constant reverse bias applied to the transfer roller in a period in which a transfer material does not pass through the transfer nip region during successive running, the transfer to the transfer roller of toner flowing into the transfer nip region can be better suppressed.

In some examples, the image forming apparatus may further operate in a cleaning mode in which the bias application device alternately applies positive and negative biases to the transfer roller, in order to return toner attached to the bar brush to the transfer roller, for cleaning.

In some examples, during the image adjustment mode, an absolute value of the reverse bias applied by the bias application device to the transfer roller may be 500 V or less, in order to suppress the transfer of toner charged to the opposite polarity, to the transfer roller.

In some examples, during the image adjustment mode, an absolute value of the reverse bias applied by the bias application device to the transfer roller may be ½ or less of an absolute value of the bias applied by the bias application device to the transfer roller during the normal mode. An absolute value of the bias applied to the transfer roller during the normal mode may be around 1 kV. Accordingly, an absolute value of the reverse bias applied to the transfer roller during the image adjustment mode may be ½ or less of an absolute value of the bias applied to the transfer roller during the normal mode, in order to suppress the transfer of toner charged to the opposite polarity, to the transfer roller.

In some examples, the transfer roller may be applied with a reverse bias at least during a period in which the adjusting toner image is passing through the transfer nip region. Switching the bias may accompany a delay time, and noise may be generated by switching the bias. Accordingly, the lowering of cleaning property due to noise generated by switching the bias can be suppressed at least during the period in which the adjusting toner image is passing through the transfer nip region.

An example image forming apparatus includes a rotatable component to be cleaned and a cleaning component to clean the rotatable component to be cleaned, by making contact with the component to be cleaned. The example image forming apparatus includes a contact-separation device rotatable by a torque transmitted from the component to be cleaned and a power transmission component movable in response to rotation of the contact-separation device to bring the cleaning component into and out of contact with the component to be cleaned.

In some examples, when a torque is transmitted from the component to be cleaned to the contact-separation device, the power transmission component moves in response to the rotation of the contact-separation device to bring the cleaning component into and out of contact with the component to be cleaned. For example, in response to rotation of the component to be cleaned, the cleaning component is operated to contact with or to separate from the component to be cleaned. Accordingly, a plastic deformation of the cleaning component can be suppressed as compared with a case where the cleaning component is always in contact with the component to be cleaned, thereby suppressing a decrease of cleaning property caused by deterioration of the cleaning component over time.

Further, the contact-separation device may comprise a centrifugal clutch to disconnect torque transmission, a torque limiter to transmit torque from the centrifugal clutch and to transmit a threshold torque by idling when the torque exceeds a threshold, and a rotary output device to move the power transmission component by rotating in response to torque transmitted from the torque limiter. When torque is transmitted from the component to be cleaned to the contact-separation device, a centrifugal force is applied to the centrifugal clutch to engage the centrifugal clutch. A torque is transmitted from the centrifugal clutch to the rotary output device to rotate the rotary output device. In response, the power transmission component is moved to bring the cleaning component into contact with the component to be cleaned, and the pressing force (contact force) of the cleaning component against the component to be cleaned increases gradually. When a predetermined pressing force is reached, the torque limiter may start idling. Consequently, even if the component to be cleaned continues rotating, the cleaning component can maintain the predetermined pressing force without being excessively pressed against the component to be cleaned. In addition, even if the cleaning component deteriorates over time and deforms plastically, the pressing force (torque) of the cleaning component against the component to be cleaned can be maintained constant and thus the cleaning component can always be pressed against the component to be cleaned at a proper pressing force. When the torque transmitted from the component to be cleaned to the contact-separation device extinguishes or decreases, centrifugal force can not be applied to the centrifugal clutch and the centrifugal clutch disengages. The pressing force of the cleaning component against the component to be cleaned is thereby released, and deterioration of the cleaning component over time can be suppressed.

In some examples, the centrifugal clutch may be disposed on a rotation axis of the component to be cleaned, to simplify the structure of the centrifugal clutch.

In some examples, the centrifugal clutch may transmit torque by engaging the clutch when the component to be cleaned is forward rotated. Accordingly, the component to be cleaned can be cleaned by the cleaning component when the component to be cleaned is forward rotated.

In some examples, the centrifugal clutch may disconnect torque transmission by releasing engagement of the clutch when the component to be cleaned is stopped or reverse rotated, to release the pressing of the cleaning component against the component to be cleaned, in order to suppress deterioration over time of the cleaning component when the component to be cleaned is not forward rotated.

In some examples, the power transmission component may be pivotable (e.g., swingably pivoted), in order to bring the cleaning component into and out of contact with the component to be cleaning by pivoting (or swinging) the power transmission component.

In some examples, the example image forming apparatus may further comprise a coupling component to couple the rotary output device and the power transmission component, and the coupling component may be extended over the rotary output device. Accordingly, when the rotary output device is rotated, the power transmission component can be pivoted along a direction in which the power transmission component is brought into and out of contact with the rotary output device.

In some examples, the power transmission component may be mounted so that it can move along a contact-separation direction of the cleaning component relative to the component to be cleaned, and the rotary output device and the power transmission component may include a cam that converts rotation of the rotary output device into movement of the power transmission component in the contact-separation direction. Accordingly, as the power transmission component may move along a contact-separation direction of the cleaning component relative to the component to be cleaned when the rotary output device is rotated, the cleaning component may be more suitably brought to contacted with or separated from the component to be cleaned.

In some examples, the contact-separation device may include an elastic component that applies elastic force to the power transmission component along a direction in which the cleaning component is separated from the component to be cleaned, so that the cleaning component can be separated more reliably from the component to be cleaned when the engagement of the centrifugal clutch is released.

In some examples, the cleaning component may be fixed to the power transmission component, so that the cleaning component can more reliably contact the component to be cleaned.

An example image forming apparatus comprises a rotatable component to be cleaned and a cleaning component to clean the component to be cleaned by contacting the component to be cleaned. The example image forming apparatus is provided with a holding component to movably hold the cleaning component within a region in which the cleaning component is not separated from the component to be cleaned.

Accordingly, as the cleaning component is movably held by the holding component within a region not separated from the component to be cleaned, when the component to be cleaned is rotated, the cleaning component follows the movement of the component to be cleaned and the position to make contact with the component to be cleaned changes, in order to suppress plastic deformation of the cleaning component, as compared with a case where the cleaning component is fixed. Accordingly, a lowering of cleaning property caused by deterioration of the cleaning component over time can be suppressed.

A direction in which the cleaning component moves in response to a forward rotation of the component to be cleaned may be defined as a forward movement direction and a direction opposite to the forward movement direction may be defined as a reverse movement direction. The example image forming apparatus may further comprise a first elastic component to push the cleaning component in the reverse movement direction. When the component to be cleaned is rotated, the cleaning component can move in the forward movement direction. As the cleaning component may then be pushed in the reverse movement direction by the first elastic component, the cleaning component can move in the reverse movement direction when the component to be cleaned is stopped or reverse rotated. Accordingly, the position of the cleaning component to contact the component to be cleaned can be changed depending on whether the component to be cleaned is forward rotated or not forward rotated.

A frictional force generated between the component to be cleaned and the cleaning component during the forward rotation of the component to be cleaned may be defined as a forward frictional force, and the elastic force of the first elastic component may be balanced with the forward frictional force. During the forward rotation of the component to be cleaned, the position of the cleaning component to contact the component to be cleaned may be a position at which the elastic force of the first elastic component is balanced with the forward frictional force. Accordingly, even if the cleaning component plastically deforms due to deterioration over time, the balance between the elastic force and the forward frictional force may remain unchanged and the position of the cleaning component to contact the forward rotated component to be cleaned may be maintained at a non-plastically deformed position or a less-plastically deformed position. For example, the position of the cleaning component to contact the component to be cleaned can be moved or changed in response to plastic deformation of the cleaning component, in order to further suppress the lowering of cleaning property of the cleaning component due to deterioration over time.

The example image forming apparatus may further comprise a second elastic component to push the cleaning component in the forward movement direction, to move the cleaning component more easily when the component to be cleaned is forward rotated.

In some examples, the holding component may be pivoted rotatably, to more easily move the cleaning component.

In some examples, the holding component may include a guide to serve as a moving path of the cleaning component, to prevent the cleaning component from moving away from the component to be cleaned in response to the rotation of the component to be cleaned.

The direction in which the cleaning component moves in response to the forward rotation of the component to be cleaned may be defined as the forward movement direction, and the guide may extend in a direction that approaches the component to be cleaned toward the forward movement direction. Accordingly, the cleaning component approaches the component to be cleaned in response to the forward rotation of the component to be cleaned. Similarly, as the guide may extend in a direction that is separated away from the component to be cleaned in the reverse rotation movement direction, the cleaning component can be moved away from the component to be cleaned when the component to be cleaned is stopped or reverse rotated. Accordingly, the plastic deformation of the cleaning component when the component to be cleaned is not forward rotated, may be suppressed.

The direction in which the cleaning component moves in response to the forward rotation of the component to be cleaned may be defined as the forward movement direction and the direction opposite to the forward movement direction may be defined as the reverse movement direction. The holding component may include a movement restrictor that restricts movement of the cleaning component in the reverse movement direction. As the movement of the cleaning component in the reverse movement direction may be restricted by the restrictor, the cleaning component can be prevented from separating from the component to be cleaned when the component to be cleaned is stopped or reverse rotated.

In the example image forming apparatuses described herein, the cleaning component may be a brush, such as, for example, a bar brush comprising a base substrate and a plurality of bristles planted in the base substrate to make pressure contact with the component to be cleaned.

In some examples, the cleaning component may be a foam component having elasticity or may be a pad-like component.

In the example image forming apparatuses described herein, the component to be cleaned may be a transfer roller defining a transfer nip region with the image carrier for passing a transfer material therethrough to transfer a toner image carried on the image carrier onto the transfer material.

In the following description, with reference to the drawings, the same reference numbers are assigned to the same components or to similar components having the same function, and overlapping description is omitted.

With reference to FIG. 1, an example image forming apparatus 1 may be an apparatus to form color images using magenta, yellow, cyan and black colors. The image forming apparatus 1 may include a conveyance device 10 for conveying paper sheets P, developing devices 20 for developing electrostatic latent images, a transfer device 30 for secondarily transferring toner images to the paper sheets P, photosensitive drums 40 that are electrostatic latent image carriers to be formed with images on circumferential surfaces thereof, a fixing device 50 for fixing the toner images onto the paper sheets P, and a discharge device 60 for discharging the paper sheets P.

The conveyance device 10 conveys the paper sheet P, e.g., recording media on which images are to be formed, along a conveyance path R1. The paper sheets P are stacked and contained in a cassette K, picked up by a feed roller 11 and conveyed. The conveyance device 10 conveys the paper sheets P to a transfer nip region R2 through the conveyance path R1 in such a timing that toner images to be transferred to the paper sheets P arrive at the transfer nip region R2.

Four developing devices 20 are provided, one for each of the respective colors. Each of the developing devices 20 is provided with a developer roller 21 to transfer toner to the photosensitive drum 40.

In the developing device 20, toner and carrier are adjusted at a selected mixing ratio, and stirred to mix the toner and carrier and to disperse the toner uniformly so as to form a developer having an optimal amount of charge. The developer is attached to the outer peripheral surface of the developer roller 21. As the developer roller 21 rotates to carry the developer to a region opposing the photosensitive drum 40, toner is extracted out from the developer attached to the developer roller 21 and transferred onto an electrostatic latent image formed on the circumferential surface of the photosensitive drum 40 to develop the electrostatic latent image.

The transfer device 30 carries the toner images formed with the developing devices 20 to the transfer nip region R2 where the toner images are secondarily transferred to the paper sheets P.

The transfer device 30 can be provided with a transfer belt 31 onto which the toner images are primarily transferred from the photosensitive drums 40, a plurality of support rollers 34, 35, 36 and 37 for supporting the transfer belt 31, primary transfer rollers 32 for holding the transfer belt 31 with the photosensitive drums 40, and a secondary transfer roller 33 for holding the transfer belt with the support roller 37.

The transfer belt 31 is an intermediate transfer body onto which toner images carried by the plurality of photosensitive drums 40 are primarily transferred successively. The transfer belt 31 is an endless belt circularly driven by the plurality of support rollers 34, 35, 36 and 37. The plurality of support rollers 34, 35, 36 and 37 are rotatable about the respective central axes. The plurality of support rollers 34, 35, 36 and 37 are disposed on a side of the transfer belt 31 to which the toner images are not transferred. The support roller 37 among the plurality of support rollers is a drive roller rotationally driven about the central axis, and the remaining support rollers 34, 35 and 36 are driven rollers that are rotated by the driving rotation of the support roller 37. The primary transfer rollers 32 are disposed to press against the photosensitive drums 40 from an inner peripheral surface of the transfer belt 31. The secondary transfer roller 33 is disposed in parallel with the support roller 37 to hold the transfer belt 31 and to press against the support roller 37 from an outer peripheral surface the transfer belt 31. For example, the secondary transfer roller 33 may be disposed on a side of the intermediate transfer belt 31 to which the toner images are transferred to hold the transfer belt 31 together with the support roller 37. Accordingly, the transfer belt 31 may be sandwiched between the support roller 37 and the secondary transfer roller. The secondary transfer roller 33 thereby forms the transfer nip region R2, through which the paper sheets P are passed, with the transfer belt 31. The secondary transfer roller 33 may be fixed in position relative to the transfer belt 31 and the support roller 37.

Four photosensitive drums 40 are provided, one for each of the respective colors. Each of the photosensitive drums 40 is provided side by side along the direction of movement of the transfer belt 31. Around the circumference of the photosensitive drum 40, the developing device 20, a charge roller 41, an exposure device 42 and a cleaning device 43 are arranged.

The charge roller 41 uniformly charges the surface of the photosensitive drum 40 to a predetermined potential. The charge roller 41 operates according to the rotation of the photosensitive drum 40. The exposure device 42 exposes the surface of the photosensitive drum 40 charged by the charge roller 41 in accordance with image to be formed on the paper sheet P. The potential of portions on the surface of the photosensitive drum 40 exposed by the exposure device 42 is thereby changed to form an electrostatic latent image. The four developing devices 20 use the toner supplied from toner tanks N provided opposite to the respective developing devices 20, relative to the transfer belt 31, to develop the electrostatic latent images formed on the photosensitive drums 40 and create toner images. The toner tanks N are respectively filled with magenta, yellow, cyan and black toners. The cleaning device 43 collects the toner remaining on the photosensitive drum 40 after the toner image formed on the photosensitive drum 40 has been primarily transferred onto the transfer belt 31.

The fixing device 50 adheres and fixates onto paper sheets toner images that have been secondarily transferred from the transfer belt 31 by passing the paper sheets P through a heated and pressed fixing nip part. The fixing device 50 is provided with a heater roller 52 (heating rotary body) for heating the paper sheets P and a pressure roller 54 (pressing rotary body) that is pressed against the heater roller 52 for rotationally driving. The heater roller 52 and the pressure roller 54 are formed in cylindrical shapes, and the heater roller 52 is internally provided with a heat source such as a halogen lamp. A contact area, or the fixing nip part is formed between the heater roller 52 and the pressure roller 54, and the toner images are fused and fixated onto the paper sheets P while the paper sheets P are passed through the fixing nip part.

The discharge device 60 is provided with discharge rollers 62 and 64 for discharging the paper sheets P on which the toner images have been fixed by the fixing device 50 to the outside of the apparatus.

An example printing process of the example image forming apparatus 1 will be described. When an image signal of a recording image is input to the image forming apparatus 1, the controller of the image forming apparatus 1 controls the paper feed roller 11 to rotate, to pick up one by one and convey a paper sheet P from the stack in the cassette K. Based on the received image signal, the surfaces of the photosensitive drums 40 are uniformly charged to a predetermined potential by the charge rollers 41 (charging operation). Electrostatic latent images are formed by irradiating laser light onto the surfaces of the photosensitive drums 40 with the exposure devices 42 (exposing operation).

In the developing devices 20, the electrostatic latent images are developed as toner to form toner images (developing operation). The formed toner images are primarily transferred from the photosensitive drums 40 to the transfer belt 31 in the regions at which the photosensitive drums 40 face the transfer belt 31 (transferring operation). The toner images formed on the four photosensitive drums 40 are successively superimposed (or layered) onto the transfer belt 31, to form a single composite toner image. Then, the composite toner image is secondarily transferred onto the paper sheet P conveyed by the conveyance device 10 in the transfer nip region R2 at which the support roller 37 and the secondary transfer roller 33 are opposed.

The paper sheet P, with the secondarily transferred composite toner image, is conveyed to the fixing device 50. The composite toner image is fused and fixated onto the paper sheet P by heating and pressing the paper sheet P between the heater roller 52 and the pressure roller 54 while the paper sheet P is made to pass through the fixing nip part (fixing operation). The paper sheet P is discharged to the outside of the image forming apparatus 1 by the discharge rollers 62 and 64.

Cleaning Function

Figure 2:
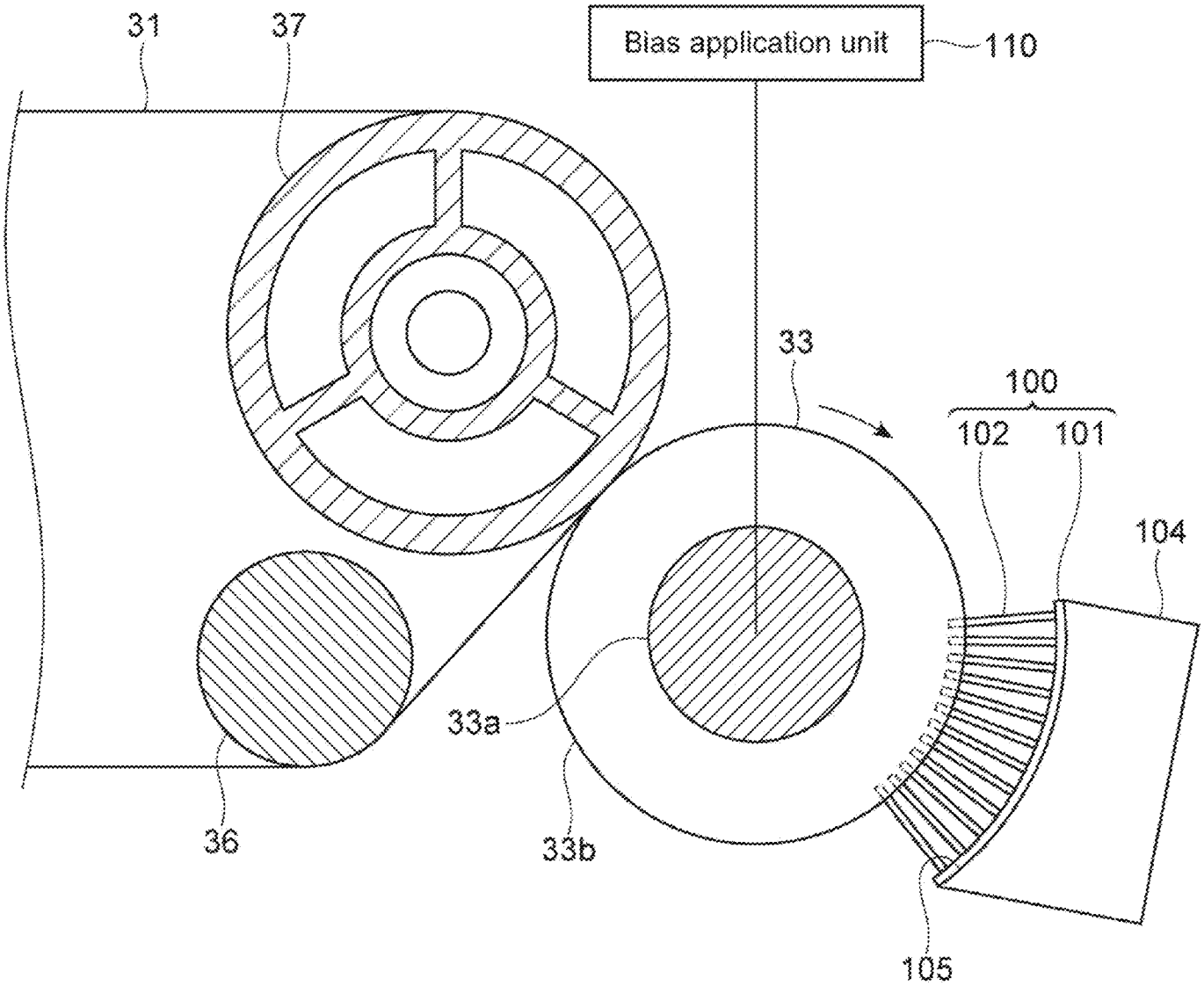
FIG. 2 is a schematic diagram of an example transfer device.

With reference to FIG. 2, an example image forming apparatus 1 may include, as a cleaning function (device), a bar brush 100 to make pressure contact with the secondary transfer roller 33 and a bias application device 110 to apply voltages to the secondary transfer roller 33.

The bar brush 100 is a cleaning component to clean the secondary transfer roller 33. The bar brush 100 cleans the secondary transfer roller 33 by diffusing toner transferred from the transfer belt 31 to the secondary transfer roller 33.

The bar brush 100 may remove various debris adhered onto the secondary transfer roller 33, in addition to the toner transferred from the transfer belt 31. The bar brush 100 is further described below.

The bias application device 110 can be implemented as a function of a control device which may include, for example, a CPU (Central Processing Unit), a ROM (Read Only Memory) and a RAM (Random Access Memory). Applying voltages to the secondary transfer roller 33 by the bias application device 110 may be realized according to various techniques.

The image forming apparatus 1 may be operable in a normal mode, an image adjustment mode, and a cleaning mode by the control device.

Normal Mode

The normal mode is a mode in which toner images are formed by the photosensitive drums 40, e.g., image carriers, so that the toner images can be transferred onto paper sheets P.

In the normal mode, the bias application device 110 applies a transfer bias to the secondary transfer roller 33 for transferring toner images onto paper sheets P. The toner images that have been primarily transferred from the photosensitive drums 40 to the transfer belt 31 are thereby secondarily transferred from the transfer belt 31 onto the paper sheets P in the transfer nip region R2.

Image Adjustment Mode

Figure 3:
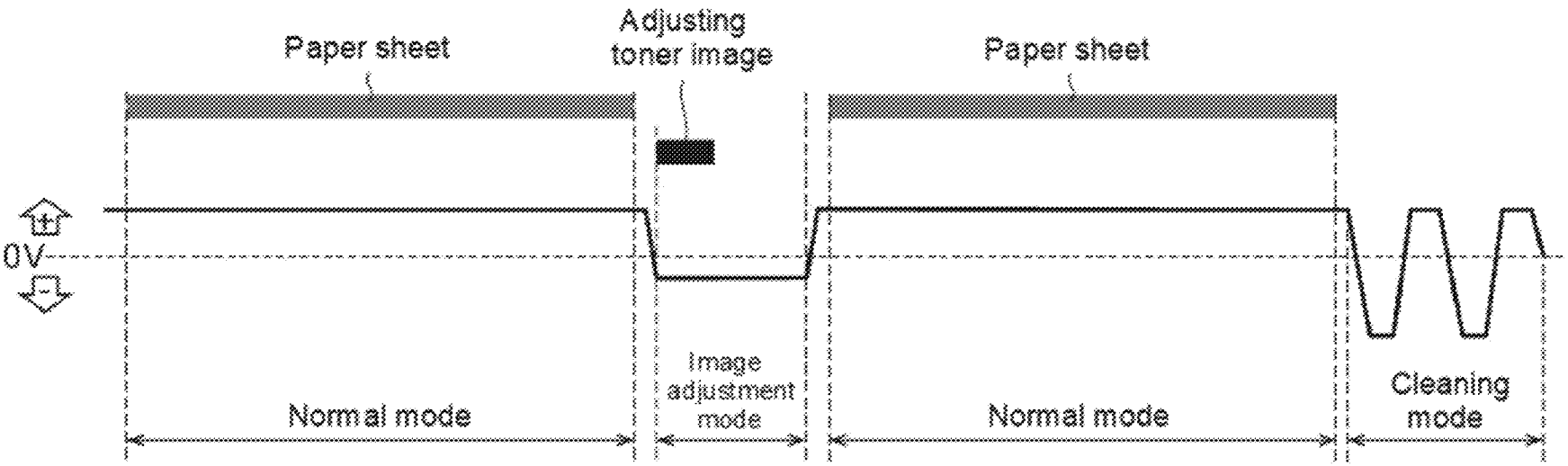
FIG. 3 is a graph illustrating operational modes of the example image forming apparatus.

With reference to FIG. 3, the image adjustment mode is a mode in which adjusting toner images to perform an image adjustment operation are formed by the photosensitive drums 40, e.g., image carriers, so as to perform an image adjustment. As shown in FIG. 3, the image adjustment mode may be executed during successive running, where toner images are successively transferred to a plurality of paper sheets P, in a period in which the paper sheets P are not passing through the transfer nip region R2.

In the image adjustment mode, a plurality of adjusting toner images are carried by the photosensitive drums 40. More specifically, the plurality of adjusting toner images may be separated toward the axial direction (longitudinal direction) of the photosensitive drums 40 and formed at axially central portions around the ends of the photosensitive drums 40. The adjusting toner images formed by the photosensitive drums 40 may be primarily transferred onto the transfer belt 31 and detected by image adjustment sensors (not shown) disposed in the vicinity of the transfer belt 31. Then, based on the results of detection with the image adjustment sensors, image adjustments such as color registration adjustment and density adjustment can be performed.

In the image adjustment mode, as the paper sheets P do not pass through the transfer nip region R2, the adjusting toner images moved to the transfer nip region R2 are made to contact with the secondary transfer roller 33. In view of this, in the image adjustment mode, the bias application device 110 applies a constant reverse bias to the secondary transfer roller 33. The reverse bias is a bias of a polarity opposite to that of the normal mode, and thus is opposite in polarity to the transfer bias. With this, the adjusting toner images that have been primarily transferred from the photosensitive drums 40 to the transfer belt 31 can be suppressed from being transferred from the transfer nip region R2 to the secondary transfer roller 33.

If the polarity of the toner adhered onto the secondary transfer roller is reversed when the bias application device 110 applies the reverse bias to the secondary transfer roller 33, the amount of toner to be transferred to the secondary transfer roller may increase. Accordingly, the bias application device 110 should apply the reverse bias to the secondary transfer roller 33 in such a manner that a charge polarity per unit mass of the adjusting toner image adhered to the secondary transfer roller 33 will be the same polarity as a charge polarity per unit mass of the adjusting toner images carried on the photosensitive drums 40.

In addition, switching the bias may accompany a delay time and noise may be generated by switching the bias. Accordingly, the bias application device 110 may apply the reverse bias to the transfer roller 33 such that the reverse bias is applied to the bias application device 110 at least during a period in which the adjusting toner image is passing through the transfer nip region R2.

Figure 4:
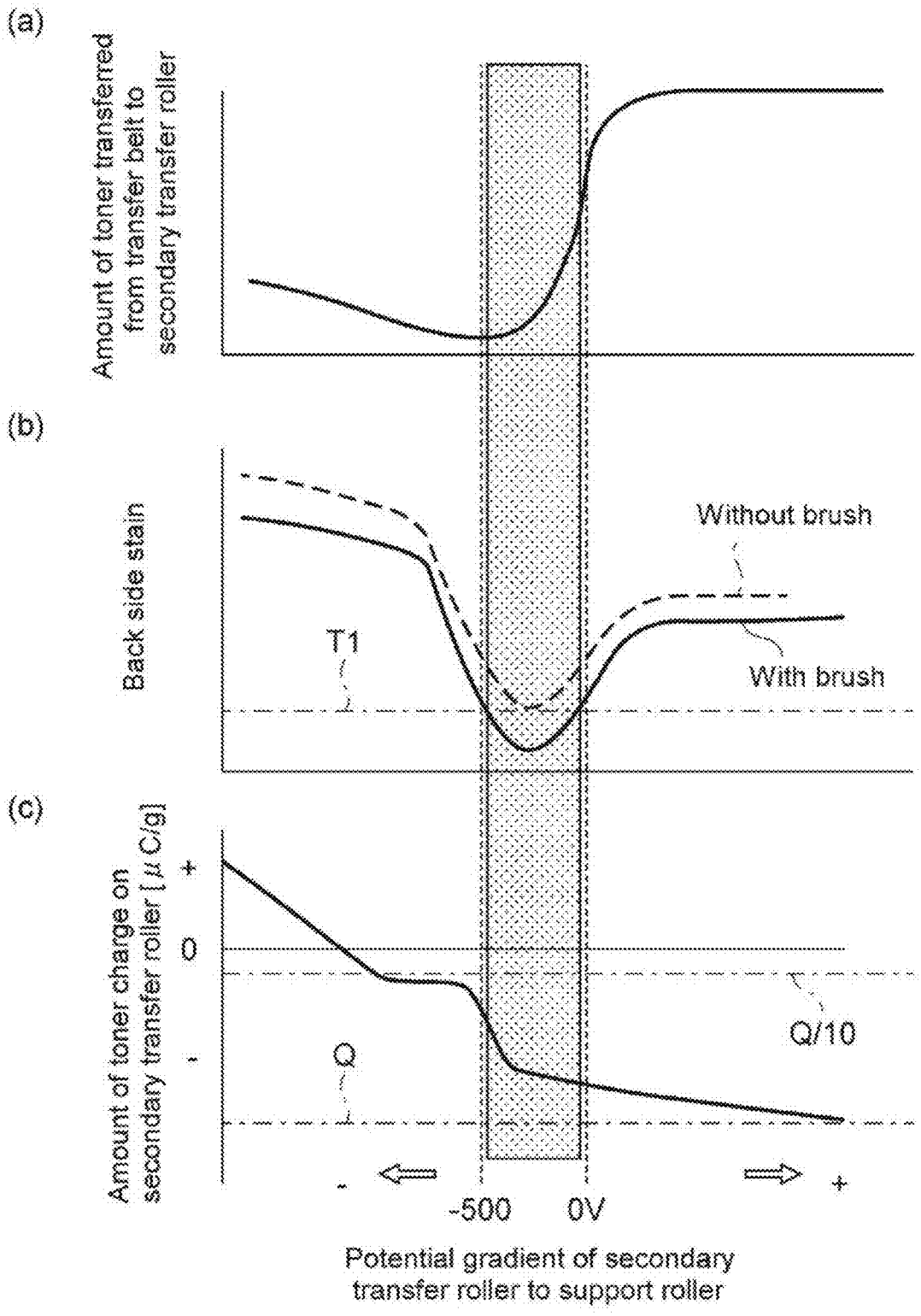
FIG. 4 is a graph showing an electric gradient of a secondary transfer roller to a support roller, in relation to an amount of toner transferred from a transfer belt to the secondary transfer roller, to a back side stain of paper sheets, and to an amount of toner charge on the secondary transfer roller.

With reference to FIG. 4, amounts of toner transferred from the transfer belt 31 to the secondary transfer roller 33, back side stains of paper sheets P, and amounts of toner charge on the secondary transfer roller 33, relative to an electric gradient of the secondary transfer roller 33 to the support roller 37, in the image adjustment mode, have been measured. The results are shown in the graphs (a), (b), and (c) of FIG. 4. The graph (a) shows a relation between an electric gradient of the secondary transfer roller 33 to the support roller 37 and an amount of toner transferred from the transfer belt 31 to the secondary transfer roller 33. The graph (b) shows a relation between an electric gradient of the secondary transfer roller 33 to the support roller 37 and back side stain of the paper sheets P. The graph (c) shows a relation between an electric gradient of the secondary transfer roller 33 to the support roller 37 and an amount of toner charge on the secondary transfer roller 33. In the graph (b), a densitometer SectroEYE available from X-Rite was used to measure the image density on the back side of paper sheets P that have passed through the transfer nip region R2 after completion of the image adjustment mode, and the measured results were used to indicate the back side stain. Then, based on a result of sensory evaluation, an image density of 0.005 was defined as a threshold T1 for back side stain. That is, when a density on the back side is 0.005 or less, it can be determined that no back side stain is generated.

As shown in the graphs (a) and (b) of FIG. 4, in the image adjustment mode, the amount of transferred toner was decreased when the reverse bias was applied to the secondary transfer roller 33, and the amount of transferred toner was significantly decreased when the applied reverse bias exceeded −100 V. When the reverse bias exceeded −500 V, the amount of transferred toner increased due to a reverse charge caused by peeling discharge or an increased amount of transferred toner having opposite polarity. When the toner is positively charged, the results may be substantially similar, except for polarity.

In view of the above, an absolute value of the reverse bias applied by the bias application device 110 to the secondary transfer roller 33 in the image adjustment mode may be 500 V or less in some examples, and 100 V or more in some examples. In the normal mode, an absolute value of the reverse bias applied by the bias application device 110 to the secondary transfer roller 33 may be about 1000 V. Accordingly, an absolute value of the reverse bias applied by the bias application device 110 to the secondary transfer roller 33 in the image adjustment mode may be ½ or less of an absolute value of the transfer bias applied by the bias application device 110 to the secondary transfer roller 33 during the normal mode.

An amount of charge per unit mass of the adjusting toner images carried on the photosensitive drums 40 may be defined as Q and an amount of charge per unit mass of the adjusting toner image adhered onto the secondary transfer roller 33 may be defined as q. As shown in the graph (c) of FIG. 4, the polarity of the toner adhered onto the secondary transfer roller 33 was reversed when the charge amount q was 1/10 or less of the charge amount Q. Accordingly, in the image adjustment mode, the bias application device 110 may apply the reverse bias to the secondary transfer roller 33 to satisfy a relation $q \geq (1/10) \times Q$.

Cleaning Mode

The cleaning mode is a mode in which the transfer device 30 is cleaned at such timing that is different from the normal mode and the image adjustment mode.

With reference to FIG. 3, the cleaning mode may be performed at an arbitrary timing after the completion of the successive printing, where toner images are successively transferred to a plurality of paper sheets P. In the cleaning mode, the bias application device 110 alternately applies positive and negative biases to the secondary transfer roller 33. This enables to return toner attached to the bar brush 100 to the secondary transfer roller 33 for cleaning.

Bar Brush

Figure 5A:
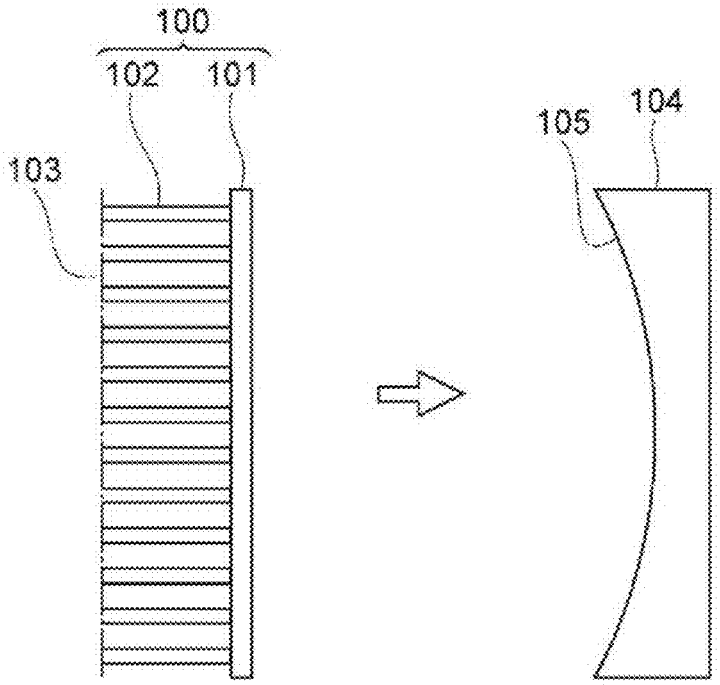
FIG. 5A is a schematic diagram of an example bar brush to be fixed to a fixing component.
Figure 5B:
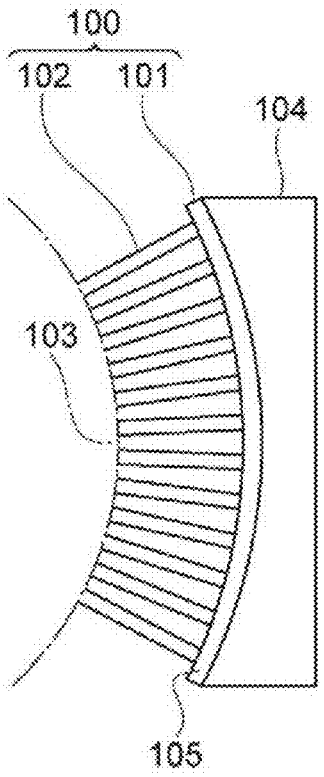
FIG. 5B is a schematic diagram of the example bar brush fixed to the fixing component.
Figure 6:
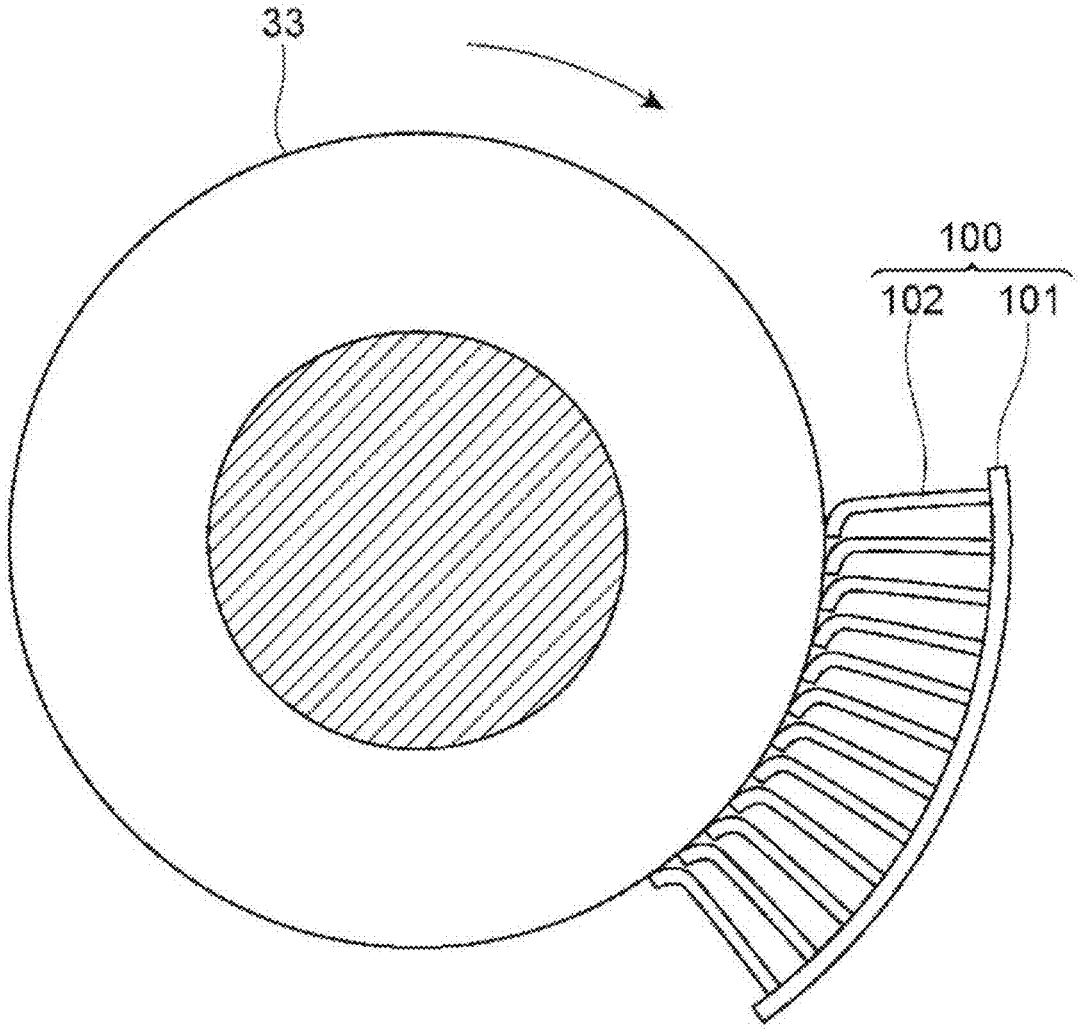
FIG. 6 is a schematic diagram secondary transfer roller and the example bar brush.

With reference to FIGS. 5A, 5B and 6, the bar brush 100 may include a base substrate 101 located at a position which is fixed relative to the secondary transfer roller 33, and a plurality of bristles 102 stemming from (e.g., planted in) the base substrate 101, to make pressure contact with the secondary transfer roller 33. The plurality of bristles 102 have free ends forming a tip end surface 103. The tip end surface 103 has a curve-shaped that conforms with a surface of the secondary transfer roller 33. Accordingly, the tip end surface 103 of the bristles 102 is no planar, but it is instead curved similarly to the surface of the secondary transfer roller 33. For example, to conform with a surface of the secondary transfer roller 33 may connote curved shapes which are more or less deviated from the surface shape of the secondary transfer roller 33.

The base substrate 101 is made of a flexible material formed into a planar or sheet shape. The plurality of bristles 102 are each provided (e.g., planted) substantially vertically into the base substrate 101. The lengths of the plurality of bristles 102 planted to the base substrate 101 may be approximately the same. The lengths of the bristles 102 refer to the lengths of portions projecting from the base substrate 101. The lengths of the plurality of bristles 102 being approximately the same may means that they are substantially the same and manufacturing errors and tolerances are allowed. The base substrate 101 is bent to a curved shape that conforms with the surface of the secondary transfer roller 33. For example, a fixing component 104 to which the base substrate 101 is fixed is disposed on a frame (not shown) of the image forming apparatus 1, and a fixing surface 105 of the fixing component 104 to which the base substrate 101 is fixed is formed into a curved shape that conforms with the surface of the secondary transfer roller 33. Accordingly, the tip end surface 103 of the plurality of bristles 102 is formed into a curved shape that conforms with the surface of the secondary transfer roller 33.

The lengths of the plurality of bristles 102 may differ depending on manufacturing errors and tolerances of the bar brush 100. Taking into consideration manufacturing errors and tolerances of the bar brush 100, a substantial tip end surface of the plurality of bristles 102 may be regarded as the tip end surface 103 of the plurality of bristles 102.

Figure 7:
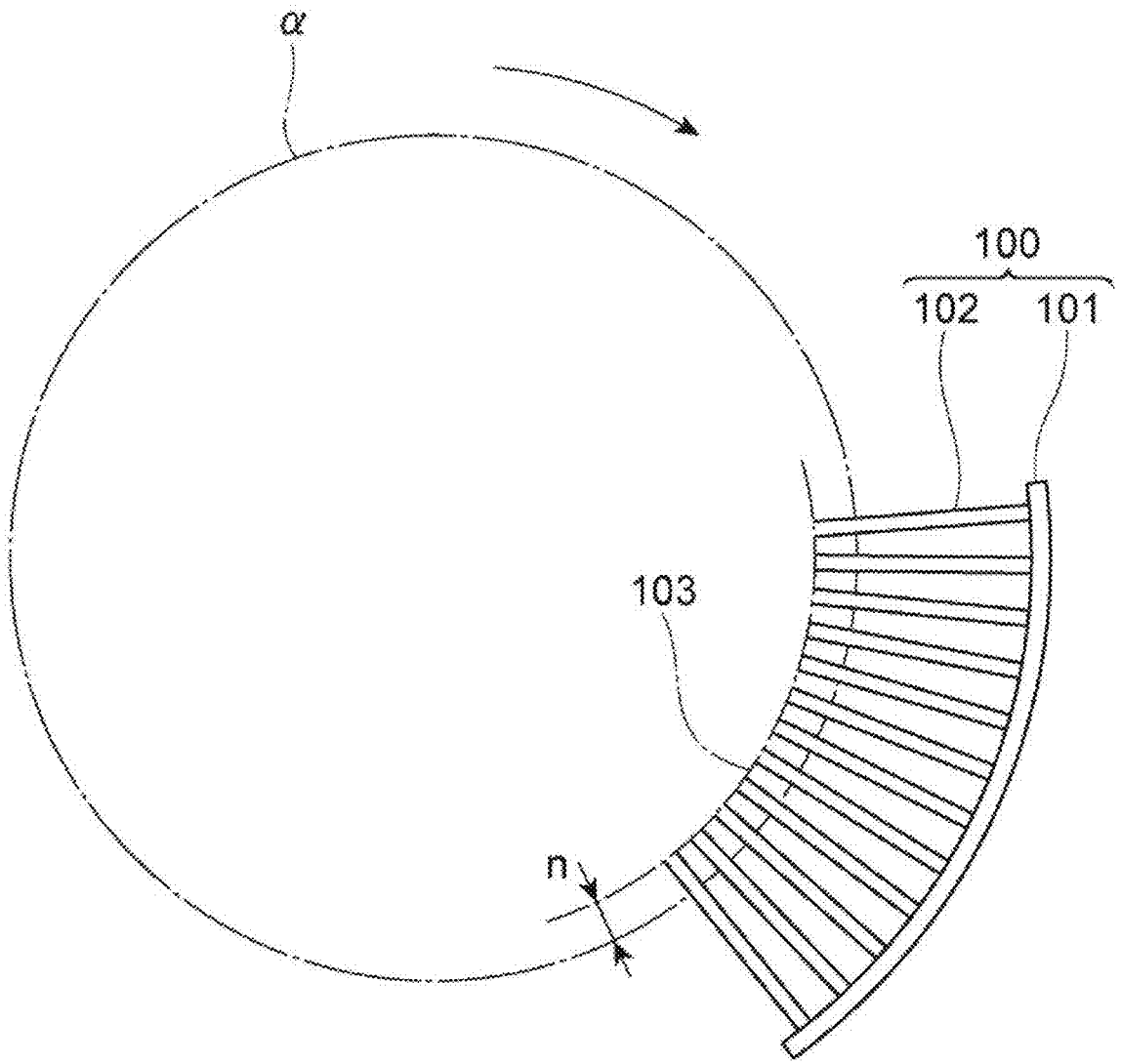
FIG. 7 is a schematic diagram of a bar brush illustrating a bite amount of bristles.

A difference between a maximum bite amount and a minimum bite amount of the bristles 102 into the secondary transfer roller 33 may be 1.0 mm or less. As shown in FIG. 6, when the bar brush 100 is made to pressure contact with the secondary transfer roller 33, the tip ends of the plurality of bristles 102 are pushed against the secondary transfer roller 33 and are flexed. As shown in FIG. 7, assuming that the secondary transfer roller 33 is not present, an amount by which the bristles 102 bite beyond a virtual line a indicative of a surface position of the secondary transfer roller 33 (the length extending inwardly of the secondary transfer roller 33 beyond the virtual line a) is defined as a bite amount n of the bristles 102 into the secondary transfer roller 33.

Measurements were taken to determine a relation among a length of the tip end surface 103 of the plurality of bristles 102 in a circumferential direction of the secondary transfer roller 33, back side stain of paper sheets P in the image adjustment mode, and the bite amount n of the bristles 102. To take the measurements, bar brushes 100 with a length of the tip end surface 103 of the plurality of bristles 102 in the circumferential direction of the secondary transfer roller 33 of 5 mm, 10 mm, 15 mm and 20 mm were prepared. Then, back side stain of paper sheets P was measured, while changing the bite amount n of the bristles 102 in the respective bar brushes 100 to 0.5 mm, 1.0 mm, 1.5 mm, 2.0 mm and 2.5 mm. The length of the tip end surface 103 of the plurality of bristles 102 in the circumferential direction of the secondary transfer roller 33 is the same as a length at the roots of the plurality of bristles 102, e.g., the length of a plant region on the base substrate 101 in which the plurality of bristles 102 are planted. However, as shown in FIG. 5B, in the case when the bar brush 100 is bent in a shape corresponding to the outer peripheral surface of the secondary transfer roller 33, the length of the tip end surface bristles 103 of the plurality of bristles 102 is shorter than the length of the plant region of the plurality of bristles 102. The definition of back side stain is the same as the back side stain indicated in FIG. 4. The measured results are shown in FIG. 8.

Figure 8:
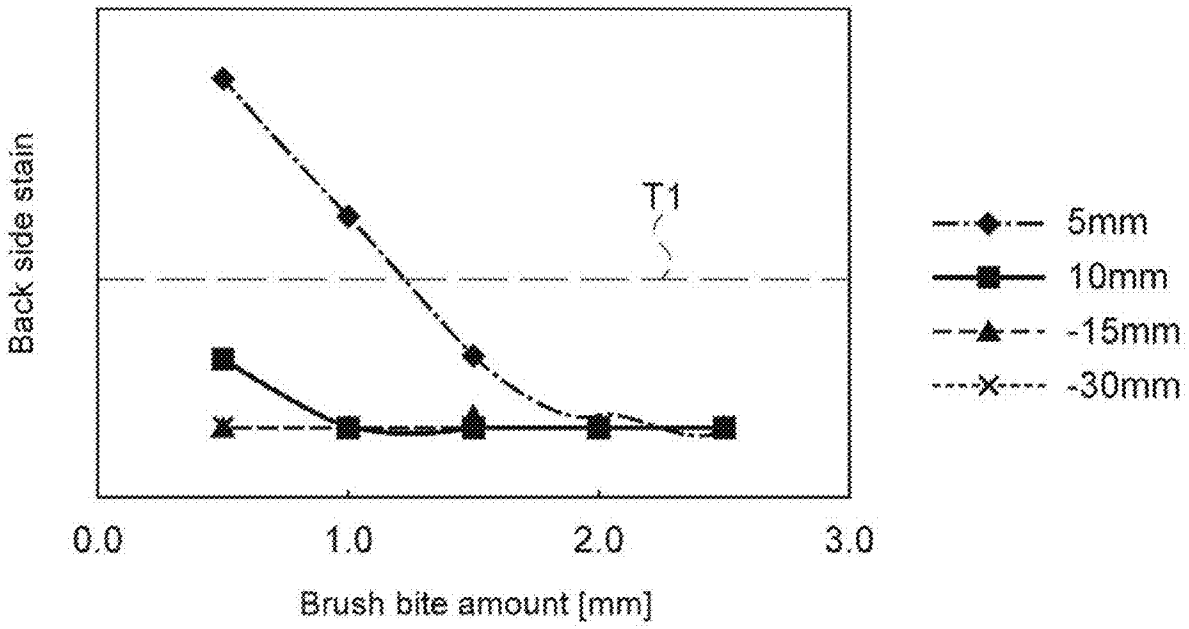
FIG. 8 is a graph illustrating a length of a plurality of bristles in a circumferential direction of the secondary transfer roller, and back side stain of paper sheets in an image adjustment mode, in relation to a bite amount of bristles.

As shown in FIG. 8, when the length of the tip end surface 103 of the plurality of bristles 102 in the circumferential direction of the secondary transfer roller 33 was 5 mm, the back side stain was suppressed below the threshold T1 by increasing the bite amount n, but the back side stain was not suppressed below the threshold T1 when the bite amount n was small. In contrast, when the length was 10 mm or more, the back side stain of paper sheets P did not exceed the threshold T1 regardless the bite amount n. Accordingly, the length of the tip end surface 103 of the plurality of bristles 102 in the circumferential direction of the secondary transfer roller 33 may be 10 mm or more. If the length of the tip end surface 103 varies in the axial direction of the secondary transfer roller 33, a maximum length of the tip end surface 103 in the circumferential direction of the secondary transfer roller 33 will be the length of the tip end surface 103 in the circumferential direction of the secondary transfer roller 33. If the length was 10 mm or more, the length of the tip end surface 103 of the plurality of bristles 102 in the circumferential direction of the secondary transfer roller 33 had little influence on the back side stain.

While the length of the bristles 102 is not particularly limited, the length of the bristles 102 may be 2 mm or more in some examples, of 4 mm or more in other examples, to suppress the driving torque of the secondary transfer roller 33. The length of the bristles 102 may be 10 mm or less in some examples, or 6 mm or less in other examples, to impart resilience to the bristles 102.

While the thickness of the bristles 102 is not particularly limited, the thickness of the bristles 102 may be of 10 dtex or less in some examples, or 4 dtex or less in other examples, to suppress the driving torque of the secondary transfer roller 33. The thickness of the bristles 102 may be 2 dtex or more in some examples, to impart resilience to the bristles.

The thickness of the bristles 102 be represented by D dtex and a plant density of the bristles 102 may be represented by W1*d* bristles per inch. Measurements were taken to determine a relation of the bite amount n of the bristles 102, a product D×W1*d*, a driving torque of the secondary transfer roller 33, and back side stain of paper sheets P. To take the measurements, bar brushes 100 with the product D×W1*d* of 250, 500, 750 and 900 were prepared. The driving torque of the secondary transfer roller 33 and the back side stain of paper sheets P were measured, while changing the bite amount n of the bristles 102 in the respective bar brushes 100 to 0.0 mm, 0.5 mm, 1.0 mm, 1.5 mm, 2.0 mm and 2.5 mm. A threshold T2 may represent a driving torque at which deficiency of the secondary transfer roller 33 occurs in terms of followability. For example, where the driving torque of the secondary transfer roller 33 is at or below the threshold T2, it can be determined that a deficiency in followability of the secondary transfer roller 33 does not occur. Accordingly, as the secondary transfer roller 33 follows the movement of the transfer belt 31 due to surface pressure, a driving torque that signifies a limit in followability of the secondary transfer roller 33 is defined as the threshold T2 of occurrence of deficiency in followability. The limit in followability of the secondary transfer roller 33 means that the rotation speed of the secondary roller 33 is 90% or less of the speed of the transfer belt 31. The definition of back side stain is the same as the back side stain indicated in FIG. 4, and the threshold T1 of the back side stain is the same as the threshold T1 shown in FIG. 4. The measured results are shown in FIG. 9 and FIG. 10.

Figure 9:
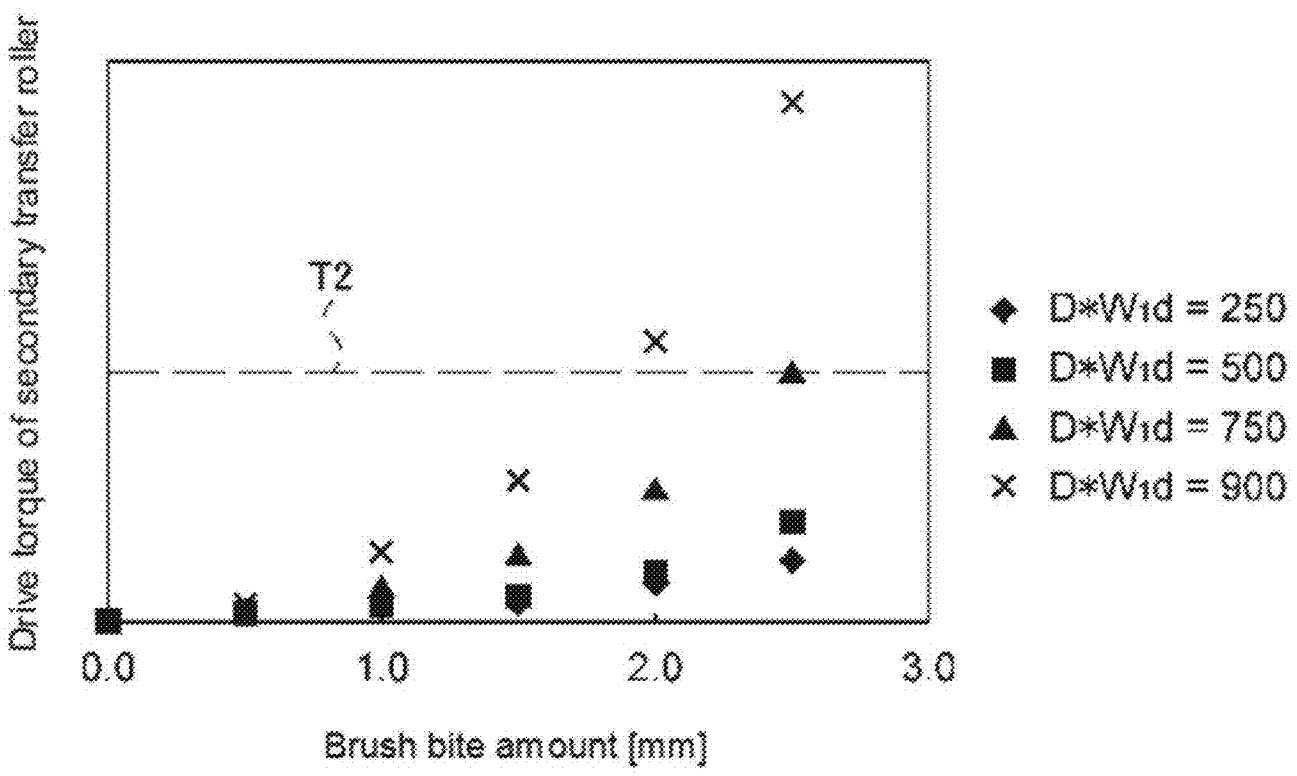
FIG. 9 is a graph illustrating a driving torque of the secondary transfer roller in relation to a bite amount of the bristles, for combinations of thickness of bristles and plant density of the bristles.
Figure 10:
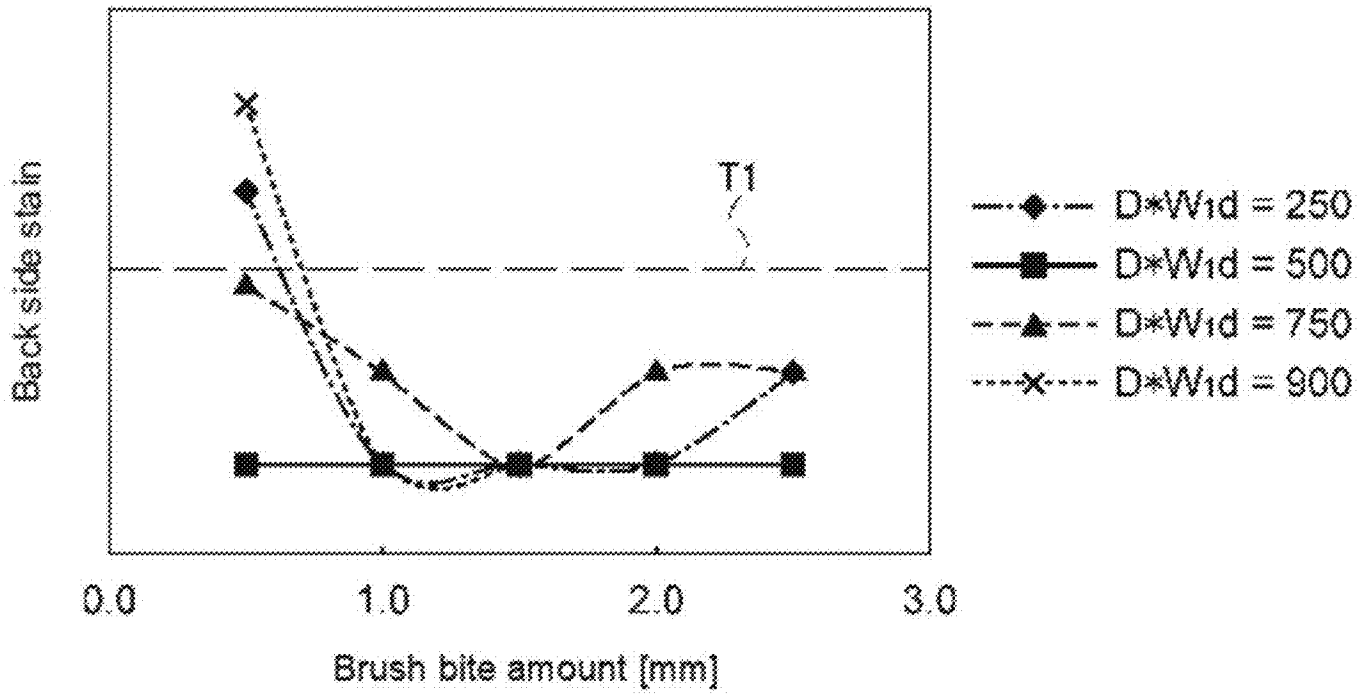
FIG. 10 is a graph illustrating a back side stain of paper sheets in relation to a bite amount of the bristles, for combinations of thickness of bristles and plant density W1*d* of the bristles.

As shown in FIG. 9, when D×W1*d* was 850 or less, the driving torque of the secondary transfer roller 33 was not influenced when the bite amount n was 2.0 mm. As shown in FIG. 10, when D×W1*d* was 250 or less or 900 or more, the back side stain exceeded the threshold T1 when the bite amount n was 0.5 mm, but when D×W1*d* was 300 or more and 850 or less, the back side stain did not exceed the threshold T1 regardless the bite amount n. Accordingly, the thickness D and the plant density W1*d* of the bristles 102 may be set to satisfy a relation of $300 \leq D \times W1d \leq 850$.

In actual implementations, it is the tip end portions of the bristles 102 that are made to pressure contact with the secondary transfer roller 33. The density of the bristles 102 at the tip end surface 103 may be represented by W2*d* bristles per inch. The thickness D tex of the bristles 102 and the density W2*d* bristles per inch of the bristles 102 at the tip end surface 103 may be set to satisfy a relation of $350 \leq D'W2d \leq 1050$.

The bar brush 100 diffuses toner adhered onto the secondary transfer roller 33 by flexure of the bristles 102. The length of the bristles 102 may be represented by L. The bite amount n may be 1/10 of the length L, to provide sufficient flexing the bristles 102. In addition, the bite amount n may be ½ or less of the length L, to prevent the bristles from breaking at roots and losing flexure of the bristles. Accordingly, the length L and the bite amount n may be set to satisfy the relation of $L/10 \leq n \leq L/2$.

The bar brush 100 may be an insulating brush or a conductive brush. Where the bar brush 100 is a conductive brush, the bar brush 100 may be electrically floated with respect to the secondary transfer roller 33, to prevent the bias applied to the secondary transfer roller 33 from flowing to the bar brush 100 (cf. FIG. 2).

Although the material of the bristles 102 is not particularly limited, the material may include PET, nylon and/or acrylic, or a mixture of these, for better ease of manufacturing.

Figure 11:
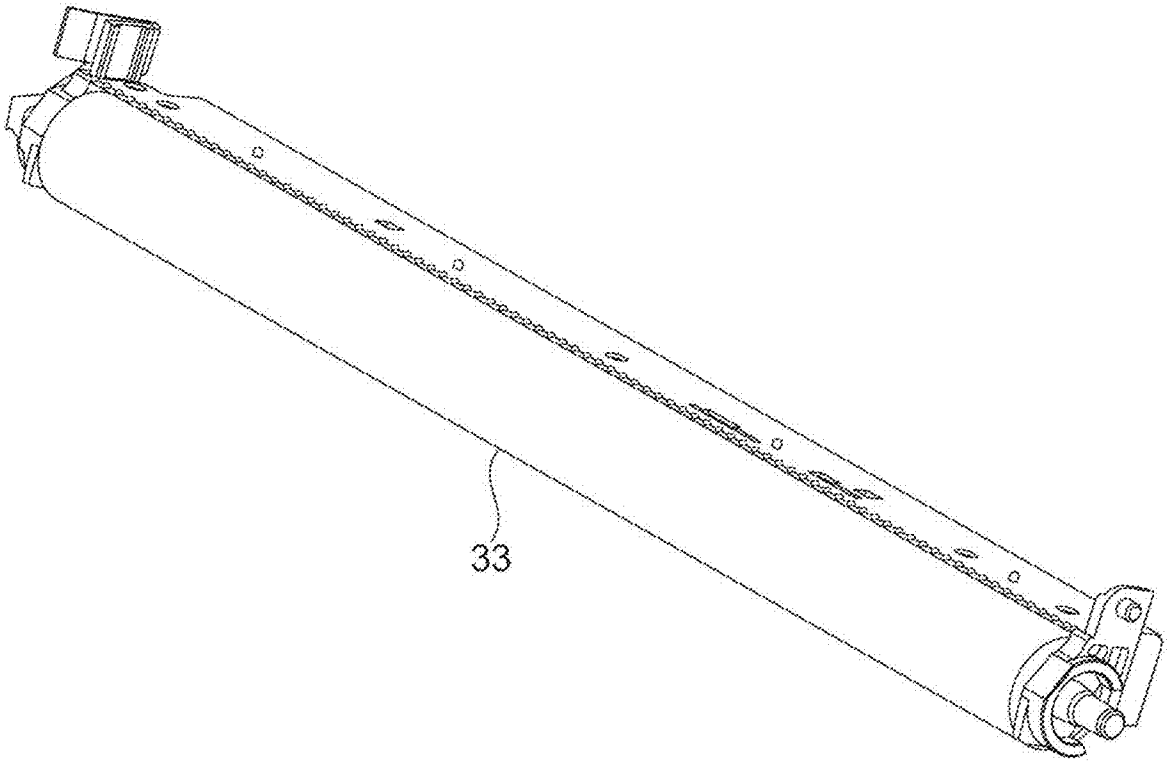
FIG. 11 is a perspective view an example secondary transfer roller with a support structure.
Figure 12:
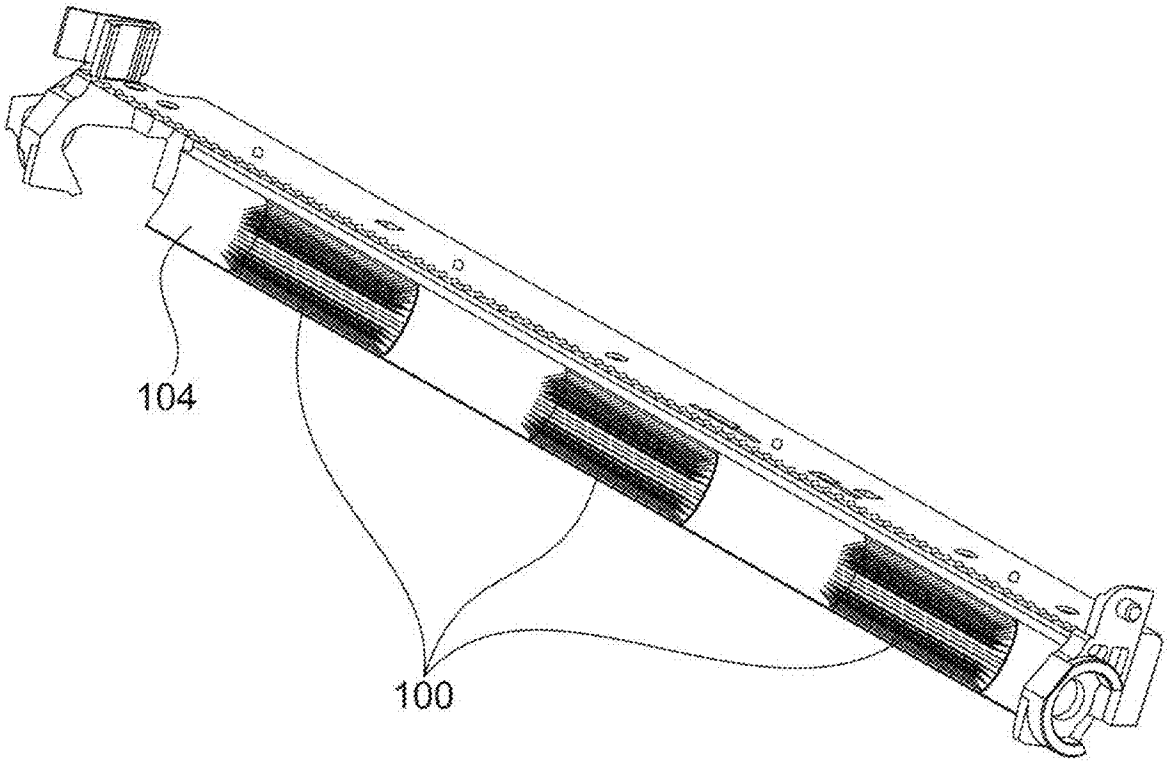
FIG. 12 is a perspective view of the support structure of FIG. 11, illustrated without the secondary transfer roller.

Although, the number and arrangement of the bar brush 100 are not particularly limited, the bar brush 100 may be disposed, along the axial direction of the secondary transfer roller 33, in a position at which adjusting toner images pass through the transfer nip region R2. For example, where a plurality of adjusting toner images are carried on the photosensitive drums 40 and spaced apart along the axial direction of the photosensitive drums 40 in the image adjustment mode as described above, bar brushes 100 may be disposed at positions at which the respective adjusting toner images pass through the transfer nip region R2, as shown in FIG. 11 and FIG. 12. In this case, three bar brushes 100 are spaced apart e.g., the bar brush 100 is disposed discontinuously along the axial direction of the secondary transfer roller 33.

As shown in FIG. 2, the secondary transfer roller 33 includes a cylindrical core metal (or metal core) 33*a* and a cylindrical foam layer 33*b* disposed around the outer circumference of the core metal 33*a*.

The foam layer 33*b* is composed of unfoamed skeletons (not shown) and foamed cells (not shown). Then, the secondary transfer roller 33 may be less susceptible to chemical adhesion to toner if its surface has a higher releasability. Further, in the foam layer 33*b*, a contact area with the toner on the transfer belt 31 can be reduced if the cells are plenty and the skeletons are not.

The releasability may be expressed in terms of a static coefficient of friction μ. The foam layer 33*b* can reduce back side stain of paper sheets P if the static coefficient of friction μ is 10.6 or less with respect to the secondary transfer roller 33 and a percentage of foam cells is 66% or more. For example, in a cross section of the foam layer 33*b*, the diameter of cells in the foam layer 33*b* may be 500 μm or less, for an improved transferability of the secondary transfer roller 33. The diameter of cells in the foam layer 33*b* may represent a maximum diameter of cells in the foam layer 33*b*. Further, in a cross section of the foam layer 33*b*, a static coefficient of friction of the foam layer 33*b* to the secondary transfer roller 33 may be 10.6 or less, in an environment at a temperature of 30° C. and a humidity of 85%, to impart sufficient releasability to the surface of the secondary transfer roller 33.

In the above-described example, the bar brush 100 is made to pressure contact with the secondary transfer roller 33, such that the plurality of bristles 102 of the bar brush 100 diffuse toner adhered onto the secondary transfer roller 33. As the tip end surface 103 of the plurality of bristles 102 is formed into a curved shape that conforms with the surface of the secondary transfer roller 33, the bar brush 100 can make pressure contact with the secondary transfer roller 33 over the entire region of the bar brush 100 in the circumferential direction (rotation direction) of the secondary transfer roller 33, in order to better diffuse and remove the toner adhered onto the secondary transfer roller 33, and improve the cleaning property.

In addition, even if the secondary transfer roller 33 is fixed in position relative to the intermediate transfer body and the support rollers, the provision of the aforementioned bar brush 100 enables to enhance the cleaning property.

In some examples, the bristles 102 may be planted in the base substrate 101 substantially vertically. Accordingly, the bar brush 100 can be manufactured more easily and at a lower cost. By bending the base substrate 101 into a curved shape that conforms with the surface of the secondary transfer roller 33, the tip end surface 103 of the plurality of bristles 102 can be easily formed into a curved shape that conforms with the surface of the secondary transfer roller 33.

In some examples, the lengths of the plurality of bristles 102 may have approximately a same length. Accordingly, the bar brush can be manufactured more easily and at a lower cost.

In some examples, the difference between a maximum bite amount and a minimum bite amount of the bristles 102 into the secondary transfer roller 33 may be 1.0 mm or less. Accordingly, the bar brush 100 can make pressure contact substantially uniformly with the secondary transfer roller 33 over the entire region of the bar brush 100 in the circumferential direction (rotation direction) of the secondary transfer roller 33, while allowing for manufacturing errors of the bar brush 100 and mounting errors of the bar brush 100.

In some examples, the length of the tip end surface of the plurality of bristles 102 in the circumferential direction of the secondary transfer roller 33 may be 10 mm or more. Accordingly, the contact width between the bar brush 100 and the secondary transfer roller 33 in the circumferential direction of the secondary transfer roller 33 may be 10 mm or more, thereby providing a sufficient diffusing effect for toner by the bar brush 100.

In some examples, the bar brush 100 may be an insulating brush, to suppress charged toner from adhering onto the bar brush 100.

In some examples, the bar brush 100 may be a conductive brush, e.g., the bar brush 100 may be electrically floated with respect to the secondary transfer roller 33 so that, when a bias is applied to the secondary transfer roller 33, the bias can be prevented from flowing into the bar brush 100.

In some examples, the length of the bristles 102 may be 2 mm or more and 10 mm or less, to impart the bristles 102 with resilience without requiring an excessive driving torque for the secondary transfer roller 33.

In some examples, the thickness of the bristles 102 may be 2 dtex or more and 10 dtex or less, to impart the bristles 102 with resilience without requiring an excessive driving torque for the secondary transfer roller 33.

In some examples, the thickness D of the bristles 102 (in dtex), the plant density W1*d* of the bristles 102 (in bristles per inch), and/or the density W2*d* of the bristles 102 at the tip end surface 103 (in bristles per inch), may be set to satisfy the condition $300 \leq D \times W1d \leq 850$ or the condition $350 \leq D \times W2d \leq 1050$, in order to suitable diffuse toner by the bar brush 100 without requiring an excessive driving torque for the secondary transfer roller 33.

In some examples, the length L of the bristles 102 and the bite amount n may be set to satisfy the condition $L/10 \leq n \leq L/2$, to provide sufficient flexure of the bristles 102 and prevent the bristles 102 from losing flexure of the bristles 102 by breaking at roots.

In some examples, the material of the bristles 102 may include PET, nylon and/or acrylic, or a mixture of these, to suitably diffuse toner by the bar brush 100, while maintaining easy manufacturability.

In some examples, the bar brush 100 may be disposed in a position at which adjusting toner images pass through the transfer nip region R2, to improve an efficiency of cleaning of the secondary transfer roller 33.

In some examples, the bar brush 100 may be disposed discontinuously along the axial direction of the secondary transfer roller 33, to improve an efficiency of cleaning when a plurality of adjusting toner images are spaced apart and carried on the photosensitive drums 40.

In some examples, the diameter of cells in the foam layer 33*b may be* 500 μm or less in the secondary transfer roller 33, to better maintain a transferability of the secondary transfer roller 33. In addition, the static coefficient of friction of the foam layer 33*b to the secondary transfer roller* 33 *may be* 10.6 or less in an environment at a temperature of 30° C. and a humidity of 85%, to impart sufficient releasability to the surface of the secondary transfer roller 33.

In some examples, a reverse bias is applied to the secondary transfer roller 33 in the image adjustment mode, to better suppress adhesion of toner onto the secondary transfer roller 33.

In some examples, the image adjustment mode to apply a constant reverse bias (e.g. apply a reverse bias continuously) to the secondary transfer roller 33 may be performed in a period in which successively running paper sheets P are not passing through the transfer nip region R2, in order to better suppress the transfer to the secondary transfer roller 33 of toner flowing into the transfer nip region R2.

In some examples, the bias application device 110 may alternately apply positive and negative biases to the secondary transfer roller 33 in the cleaning mode, to return toner attached to the bar brush 100, to the secondary transfer roller 33 for cleaning.

In some examples, a reverse bias having an absolute value of 500 V or less may be applied to the secondary transfer roller 33 during the image adjustment mode, in order to suppress the transfer of toner charged to the opposite polarity to the secondary transfer roller 33.

In some examples, an absolute value of the reverse bias applied to the secondary transfer roller 33 during the image adjustment mode may be ½ or less of an absolute value of the bias applied to the secondary transfer roller 33 during the normal mode, in order to suppress the transfer of toner charged to the opposite polarity, to the secondary transfer roller 33.

In some examples, the reverse bias may be applied at least during a period in which the adjusting toner image is passing through the transfer nip region R2, in order to suppress a decrease of cleaning property due to noise generated by switching the bias, at least during the period in which the adjusting toner image is passing through the transfer nip region R2.

In some examples, in the image adjustment mode, the reverse bias is may be applied to the secondary transfer roller 33 in such a manner that a charge polarity per unit mass of the adjusting toner image adhered to the secondary transfer roller 33 is the same polarity as a charge polarity per unit mass of the adjusting toner images carried on the photosensitive drums 40, in order to inhibit the polarity of the toner adhered onto the secondary transfer roller 33 from reversing, thereby suppressing an increase in the amount of toner to be transferred to the secondary transfer roller 33.

In some examples, the amount of charge per unit mass q of the adjusting toner image adhered onto the secondary transfer roller 33, and the amount of charge per unit mass Q of the adjusting toner images carried on the photosensitive drums 40, are set to satisfy the condition $q \leq (1/10) \times Q$, in order to suppress the polarity of the toner adhered to the secondary transfer roller 33 from reversing.

FIG. 13 shows measurement results of an experiment conducted with an imaging forming apparatus of a comparative example (Comparative Example 1). The experiment conducted will be described.

In the experiment of Comparative Example 1, an image forming apparatus without any bar brush was used. A plain paper (80 g/m2), a thick paper (250 g/m2), a single coated paper (250 g/m2), a double coated paper (80 g/m2) and a double coated paper (matt) (210 g/m2) were used as paper sheets, and the image adjustment mode was performed under an environment at a temperature of 30° C. and a humidity of 85%, an environment at a temperature of 22° C. and a humidity of 55%, and an environment at a temperature of 10° C. and a humidity of 10%. A densitometer SpectroEYE available from X-Rite was used to measure the image density on the back side of paper sheets that have passed through the transfer nip region after completion of the image adjustment mode, and the measured results were used to indicate the back side stain. In addition, based on a result of sensory evaluation, an image density of 0.005 was defined as a threshold T1 for back side stain. For example, when a density on the back side is 0.005 or less, it can be determined that no back side stain is generated.

With reference to the measurement results of FIG. 13, in Comparative Example 1, a back side stain was generated on paper sheets for the double coated papers and under high-temperature and high-humidity environments.

Figure 14:
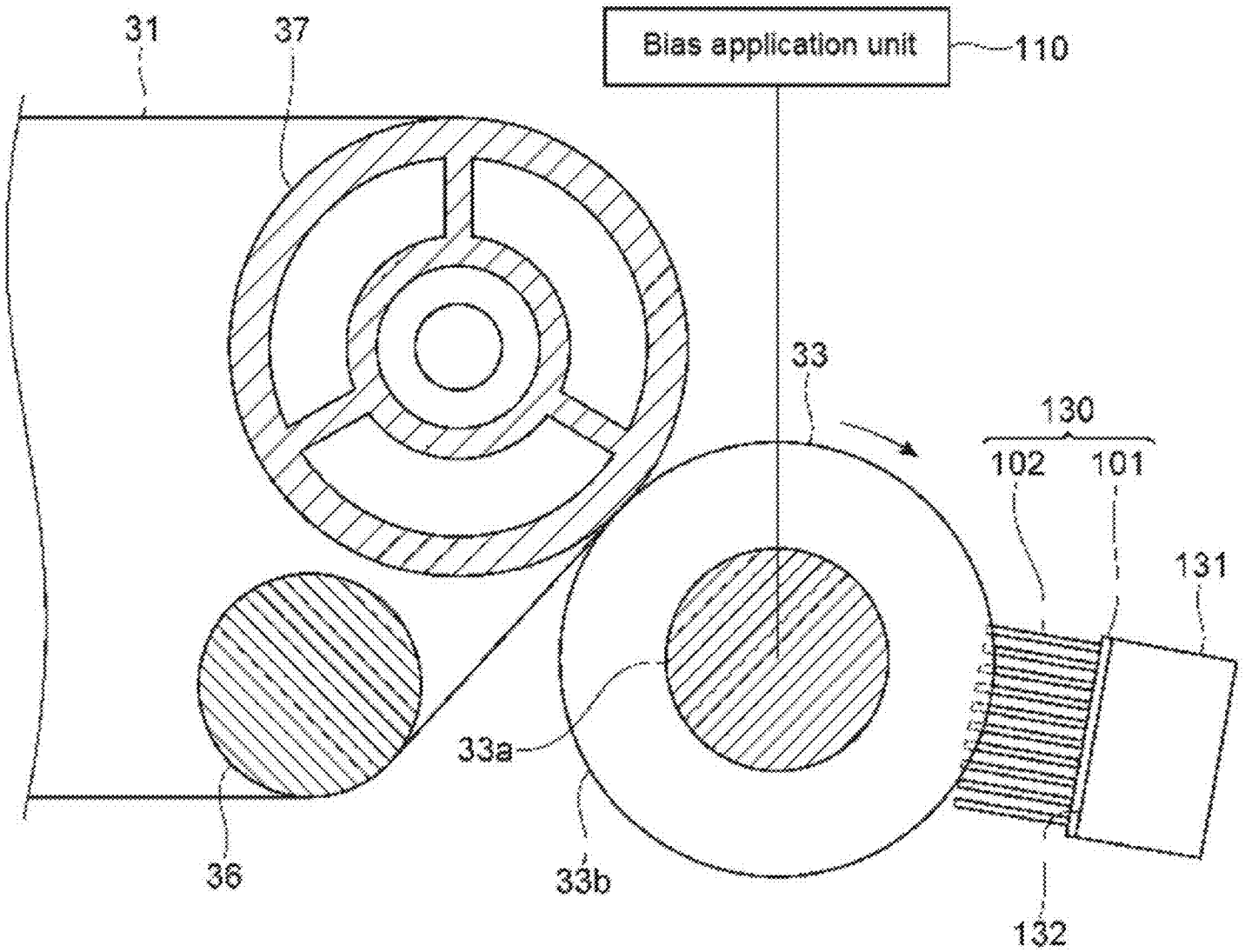
FIG. 14 is a schematic diagram of a transfer device according to a comparative example.
Figure 16:
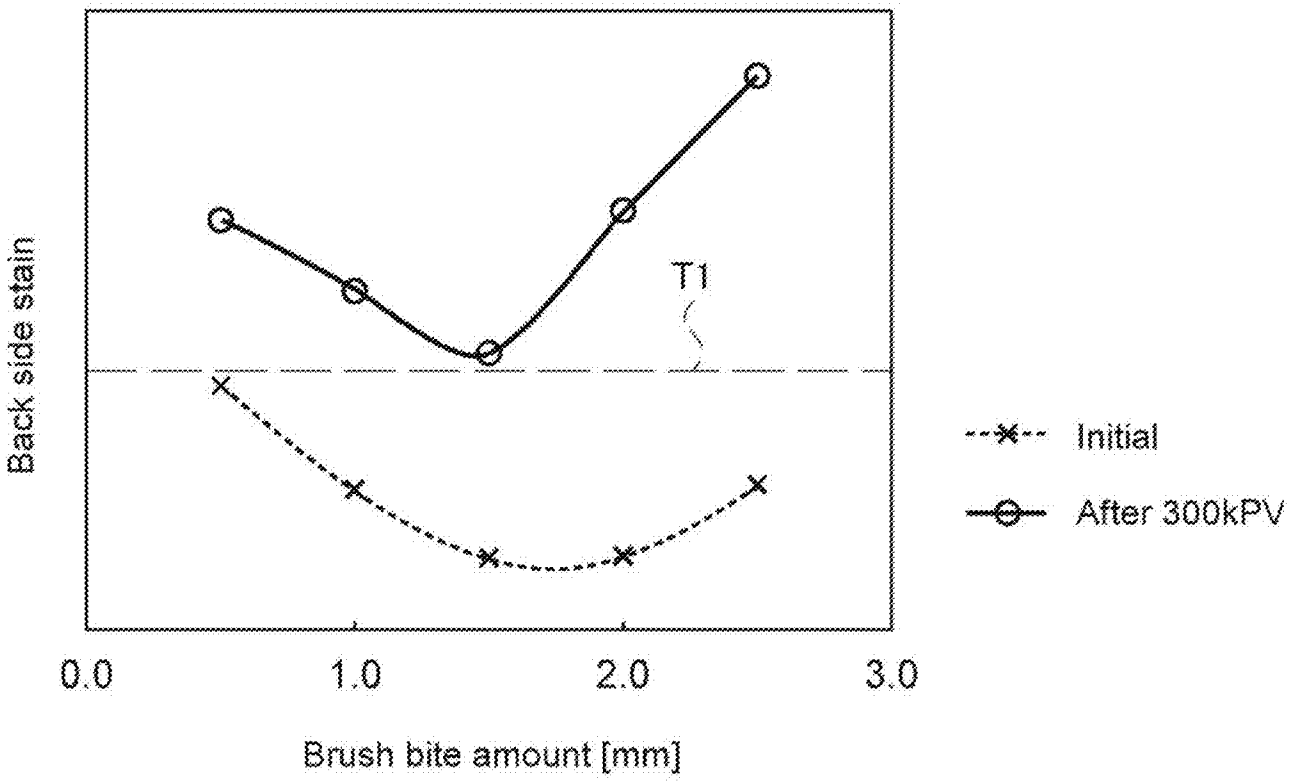
FIG. 16 is a graph of back side stain of paper sheets in the comparative example of FIG. 15, in relation to a bite amount of the bristles, for an initial stage of experiment and for a stage of experiment after printing 300,000 prints.

With reference to FIGS. 14 to 16, an experiment was conducted with an imaging forming apparatus of another comparative example (Comparative Example 2). The experiment conducted will be described.

In the experiment of Comparative Example 2, with reference to FIG. 14, an image forming apparatus used was provided with a bar brush 130 in which the tip end surface of the plurality of bristles 102 was formed planar. The bar brush 130 included the plurality of bristles 102 planted in the base substrate 101 as in the bar brush 100, but a fixing surface 132 of a fixing component 131 for fixing the base substrate 101 was planar. A conductive brush with the bristles 102 formed of a conductive PET was used as the bar brush 130. The thickness of the bristles 102 was 25 dtex, the plant density of the bristles 102 was 200 kf/inch2, the length of the bristles 102 was 5 mm, the length of the tip end surface in the circumferential direction of the secondary transfer roller 33 was 15 mm, and the bite amount of the bristles 102 into the secondary transfer roller 33 at a circumferentially central portion of the secondary transfer roller 33 (the maximum bite amount of the bristles 102 into the secondary transfer roller 33) was 1.5 mm.

The image adjustment mode was conducted under similar conditions as Comparative Example 1 and a back side stain of paper sheets was measured. The results of the measurements are shown in FIG. 15.

With reference to the measurement results of FIG. 15, in Comparative Example 2 the back side stain of the paper sheets was improved over Comparative Example 1. However, as the tip end surface of the plurality of bristles 102 was planar in Comparative Example 2, while the central part of the bar brush 130 in the circumferential direction of the secondary transfer roller 33 bit into the secondary transfer roller 33 to function as a brush, the ends of the bar brush 130 in the circumferential direction of the secondary transfer roller 33 scarcely bit into the secondary transfer roller 33 and did not function as a brush. Accordingly, it may be susceptible to variations due to paper types and environments and, as the bristles 102 bite into the secondary transfer roller 33 locally, collapsing of the bristles over time may occur.

The amount of bite of the bristles 102 into the secondary transfer roller 33 at a circumferentially central portion of the secondary transfer roller 33 was set to 0.5 mm, 1.0 mm, 1.5 mm, 2.0 mm and 2.5 mm, and comparisons were made for a relation between a bristle bite amount and back side stain of paper sheets, between an initial stage of experiment and after printing 300,000 prints.

As shown in FIG. 16, a back side stain was not generated in the initial stage of experiment. After printing 300,000 prints, bending of maximally around 1.0 mm occurred in the bristles 102 and a back side stain was generated in all cases. In view of these results, it was understood that, with the bar brush 130 in which the tip end surface of the plurality of bristles 102 was planar, an increase in back side stain over time cannot be sufficiently suppressed.

Figure 18:
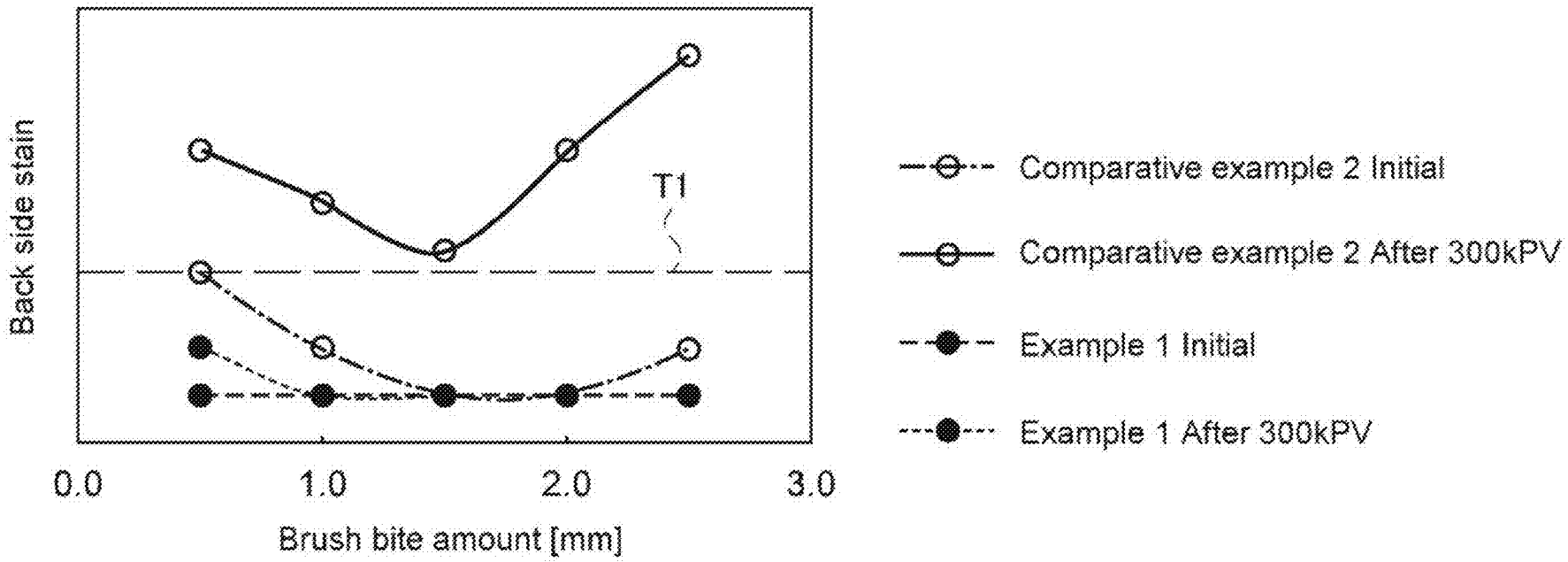
FIG. 18 is a graph of back side stain of paper sheets in relation to a bite amount of brittles for the example image forming apparatus of FIG. 2, illustrating a comparison between an initial stage of experiment and after printing 300,000 prints.

With reference to FIGS. 17 and 18, an experiment was conducted using the example image forming apparatus 1 shown in FIG. 2. Accordingly, the bar brush 100 was used, in which the tip end surface of the plurality of bristles 102 was formed into a curved shape that conformed with the surface of the secondary transfer roller 33. With the exception that the tip end surface of the plurality of bristles 102 was formed into a curved shape that conformed with the surface of the secondary transfer roller 33, the condition of the bar brush 100 was similar to that of the bar brush 130 in Comparative Example 2. For example, a conductive brush with the bristles 102 formed of a conductive PET was used as the bar brush 100. The thickness of the bristles 102 was 25 dtex, the plant density of the bristles 102 was 200 kf/inch2, the length of the bristles 102 was 5 mm, the length of the tip end surface in the circumferential direction of the secondary transfer roller 33 was 15 mm, and the bite amount of the bristles 102 into the secondary transfer roller 33 was 1.5 mm.

The image adjustment mode was conducted under similar conditions as Comparative Example 1 and back side stain of paper sheets was measured. The results of the measurements are shown in FIG. 17.

With reference to FIG. 17, in this experiment the back side stain of the paper sheets was largely improved over Comparative Example 2.

In the bar brush 100, the amount of bite of the bristles 102 into the secondary transfer roller 33 was set to 0.5 mm, 1.0 mm, 1.5 mm, 2.0 mm and 2.5 mm, and comparisons were made for a relation between a bristle bite amount and back side stain of paper sheets, between an initial stage of experiment and after printing 300,000 prints. The results of the comparison are shown in FIG. 18 which also includes the results of measurements according to Comparative Example 2.

As shown in FIG. 18, in the experiment conducted, the back side stain did not change substantially even after printing 300,000 prints. In view of these results, it was understood that, with the tip end surface formed into a curved shape conforming with the surface of the secondary transfer roller 33, an increase in back side stain over time can be better suppressed.

Figure 19:
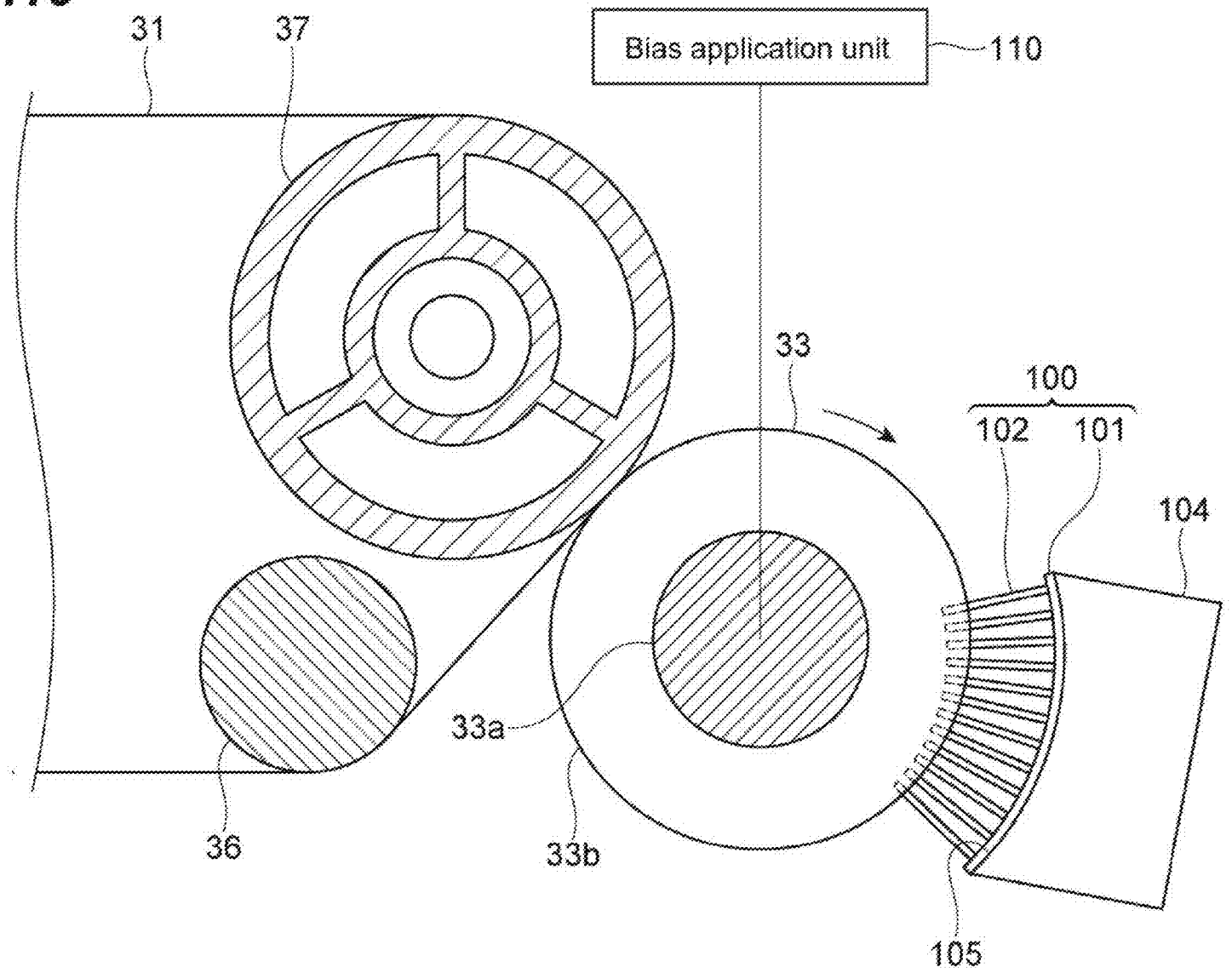
FIG. 19 is a schematic diagram of an example transfer device.
Figure 20:
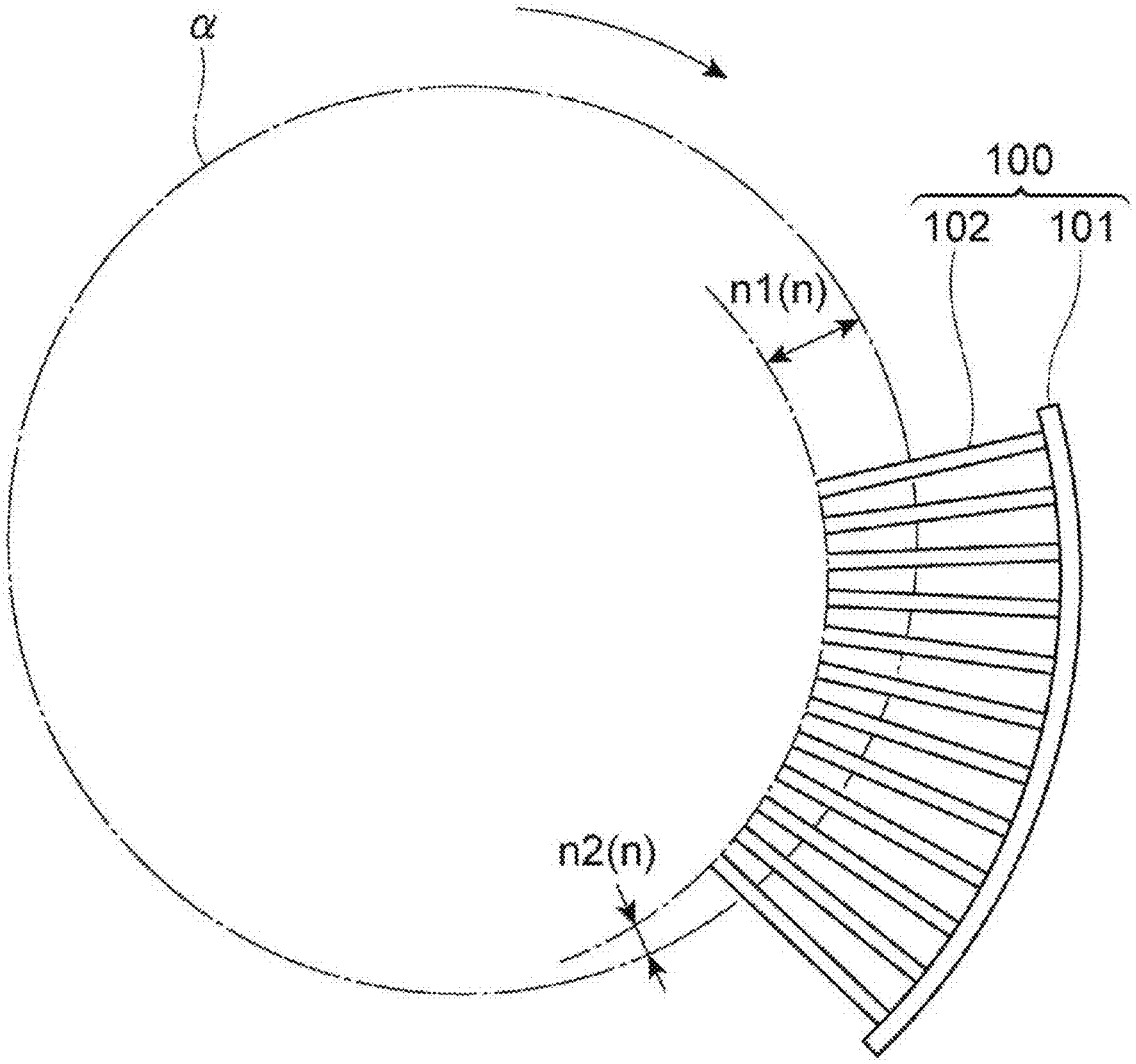
FIG. 20 is a schematic diagram illustrating a bite amount of bristles.

With reference to FIGS. 19 and 20, an example transfer device differs from the example of FIG. 2, in that the amount of bite of the plurality of bristles into the secondary transfer roller varies in the circumferential direction of the secondary transfer roller.

In the example of FIG. 19 and FIG. 20, the bite amount n of the bristles 102 into the secondary transfer roller 33 is larger in an upstream side than in a downstream side of the secondary transfer roller 33. For example, the fixing surface 105 of the fixing component 104 to fix the base substrate 101 is formed into a curved shape that conforms with the surface of the secondary transfer roller 33. The separation distance between the fixing surface 105 and the secondary transfer roller 33 is smaller in the upstream side than in the downstream side of the secondary transfer roller 33. Consequently, the bite amount n1 of the bristles 102 into the secondary transfer roller 33 in the upstream side of the secondary transfer roller 33 is larger than the bite amount n2 of the bristles 102 into the secondary transfer roller 33 in the downstream side of the secondary transfer roller 33.

Accordingly, the difference between a maximum bite amount and a minimum bite amount of the bristles 102 into the secondary transfer roller 33 may be 1.0 mm or less.

Toner adhered onto the secondary transfer roller 33 is first flicked by the bristles 102 upon entry into the bar brush 100. Accordingly, the bite amount n of the bristles 102 into the secondary transfer roller 33 may be larger in the upstream side than in the downstream side of the secondary transfer roller 33, to enhance the flicking force of the bristles 102 and reduce an amount of toner flowing downstream, in order to diffuse toner more efficiently.

Figure 21:
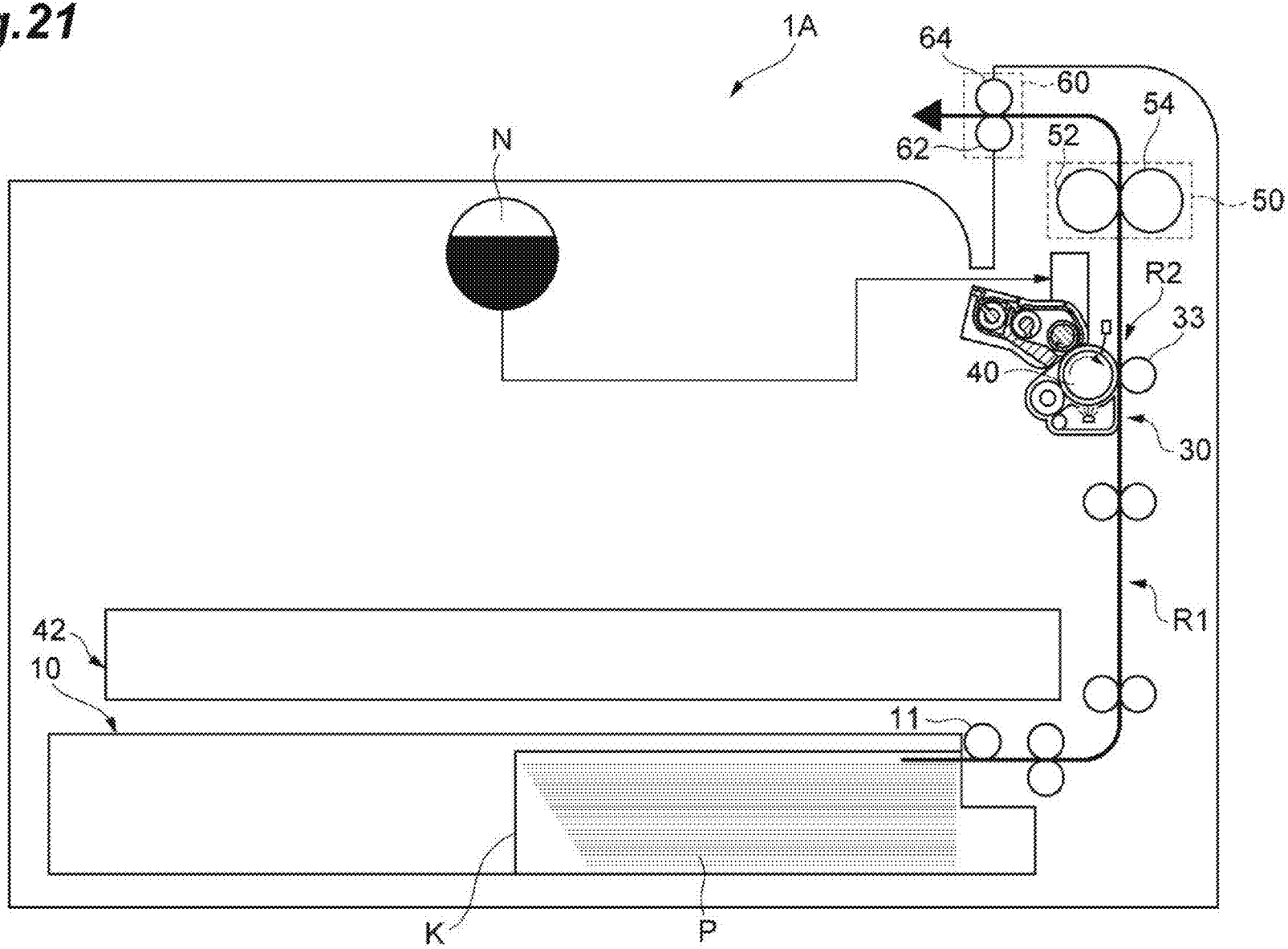
FIG. 21 is a schematic diagram illustrating a construction of an example image forming apparatus.
Figure 22:
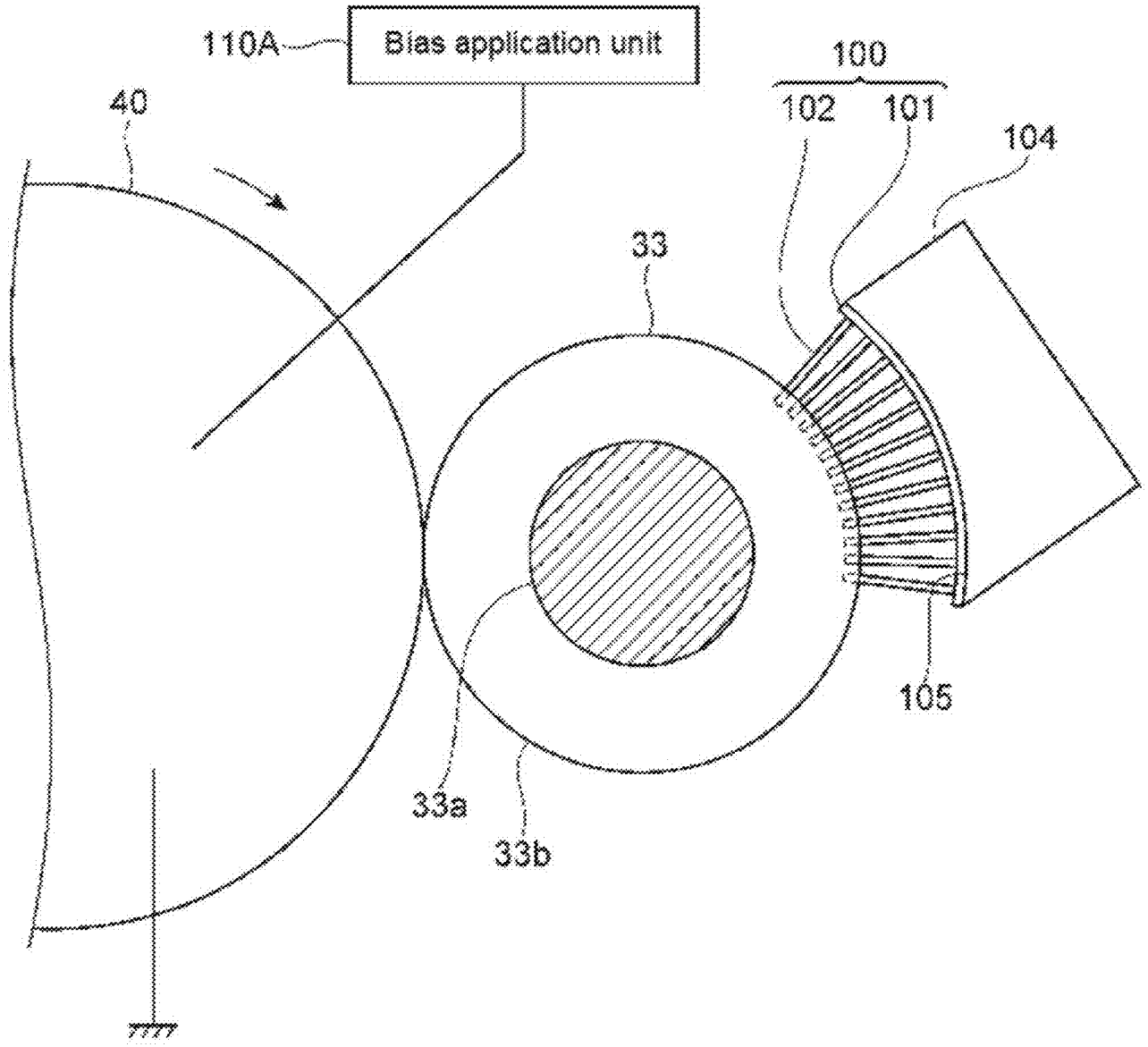
FIG. 22 is a schematic diagram of an example transfer device.

With reference to FIGS. 21 and 22, an example image forming apparatus 1A differs from the example of FIGS. 1 and 2, in that, the image forming apparatus transfers monochrome (or single color, e.g. black, toner images to paper sheets.

As shown in FIG. 21, an image forming apparatus 1A includes one developing device 20, without any primary transfer roller, transfer belt and plurality of support rollers, and includes a transfer roller 33A in place of the secondary transfer roller. The transfer roller 33A is fixed in position relative to the photosensitive drum 40 of the developing device 20. The transfer roller 33A is disposed to press with a constant pressure against the photosensitive drum 40 of the developing device 20. The transfer roller 33A forms a transfer nip region R2 with the photosensitive drum 40. The image carrier that forms the transfer nip region R2 with the transfer roller 33A is the photosensitive drum 40.

As shown in FIG. 22, the image forming apparatus 1A includes a bar brush 100 similarly to FIG. 2, and a bias application device 110A.

The relation between the bar brush 100 and the transfer roller 33A is similar to the relation between the bar brush 100 and the secondary transfer roller 33 of the example illustrated in FIG. 2, with reference to FIGS. 5A to 7.

The bias application device 110A differs from the bias application device 110 of FIG. 2, in that the object to be applied with the bias is the photosensitive drum 40. Accordingly, the bias applied by the bias application device 110A to the transfer roller 33A is similar to the bias applied by the bias application device 110 to the secondary transfer roller 33 in cf. FIG. 2, with reference to FIG. 3.

In the example image forming apparatus 1A, the bar brush 100 is made to pressure contact with the transfer roller 33A, to diffuse and remove toner adhered onto the transfer roller 33A by the plurality of bristles 102 of the bar brush 100. The tip end surface 103 of the plurality of bristles 102 is formed into a curved shape that conforms with the surface of the transfer roller 33A, so that the bar brush 100 can make pressure contact with the transfer roller 33A over the entire region of the bar brush 100 in the circumferential direction (rotation direction) of the transfer roller 33A. Accordingly, toner adhered onto the transfer roller 33A can be better diffused and removed, to improve the cleaning property.

In addition, even if the transfer roller 33A is fixed in position relative to the photosensitive drum 40, the provision of the aforementioned bar brush 100 enables to improve the cleaning property.

The above-described examples of image forming apparatuses may be modified.

For example, while specific constructions of the bar brush have been described, the bar brush 100 may be a bar brush of any structure as long as the tip end surface 103 of the plurality of bristles 102 is formed into a curved shape that conforms with a surface of the transfer roller (the secondary transfer roller 33 or the transfer roller 33A).

Further, while the bias application device 110 has been described in some examples, as applying the bias to the secondary transfer roller 33, the bias may be applied to either the secondary transfer roller 33 or the support roller 37 that constitute the transfer device, and the bias may be applied to the support roller 37. In this case, the bias applied by the bias application device 110 to the support roller 37 is similar to the bias applied by the bias application device 110 to the secondary transfer roller 33 in the examples of FIG. 2 or 19.

In some examples, the bar brush 100 cleans the secondary transfer roller 33 or a surface of the transfer roller 33A, but the object to be cleaned by the bar brush 100 is not limited by the transfer roller. The bar brush 100 may be adapted to an object, such as a rotatable cylindrical component to be cleaned. For example, the component to be cleaned by the bar brush 100 may include the transfer roller 33A, the secondary transfer roller 33, photosensitive drum 40 and the like.

With reference to FIGS. 27 to 31, an example image forming apparatus comprises a rotatable component to be cleaned and a cleaning component to clean the component to be cleaned by making contact with the component to be cleaned.

A phenomenon of deterioration over time of the cleaning component will be explained with reference to FIGS. 23 to 26.

Figure 23:
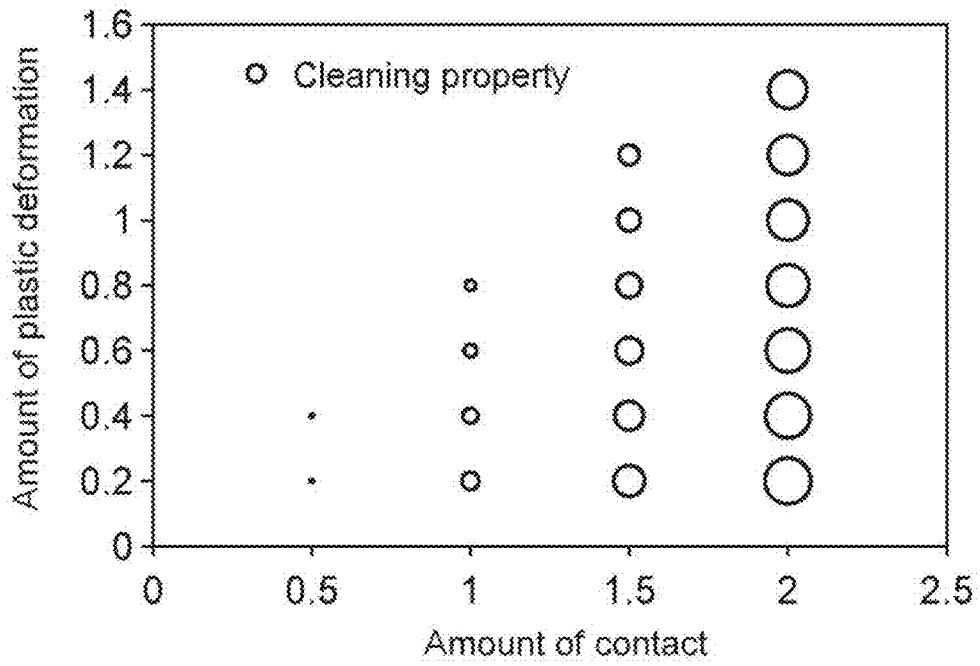
FIG. 23 is a graph of a cleaning property for a plastic deformation of a cleaning component in relation to a contact amount of the cleaning component.

With reference to FIG. 23, the cleaning property of a cleaning component, such as a brush (such as a roll brush or a bar brush), a foam component having elasticity, a pad-like component and the like, is often determined by a contact force against a component to be cleaned. The contact force may be determined by two factors, e.g., a contact amount of the cleaning component to the component to be cleaned, and a plastic deformation of the cleaning component. Namely, the larger the contact amount and the smaller the plastic deformation, the higher the contact force and the higher the cleaning property.

Where the cleaning component is a brush, the plastic deformation is signified by the bending of the bristles. The contact amount is substantially the same as the bite amount in the example with reference to FIG. 2. For example, assuming that the component to be cleaned is not present, an amount by which the cleaning component makes contact with a virtual line indicative of a surface position of the component to be cleaned (the length extending inwardly beyond the virtual line) is defined as the contact amount (cf. FIG. 7). The contact amount is a maximum contact amount if it varies in the circumferential direction of the component to be cleaned.

The amount of plastic deformation of the cleaning component increases as the contact amount increases or an operating time of the cleaning component gets longer. The operating time of the cleaning component may be calculated from, for example, the contact time, a rotating time of the component to be cleaned, or the like. If the contact amount is constant, the plastic deformation occurred to the cleaning component increases as the operating time lapses, and the cleaning property is exacerbated thereby.

Figure 24:
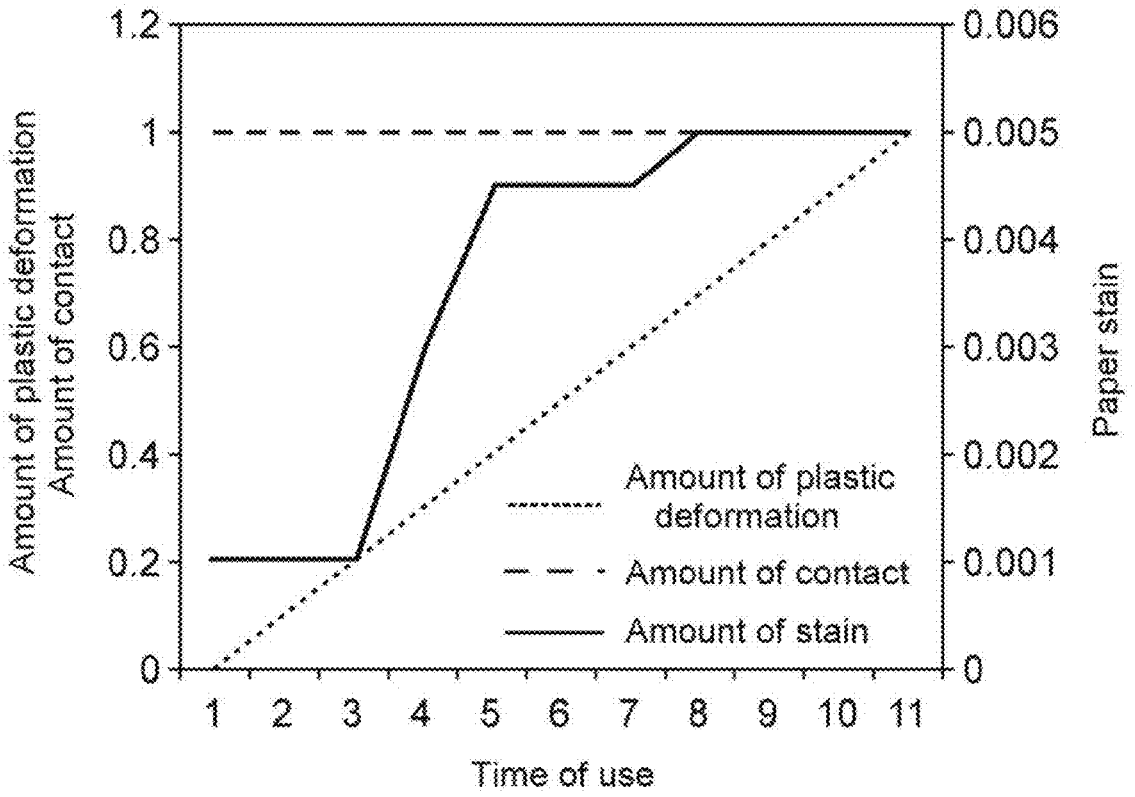
FIG. 24 is a graph illustrating an amount of plastic deformation of the cleaning component, a contact amount of the cleaning component, and back side stain of paper sheets, in relation to time of use of the cleaning component.

As shown in FIG. 24, where the distance between the cleaning component and the component to be cleaned is constant and the contact amount is kept constant, plastic deformation over time occurs and the contact force is thereby lowered, which causes a deterioration of the cleaning property. That the contact amount is constant may indicate that the cleaning component is fixed and the relative position between the component to be cleaned and the cleaning component is constant.

Figure 25:
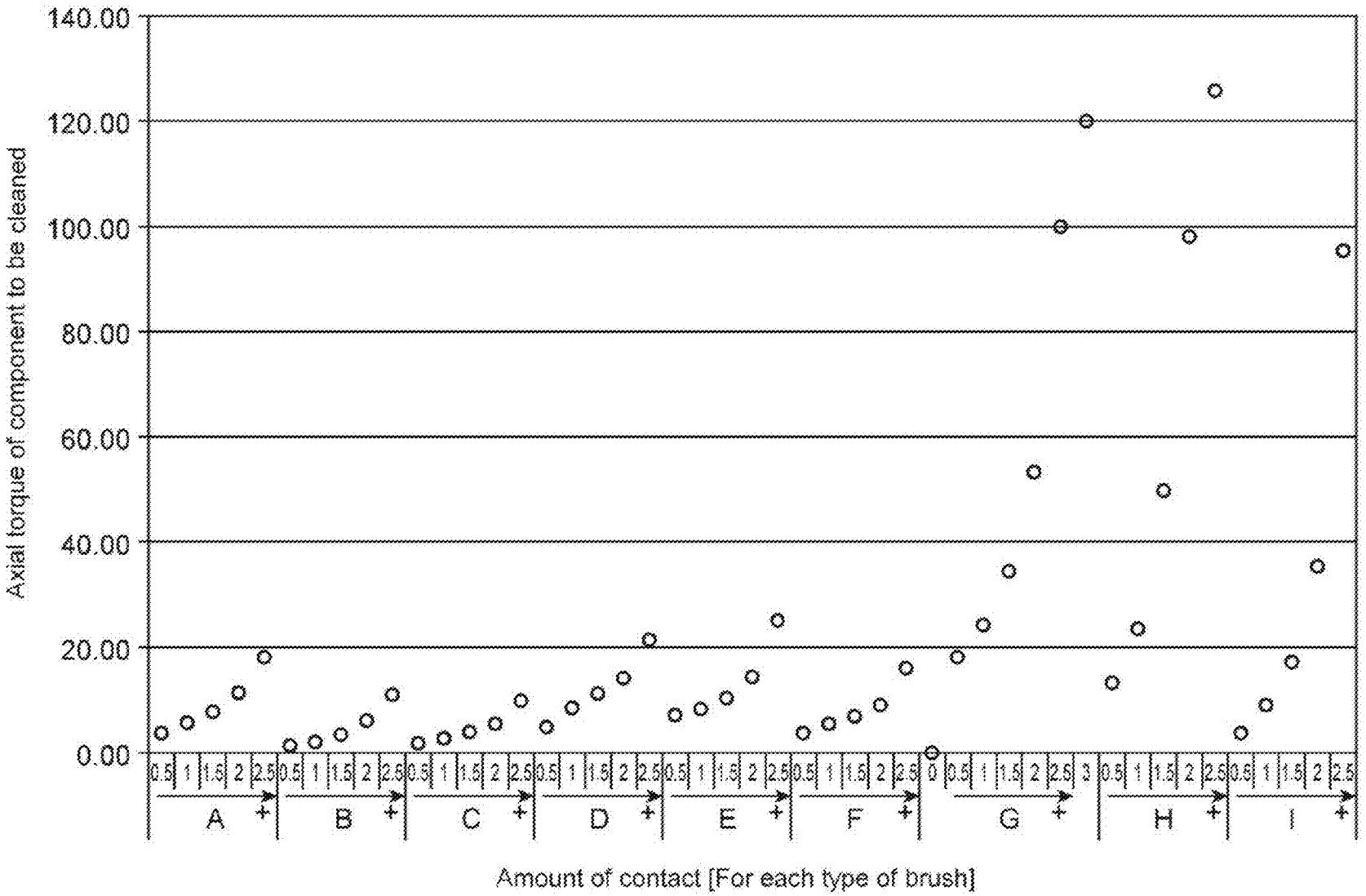
FIG. 25 is a graph illustrating an axial torque of the component to be cleaned in relation to a contact amount of the cleaning component.

As shown in FIG. 25, when the cleaning component makes contact with the component to be cleaned, a rotary torque is generated axially of the component to be cleaned, and the contact force is corelated to the rotary torque. FIG. 25 shows results of measurements of a relation between a contact amount and an axial torque of a component to be cleaned, for 9 types of cleaning components A to I.

Figure 26:
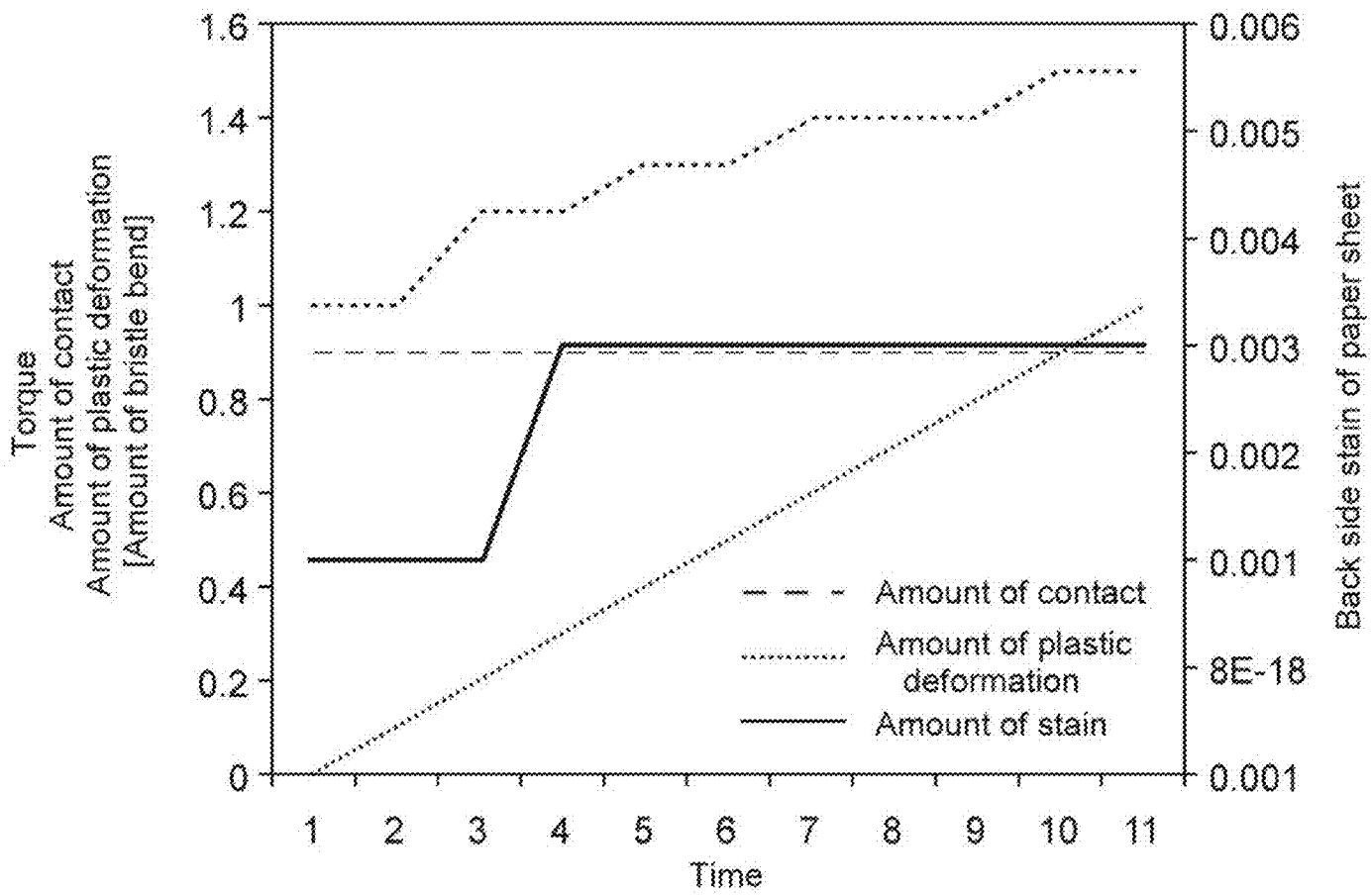
FIG. 26 is a graph illustrating a torque, a contact amount of the cleaning component, an amount of plastic deformation of the cleaning component, and back side stain of paper sheets, in relation to time of use of the cleaning component.

In view of the above-mentioned relations, the contact force of the cleaning component can be made constant by controlling the rotary torque imposed upon the component to be cleaned by the cleaning component to a predetermined value. For example, as shown in FIG. 26, if a plastic deformation occurs to the cleaning component, the contact force can be maintained constant by increasing the contact amount. Accordingly, even if a plastic deformation occurs to the cleaning component due to lapse of time, a proper cleaning property can be maintained.

Referring back to FIGS. 27 and 28, an example image forming apparatus 1B comprises a secondary transfer roller 33, e.g., a rotatable component to be cleaned, a cleaning component 140, a contact-separation device 151, and a power transmission component 152.

The cleaning component 140 cleans the secondary transfer roller 33 by making contact with the secondary transfer roller 33. The contact-separation device 151 is rotated by a torque transmitted from the secondary transfer roller 33. The power transmission component rotates in response to rotation of the contact-separation device 151 to bring the cleaning component 140 into and out of contact with the secondary transfer roller 33.

For example, a roll brush, a bar brush, a foam component having elasticity, a pad-like component or the like may be used for the cleaning component 140. The bar brush may be similar to any one of the bar brushes of FIGS. 2, 14, 19 and 2. As the foam component having elasticity, for example, a low-density urethane foam or the like may be used. The pad-like component refers to a component that performs cleaning by making pressure in a pad shape against an opposing object and, as the pad-like component, for example, a high-density urethane foam such as PORON, silicone rubber, epichlorohydrin rubber or the like may be used.

Figure 29:
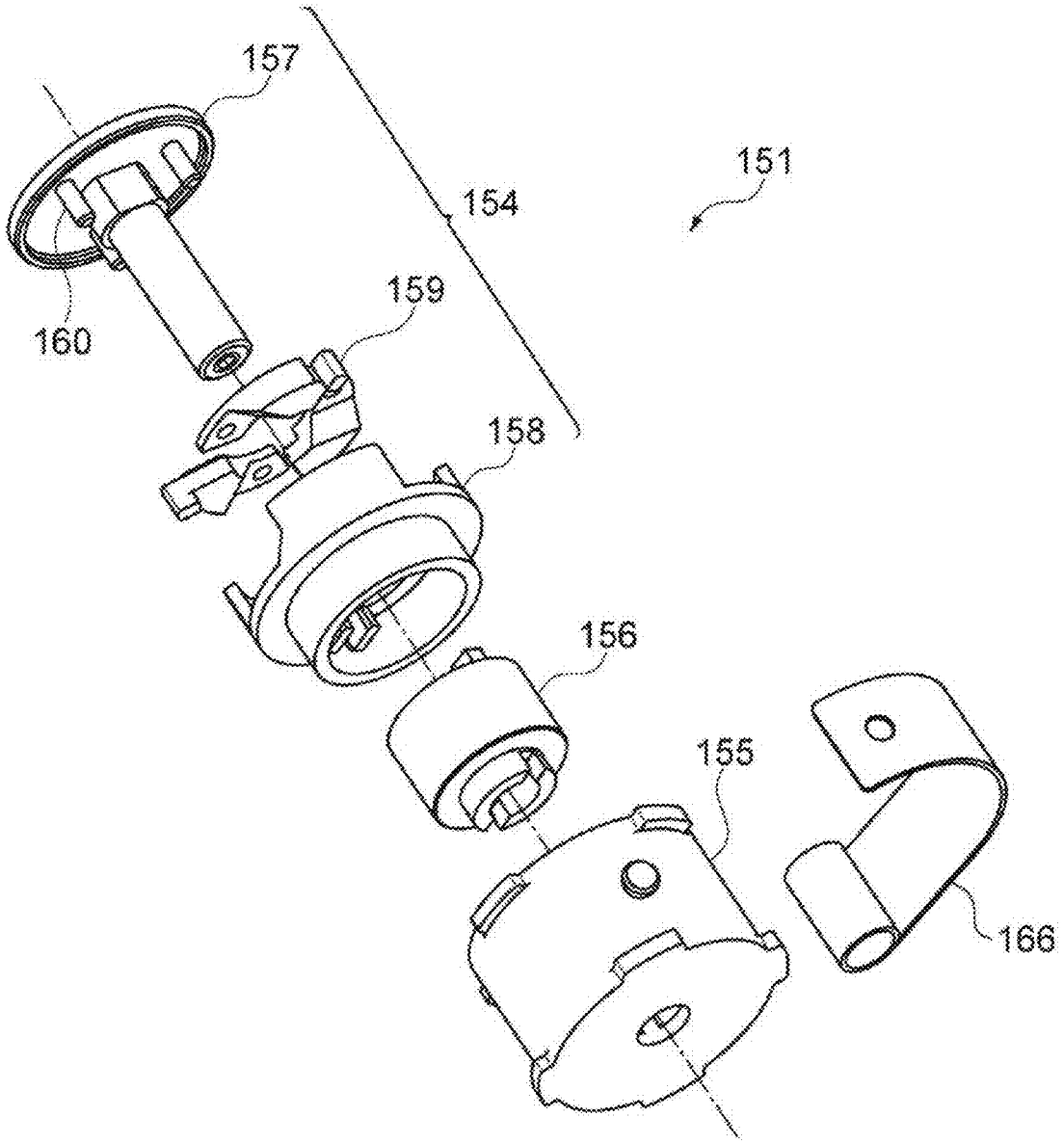
FIG. 29 is an exploded perspective view of the transfer device shown in FIG. 27.

As shown in FIG. 29, the contact-separation device 151 includes a centrifugal clutch 154, a rotary output device 155, and a torque limiter 156.

The centrifugal clutch 154 is a component to connect torque transmitted from the secondary transfer roller 33 or to disconnect transmission of that torque. The centrifugal clutch 154 is disposed on a rotation axis of the secondary transfer roller 33 and torque is transmitted from a rotary shaft of the secondary transfer roller 33. When a predetermined centrifugal force is exerted on the centrifugal clutch 154, the clutch engages to transmit the torque to the torque limiter 156. On the other hand, when the predetermined centrifugal force is ceased, the centrifugal clutch 154 releases the engagement of the clutch to disconnect transmission of the torque to the torque limiter 156.

Figure 30:
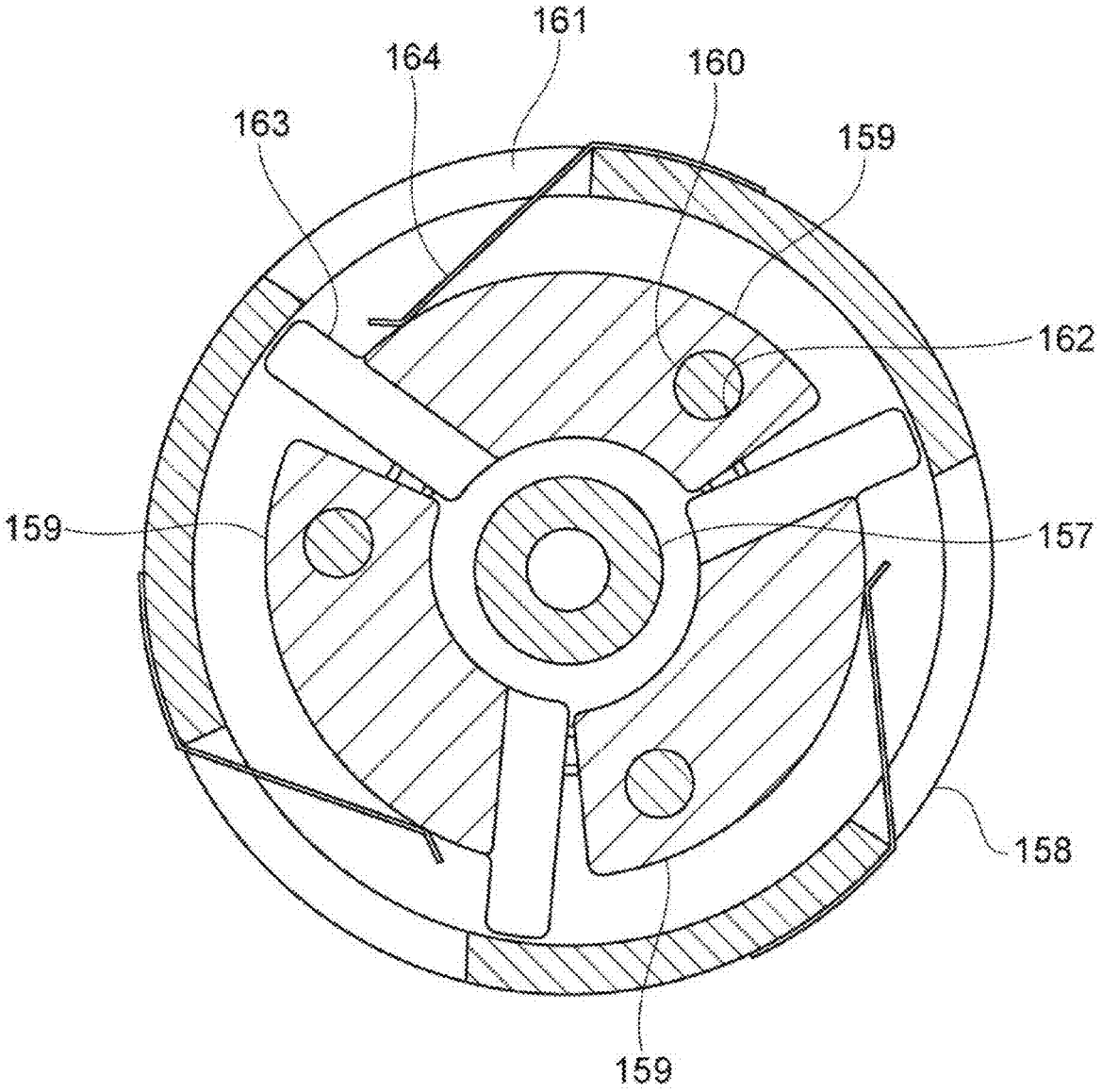
FIG. 30 is a cross-sectional view of a centrifugal clutch of an example contact-separation device, illustrated in a state where an engagement of the clutch is released.
Figure 31:
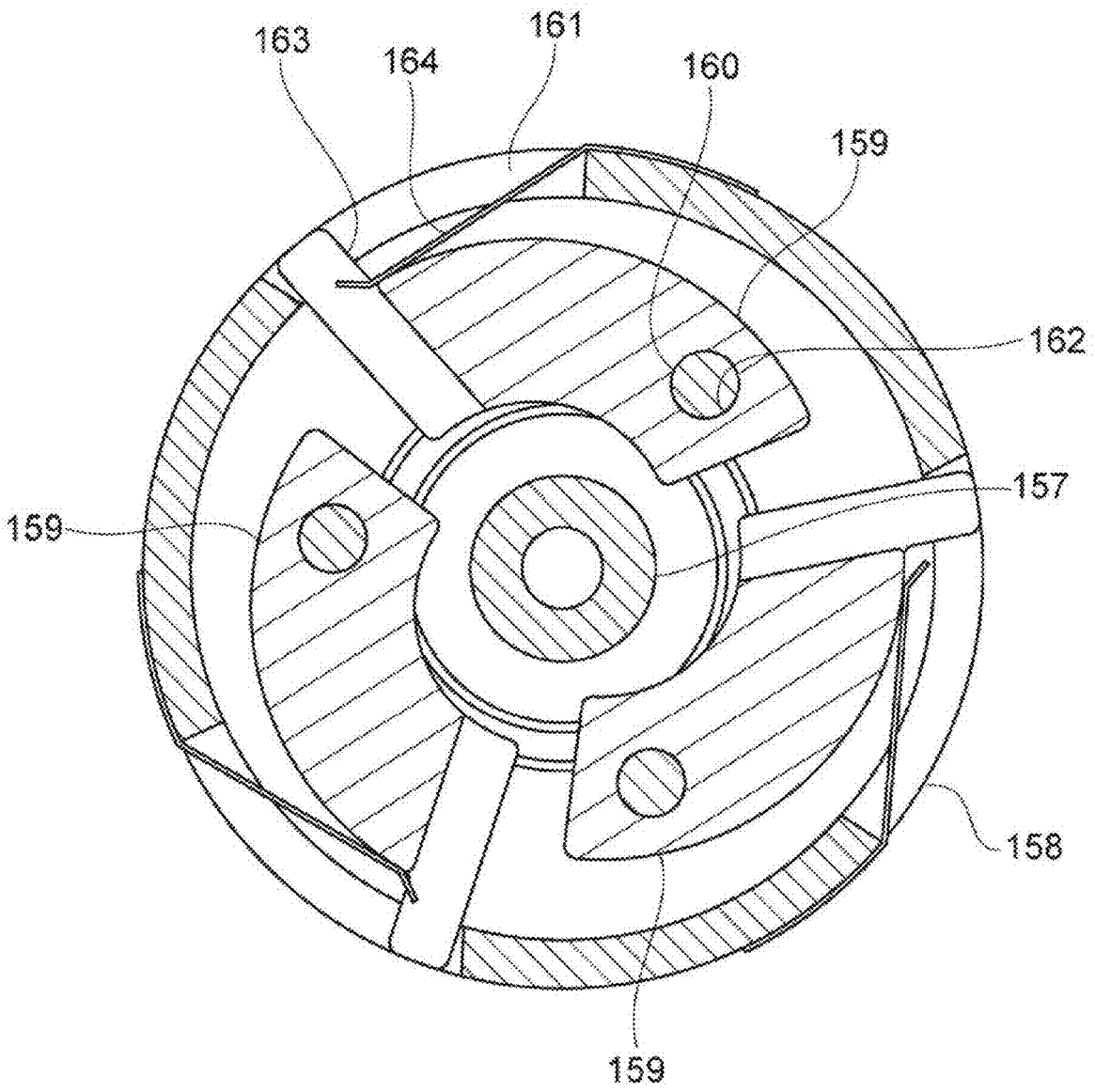
FIG. 31 is a cross-sectional view of the centrifugal clutch of FIG. 30, illustrated in a state where the clutch is engaged.

As shown in FIG. 29 to FIG. 31, the centrifugal clutch 154 includes a clutch input 157, a clutch output 158, and three swing parts 159.

The clutch input 157 is unrotatably fitted over the rotary shaft of the secondary transfer roller 33. The clutch output 158 is unrotatably fitted over the rotary output device 155. The swing parts 159 transmit torque from the clutch input 157 to the clutch output 158 when a centrifugal force is applied. At positions offset from the rotation axis, the clutch input 157 is formed with three bosses 160 extending in a direction parallel to the rotation axis. The clutch output 158 is formed with recesses 161 to latch the swing parts 159. The swing parts 159 are formed at one end with holes 162 into which the bosses 160 of the clutch output 158 are inserted. The other ends of the swing parts 159 are formed with projections 163 adapted to get into the recesses 161 radially inwardly so as to be latched by the recesses 161. Then, when the clutch input 157 rotates to exert a predetermined centrifugal force on the swing parts 159, the swing parts 159 pivot about the bosses 160, and the projections 163 are moved radially outwardly and enter the recesses 161. The projections 163 are thereby latched by the recesses 161 and the torque of the clutch input 157 is transmitted to the clutch output 158.

Three elastic components 164 are attached to the clutch output 158. The elastic components 164 are components to push by the elastic force the projections 163 entered into the recesses 161 to get out of the recesses 161. The elastic components 164 are not particularly limited, but they may include leaf springs, for example, that extend from the outside of the recesses 161 to the inside of the recesses 161, from a radially outward side to a radially inward side.

When the secondary transfer roller 33 is forward rotated, the centrifugal clutch 154 engages the clutch and transmits the torque transmitted from the secondary transfer roller 33 to the rotary output device 155. That the clutch is engaged may indicate that the projections 163 are made to enter into the recesses 161 to have the projections 163 latched by the recesses 161. The forward rotation refers to a rotation of the secondary transfer roller 33 in the case of performing a normal operation. On the other hand, when the secondary transfer roller 33 is stopped or reverse rotated, the centrifugal clutch 154 releases the engagement of the clutch to disconnect the transmission of torque transmitted from the secondary transfer roller 33 to the rotary output device 155. To release the engagement of the clutch means that the projections 163 are pushed out of the recesses 161 by the elastic components 164 and the latching state between the projections 163 and the recesses 161 is released. The centrifugal clutch 154 is not limited to the one described above. For example, the centrifugal clutch 154 may disconnect the transmission of torque from the clutch input 157 to the clutch output 158 when the secondary transfer roller 33 is reverse rotated.

The rotary output device 155 is rotationally fixed to (e.g., unrotatably fitted over) the clutch output 158 and rotates integrally with the clutch output 158. The rotary output device 155 also serves as a housing that covers part of the centrifugal clutch 154 and the outer periphery of the torque limiter 156. When the rotary output device 155 is rotated, the power transmission component 152 is moved. The relation between the rotation of the rotary output device 155 and the movement of the power transmission component 152 will be described later.

The torque limiter 156 is a component that limits torque transmitted from the clutch output 158 of the centrifugal clutch 154 to the rotary output device 155. The limiting torque is set in the torque limiter 156 as a threshold. The threshold may be changed appropriately. The torque limiter 156 transmits torque from the clutch output 158 of the centrifugal clutch 154 to the rotary output device 155, and transmits the threshold torque by idling when the torque exceeds the threshold.

The power transmission component 152 is pivoted by a swing shaft (or pivot shaft) 165. The swing shaft 165 is disposed, at a position separated from the secondary transfer roller 33, in parallel with the rotary shaft of the secondary transfer roller 33. The power transmission component 152 extends like an arm. One end of the power transmission component 152 is pivoted at the swing shaft 165 and the other end of the power transmission component 152 holds the cleaning component 140. The cleaning component 140 is held on a side of the power transmission component 152 facing the secondary transfer roller 33. Accordingly, when pivoted about the swing shaft 165, the power transmission component 152 moves the cleaning component 140 in a direction to make contact with or separate from the secondary transfer roller 33.

A coupling component 166 and an elastic component 167 are connected to the power transmission component 152.

The coupling component 166 couples the rotary output device 155 and the power transmission component 152. The coupling component 166 is a non-stretchable component and extended over an outer peripheral surface of the rotary output device 155. Specifically, the coupling component 166 is extended over the rotary output device 155 such that, when the rotary output device 155 is forward rotated, the cleaning component 140 is moved closer to the secondary transfer roller 33. The rotary output device 155 is not particularly limited, but a thin planar component, a metal wire or the like, for example, may be used. In the drawings, a thin planar component is used as the rotary output device 155.

The elastic component 167 pushes by the elastic force the power transmission component 152 in a direction to separate the cleaning component 140 from the secondary transfer roller 33. For example, the elastic component 167 pushes the power transmission component 152 such that, when the engagement of the centrifugal clutch 154 is released, the cleaning component 140 is separated from the secondary transfer roller 33. The elastic component 167 is not limited to any particular shape or structure, insofar as it possesses elasticity and, for example, a stretchable component, such as a coil spring, a leaf spring or the like, and a component made of an elastic material, such as sponge or the like, may be used. The elastic component 167 may be disposed on a side of the power transmission component 152 same as the secondary transfer roller 33 if exerting a force in a contracting direction, and may be disposed on a side of the power transmission component 152 opposite to the secondary transfer roller 33 if exerting a force in an expanding direction. In the drawings, a coil spring exerting a force in an expanding direction is used as the elastic component 167, and the elastic component 167 is disposed on a side of the power transmission component 152 opposite to the secondary transfer roller 33.

An operation of the image forming apparatus 1B will be described.

When the secondary transfer roller 33 is rotated (forward), torque is transmitted from the rotary shaft of the secondary transfer roller 33 to the clutch input 157 of the centrifugal clutch 154. A centrifugal force is thereby exerted on the swing parts 159, and the torque is transmitted from the clutch input 157 to the clutch output 158. The torque transmitted to the clutch output 158 is transmitted to the rotary output device 155 through the torque limiter 156. At that time, the upper limit of the torque transmitted to the rotary output device 155 is limited by the torque limiter 156 to the threshold of the torque limiter 156. When the rotary output device 155 is rotated, the coupling component 166 pulls the power transmission component 152 and the power transmission component 152 swings about the swing shaft 165. The cleaning component 140 held by the power transmission component 152 is thereby made to pressure contact with the secondary transfer roller 33 and the secondary transfer roller 33 is cleaned by the cleaning component 140. Even if the secondary transfer roller 33 continues to rotate, the upper limit of the torque transmitted to the rotary output device 155 is limited by the torque limiter 156, and the pressure contact force of the cleaning component 140 against the secondary transfer roller 33 is kept constant.

When the secondary transfer roller 33 is stopped or reverse rotated, no centrifugal is applied to the swing parts 159. The projections 163 entered into the recesses 161 are thereby pushed out of the recesses 161 by the elastic components 164, and the torque of the clutch input 157 is not transmitted to the clutch output 158. The power transmission component 152 is then made to pivot about the swing shaft 165 due to the elastic force of the elastic component 167. The cleaning component 140 that has been made to pressure contact against the secondary transfer roller 33 is thereby separated from the secondary transfer roller 33.

As described above, when torque is transmitted from the secondary transfer roller 33 to the contact-separation device 151, the power transmission component 152 is moved in response to the rotation of the contact-separation device 151 so as to bring the cleaning component 140 into and out of contact with the secondary transfer roller 33. For example, the cleaning component 140 is brought into and out of contact with the secondary transfer roller 33 in response to the rotation of the secondary transfer roller 33. Accordingly, as compared with a case where the cleaning component 140 is always made to contact with the secondary transfer roller 33, plastic deformation of the cleaning component 140 can be suppressed, thereby suppressing the lowering of cleaning property caused by deterioration of the cleaning component 140 over time.

In some examples, when torque is transmitted from the secondary transfer roller 33 to the contact-separation device 151, a centrifugal force is applied to the centrifugal clutch 154 to have the centrifugal clutch 154 engaged. Then, when the torque is transmitted from the centrifugal clutch 154 to the rotary output device 155, the rotary output device 155 starts rotating. In response, the power transmission component 152 moves to bring the cleaning component 140 into contact with the secondary transfer roller 33, and the pressing force (contact force) of the cleaning component 140 against the secondary transfer roller 33 gradually increases. When a predetermined pressing force is reached, the torque limiter 156 starts idling. Accordingly, even if the secondary transfer roller 33 continues rotating, the predetermined pressing force can be maintained without having the cleaning component 140 overly pressed against the secondary transfer roller 33. In addition, even if the cleaning component 140 deteriorates over time and subjected to plastic deformation, the pressing force (torque) of the cleaning component 140 against the secondary transfer roller 33 can be maintained constant and the cleaning component 140 can always be pressed against the secondary transfer roller 33 with a proper pressing force. On the other hand, when the torque transmitted from the secondary transfer roller 33 to the contact-separation device 151 extinguishes or decreases, centrifugal force is not be applied to the centrifugal clutch 154 and the engagement of the centrifugal clutch 154 is released. The pressing of the cleaning component 140 against the secondary transfer roller 33 is thereby released, and deterioration of the cleaning component 140 over time can be suppressed.

In some examples, the centrifugal clutch 154 is disposed on the rotation axis of the secondary transfer roller 33, to simplify a structure of the centrifugal clutch 154.

In some examples, the centrifugal clutch 154 engages the clutch to transmit torque when the secondary transfer roller 33 is forward rotated, to clean the secondary transfer roller 33 by the cleaning component 140 during forward rotation of the secondary transfer roller 33. When the secondary transfer roller 33 is stopped or reverse rotated, the centrifugal clutch 154 releases the clutch engagement and disconnects the transmission of torque, and the pressing of the cleaning component 140 against the secondary transfer roller 33 is released, thereby suppressing deterioration of the cleaning component 140 over time when the secondary transfer roller 33 is not forward rotated.

In some examples, the power transmission component 152 is pivoted, to bring the cleaning component 140 into and out of contact with the secondary transfer roller 33.

In some examples, as the coupling component 166 extended over the rotary output device 155 is coupled between the rotary output device 155 and the power transmission component 152, when the rotary output device 155 is rotated, to pivot the power transmission component 152 in a direction to make contact with or separate from the rotary output device 155.

In some examples, the power transmission component 152 is pushed by the elastic component 167 in a direction to separate the cleaning component 140 from the secondary transfer roller 33, to separate the cleaning component 140 more reliably from the secondary transfer roller 33 when the engagement of the centrifugal clutch 154 is released.

In some examples, the cleaning component 140 is fixed to the power transmission component 152, such that the cleaning component 140 contact the secondary transfer roller 33 more reliably.

With reference to FIGS. 32 to 35, an example transfer device is similar to the example of FIGS. 27 to 31, with the exception of the construction of the power transmission component.

Figure 32:
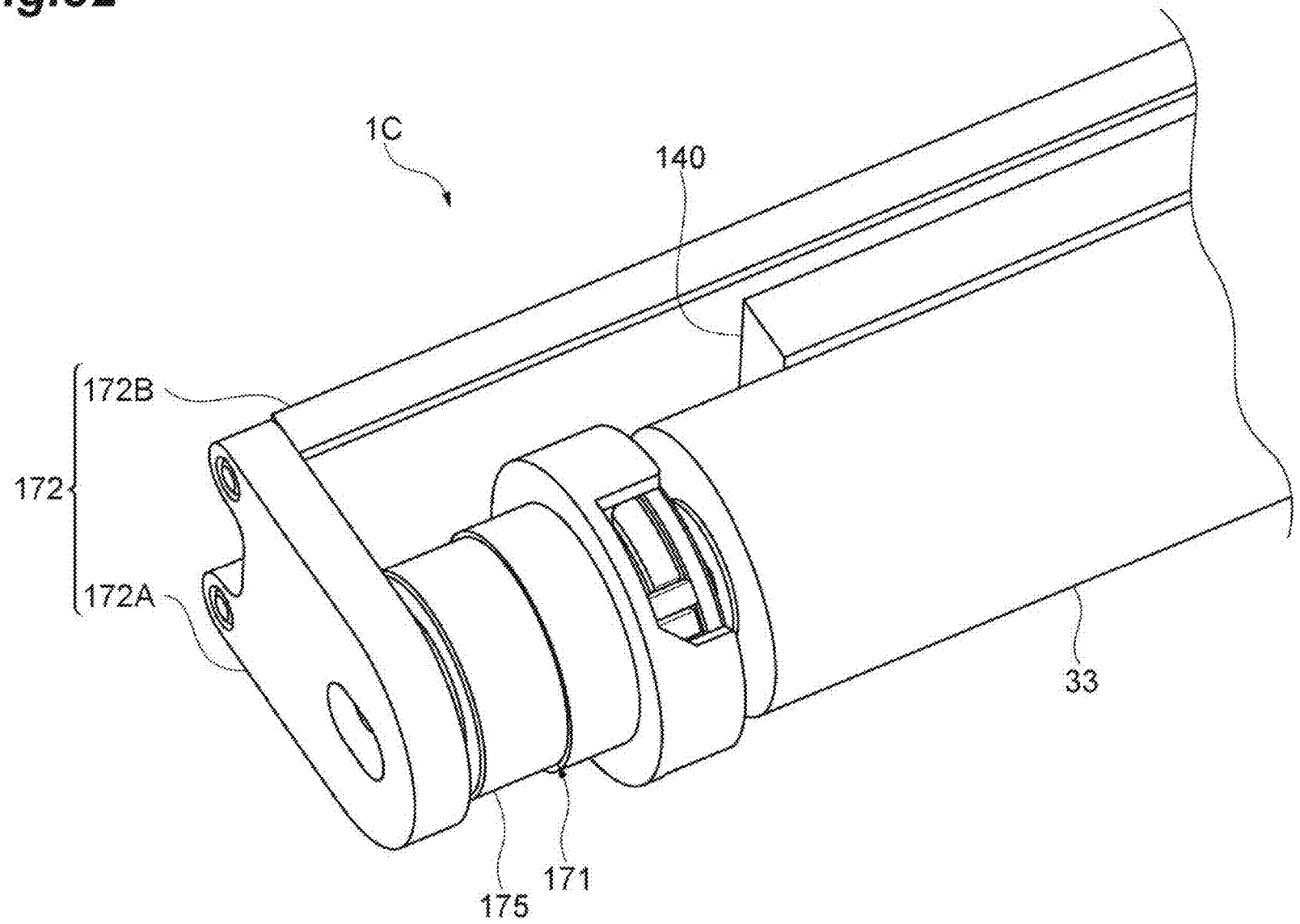
FIG. 32 is a perspective view showing an example transfer device.

As shown in FIG. 32, an example image forming apparatus 1C comprises a secondary transfer roller 33, e.g., a rotatable component to be cleaned, a cleaning component 140, a contact-separation device 171, and a power transmission component 172.

Figure 33:
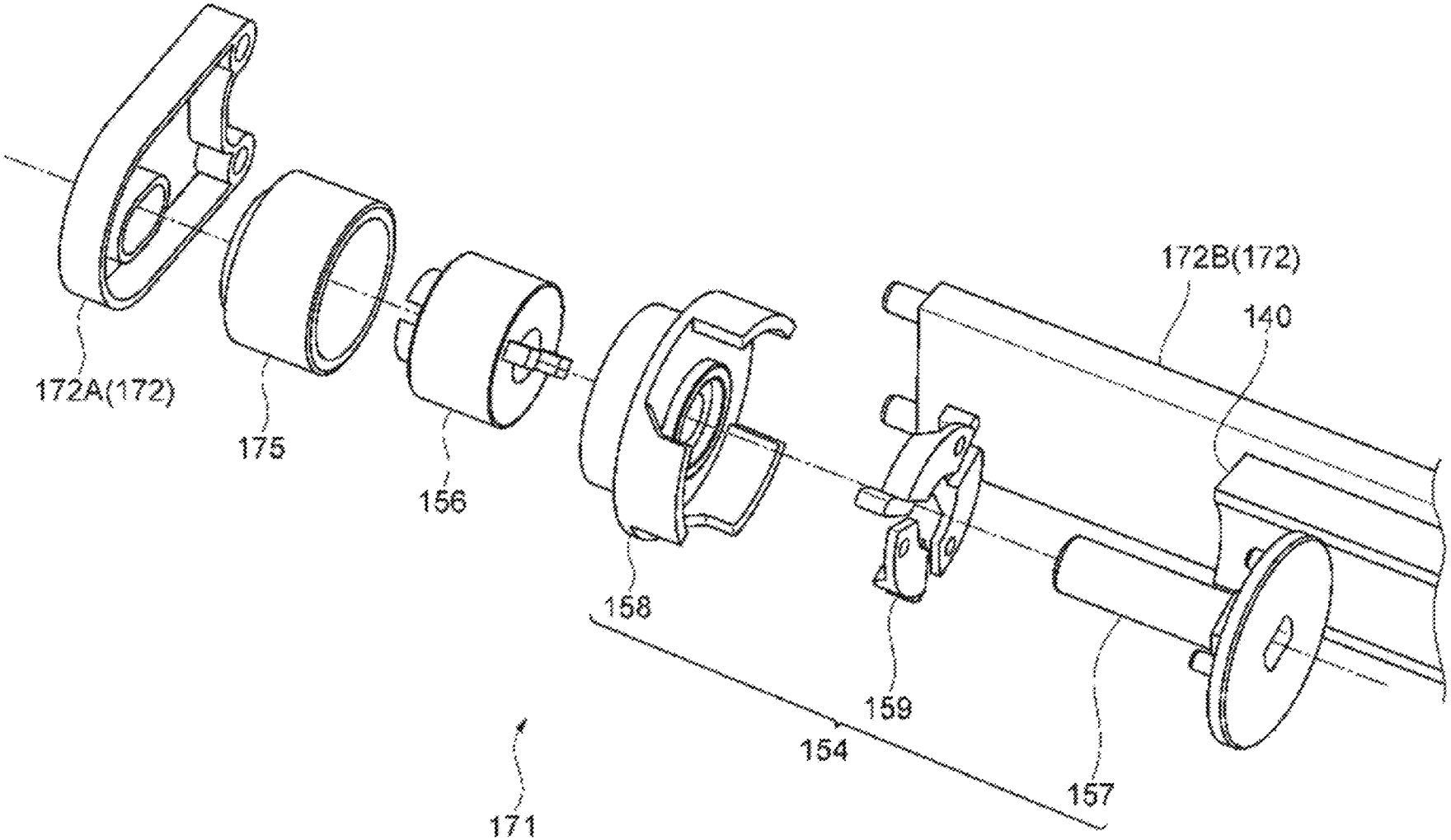
FIG. 33 is an exploded perspective view of the transfer device shown in FIG. 32.
Figure 34:
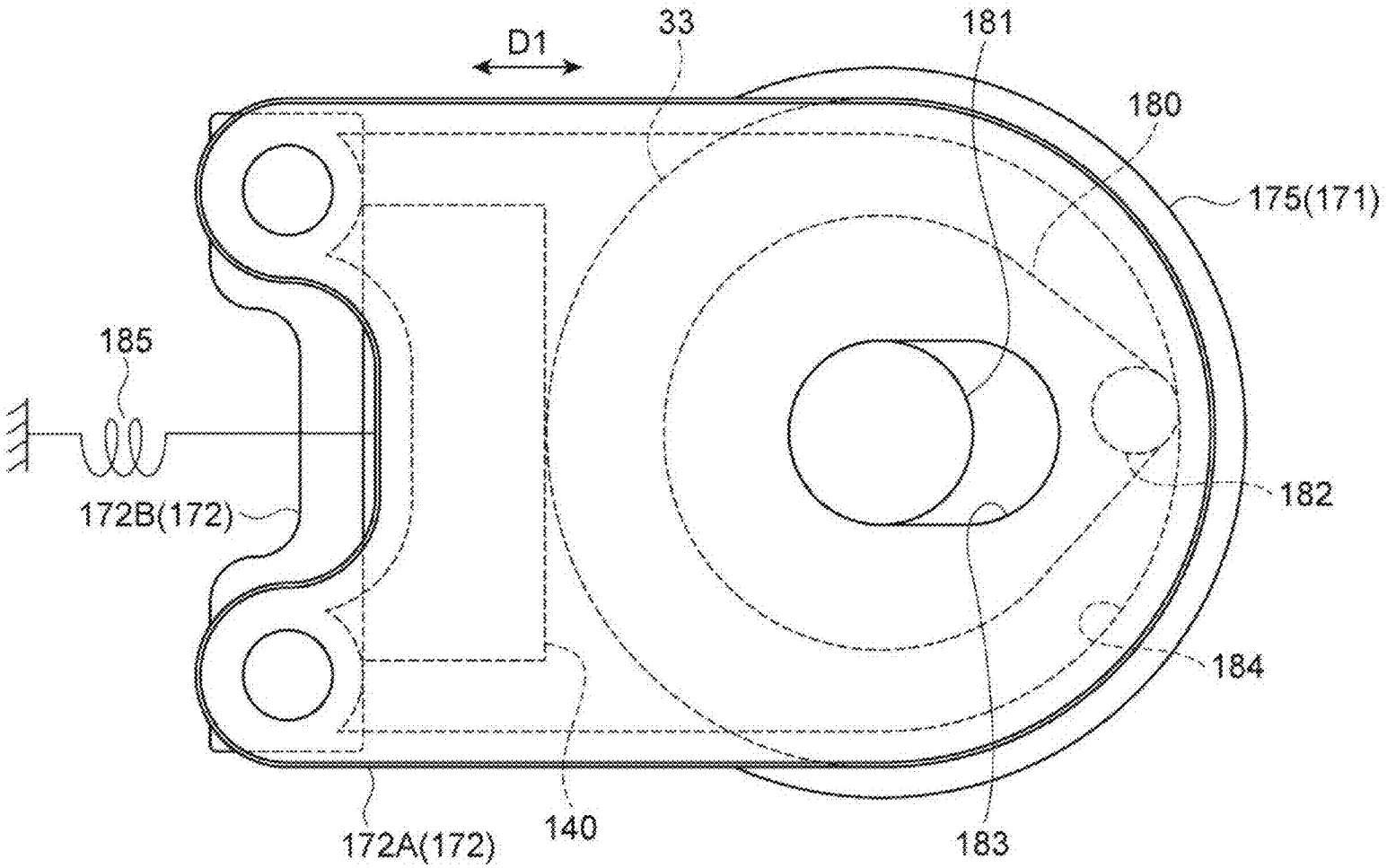
FIG. 34 is a lateral view of the transfer device shown in FIG. 32.
Figure 35:
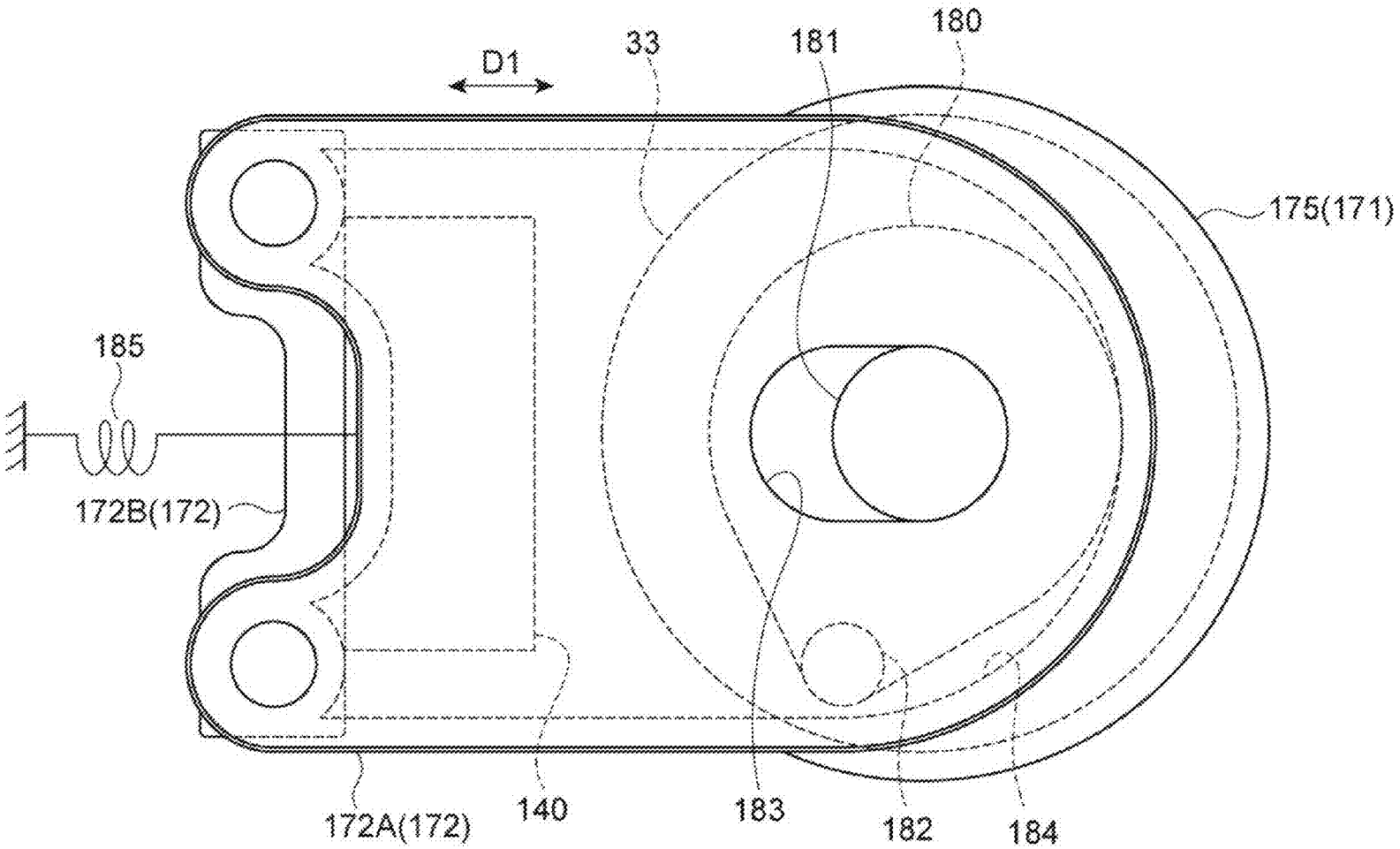
FIG. 35 is a lateral view of the transfer device shown in FIG. 32.

As shown in FIG. 33, the contact-separation device 171 includes a centrifugal clutch 154, a rotary output device 175, and a torque limiter 156.

Figure 27:
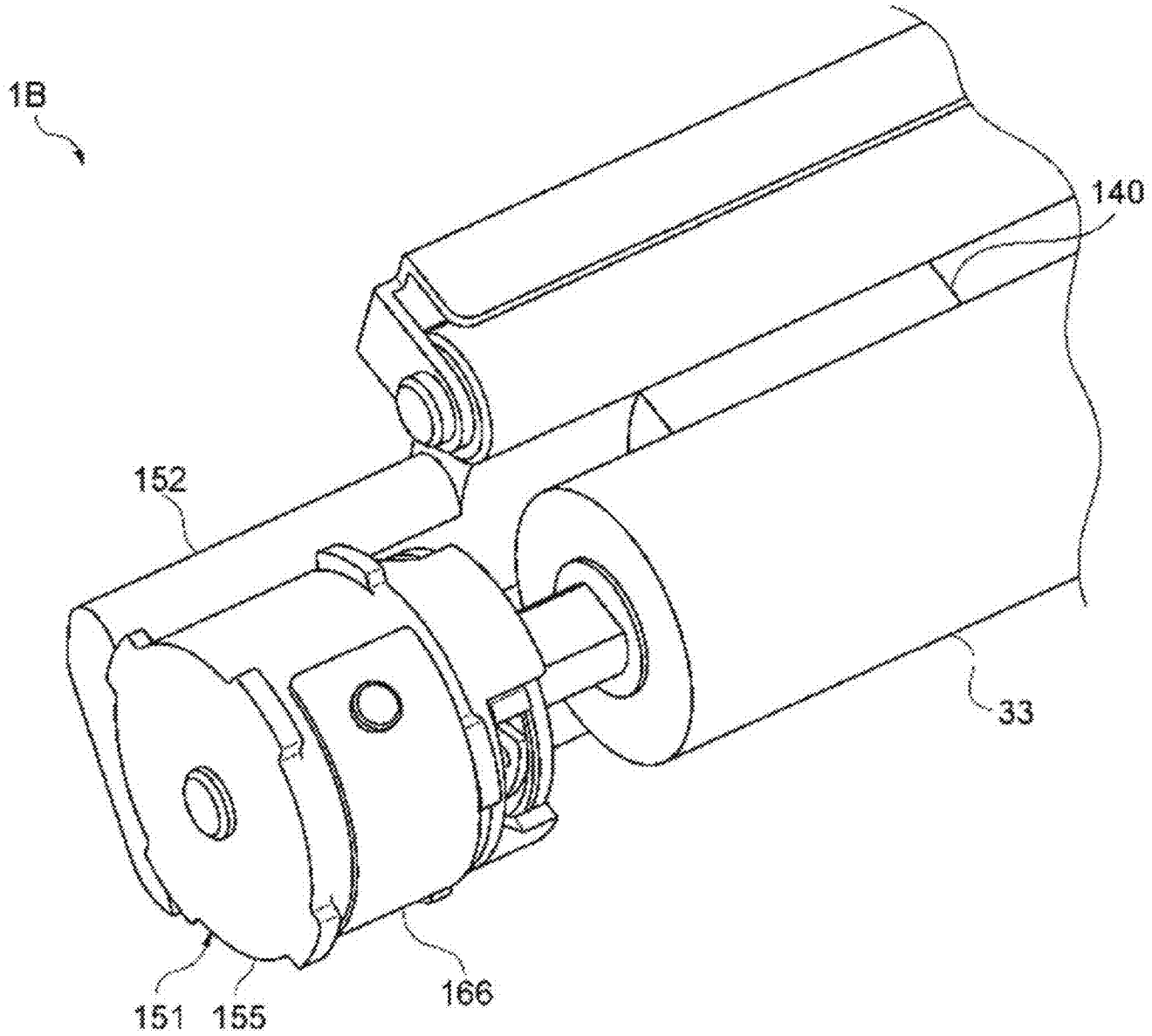
FIG. 27 is a perspective view of an example transfer device.
Figure 28:
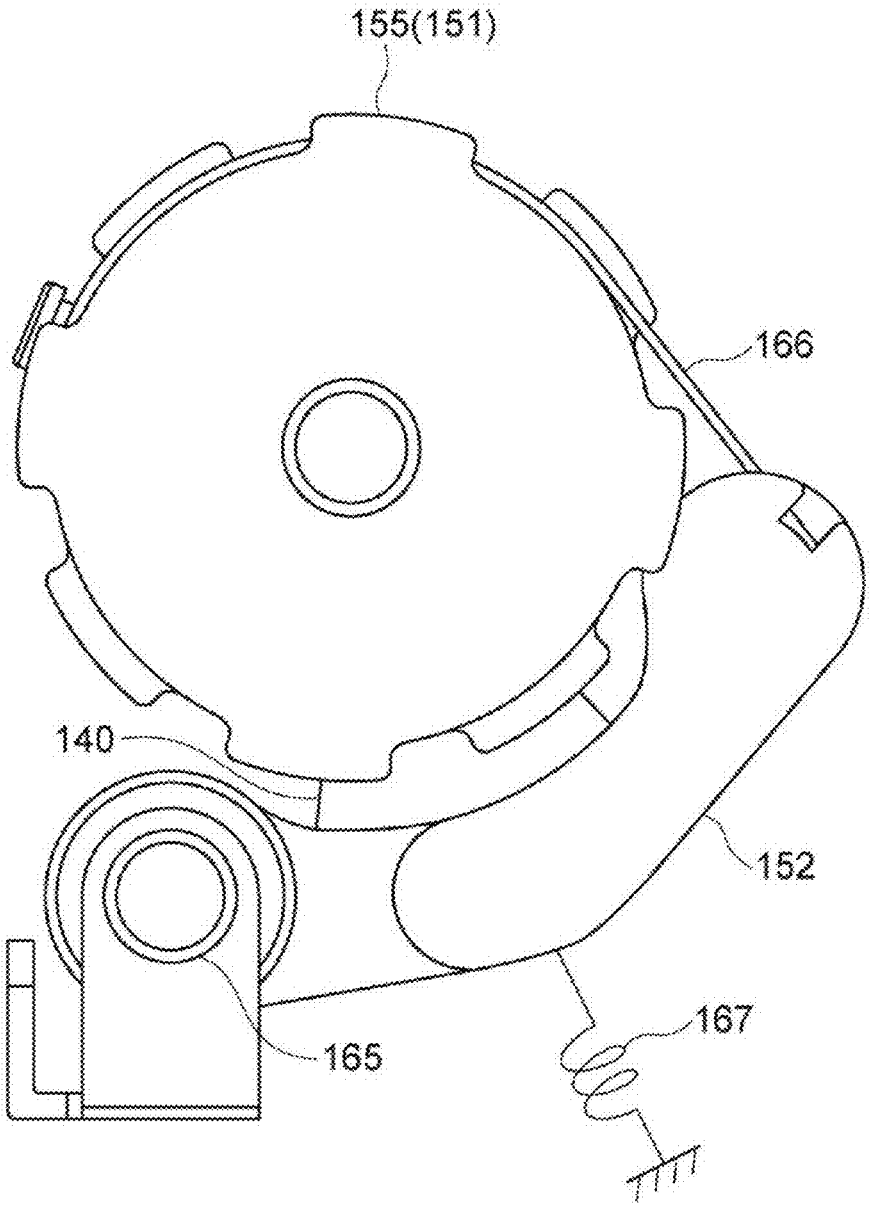
FIG. 28 is a lateral view of the transfer device shown in FIG. 27.

The rotary output device 175 is a component similar to the rotary output device 155 of FIG. 27. The rotary output device 175 is unrotatably fitted over the clutch output 158 and rotates integrally with the clutch output 158. The rotary output device 175 also serves as a housing that covers the outer periphery of the torque limiter 156. When the rotary output device 175 is rotated, the power transmission component 172 is moved. The relation between the rotation of the rotary output device 175 and the movement of the power transmission component 172 will be described later.

The power transmission component 172 is similar to the power transmission component 152 of FIG. 27. The power transmission component 172 is mounted so that it can move along a contact-separation direction D1 (cf. FIGS. 34, 35) of the cleaning component 140 relative to the secondary transfer roller 33.

As shown in FIG. 32 to FIG. 35, the power transmission component 172 includes an engaging part 172A and a holder part 1726. The engaging part 172A may engage the rotary output device 175, and extends radially of the rotary output device 175 (secondary transfer roller 33). The holder part 1726 may hold the cleaning component 140. The holder part 172B is separated from the secondary transfer roller 33 and disposed to extend from one end of the engaging part 172A over the entire region of the secondary transfer roller 33 and in parallel with the rotary shaft of the secondary transfer roller 33. The cleaning component 140 is held on a side of the holder part 1726 facing the secondary transfer roller 33.

Then, the rotary output device 175 and the power transmission component 172 include a cam 180 that converts a rotation of the rotary output device 175 into a movement of the power transmission component 172 in the contact-separation direction Dl. The cam 180 includes a first projection 181 and a second projection 182 formed on an end face of the rotary output device 175, and a slot 183 and a cam wall 184 formed in the other end of the engaging part 172A.

The first projection 181 is located centrally on the end face f the rotary output device 175. The second projection 182 is located on a position of the end face of the rotary output device 175 offset from the center. Accordingly, when the rotary output device 175 rotates, the first projection 181 rotates at that position (spins), and the second projection 182 rotates around the first projection 181.

The slot 183 is a hole into which the first projection 181 is inserted, and extends radially of the rotary output device 175 (secondary transfer roller 33). The power transmission component 172 is movable in the longitudinal direction of the slot 183. The cam wall 184 is a wall formed in an arcuate shape surrounding the slot 183 and engages with the second projection 182 on its inner peripheral surface.

With the cam 180, when the rotary output device 175 rotates to move the second projection 182 to an opposite side of the cleaning component 140 with respect to the first projection 181, the second projection 182 pushes the cam wall 184 and the power transmission component 172 is moved in a direction to move the cleaning component 140 closer to the secondary transfer roller 33.

An elastic component 185 is connected to the engaging part 172A. The elastic component 185 pushes by the elastic force the engaging part 172A (power transmission component 172) in a direction to separate the cleaning component 140 from the secondary transfer roller 33. As the elastic component 185 pushes the engaging part 172A, the cleaning component 140 held by the holder part 172B is separated from the secondary transfer roller 33 when the engagement of the centrifugal clutch 154 is released. As the elastic component 185may be similar to the elastic component 167 of FIG. 27. The elastic component 185 may be disposed on a same side of the power transmission component 172 as the secondary transfer roller 33 if the elastic component 185 exerts a force in a contracting direction, or on a side of the power transmission component 172 opposite to the secondary transfer roller 33 if the elastic component 185 exerts a force in an expanding direction. In the drawings, a coil spring exerting a force in an expanding direction is used as the elastic component 185, and the elastic component 185 is disposed on a side of the power transmission component 172 opposite to the secondary transfer roller 33.

An operation of the example image forming apparatus 1C will be described.

When the secondary transfer roller 33 is rotated (forward) and the rotary output device 175 is rotated, the second projection 182 pushes the cam wall 184 to move the engaging part 172A along the direction in which the slot 183 extends. The cleaning component 140 held by the holder part 172B is thereby made to pressure contact with the secondary transfer roller 33, and the secondary transfer roller 33 is thereby cleaned by the cleaning component 140.

When the secondary transfer roller 33 is stopped or reverse rotated to release the centrifugal clutch 154, the power transmission component 172 is moved by the elastic force of the elastic component 185 along the direction in which the slot 183 extents. Accordingly, the cleaning component 140 that has been made to pressure contact with the secondary transfer roller 33 is separated from the secondary transfer roller 33.

As described above, as the power transmission component 172 is moved in the contact-separation direction D1 of the cleaning component 140 relative to the secondary transfer roller 33 when the rotary output device 175 is rotated, the cleaning component can be properly brought into and out of contact with the component to be cleaned.

The above-described examples of image forming apparatuses may be modified.

For example, while the above-described image forming apparatus may be adapted similarly to FIG. 21, by substituting the secondary transfer roller 33 with the transfer roller 33A of FIG. 21.

In addition, the component to be cleaned is not particularly limited and it may be, for example, the photosensitive drum 40, the transfer roller 33A FIG. 21, or the like.

In addition, the cam may include any cam that converts a rotation of the rotary output device to a movement in a contact-separation direction of the power transmission component.

Figure 36:
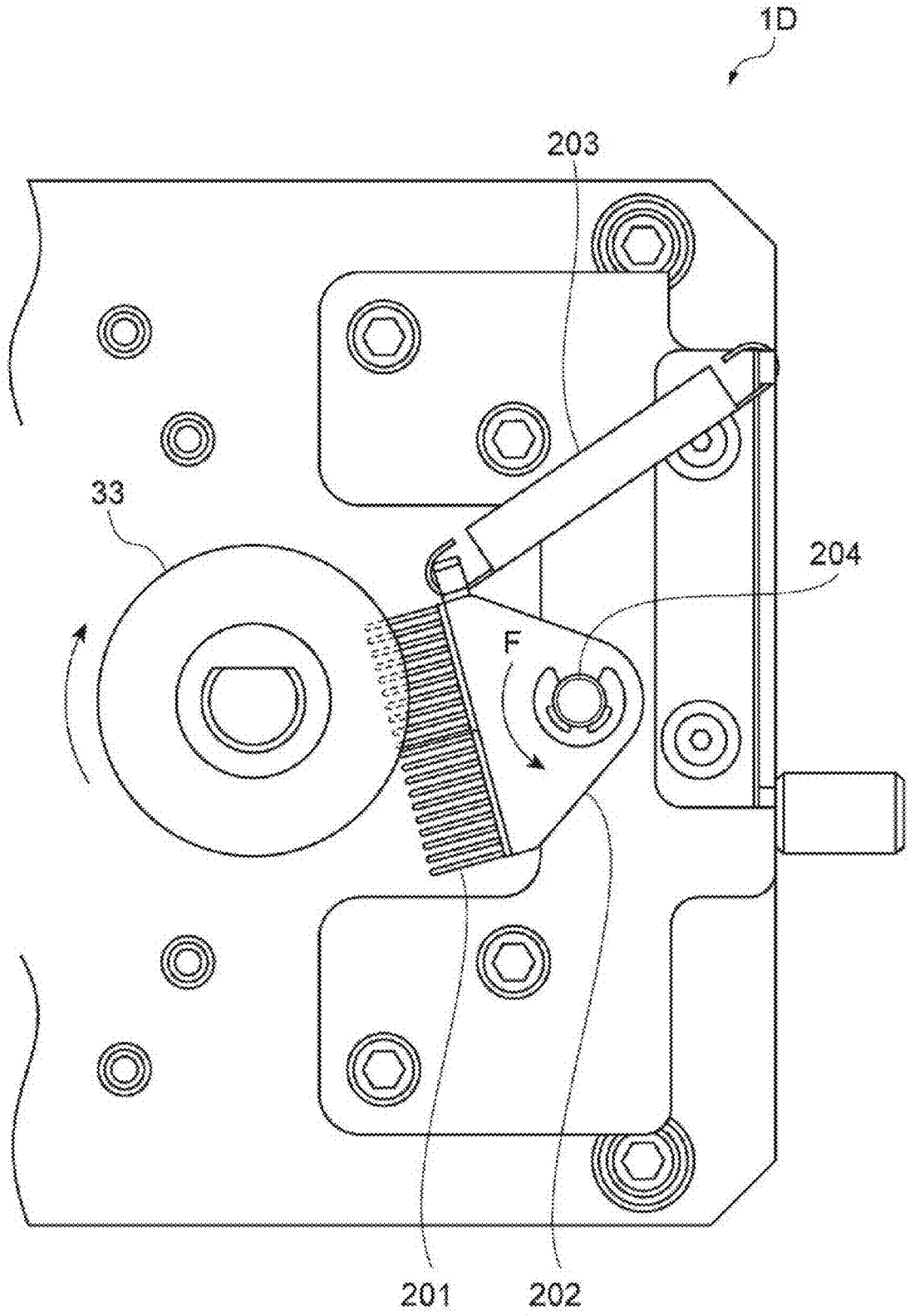
FIG. 36 is a lateral view of an example transfer device, illustrated in a state in which a secondary transfer roller is forward rotated.
Figure 37:
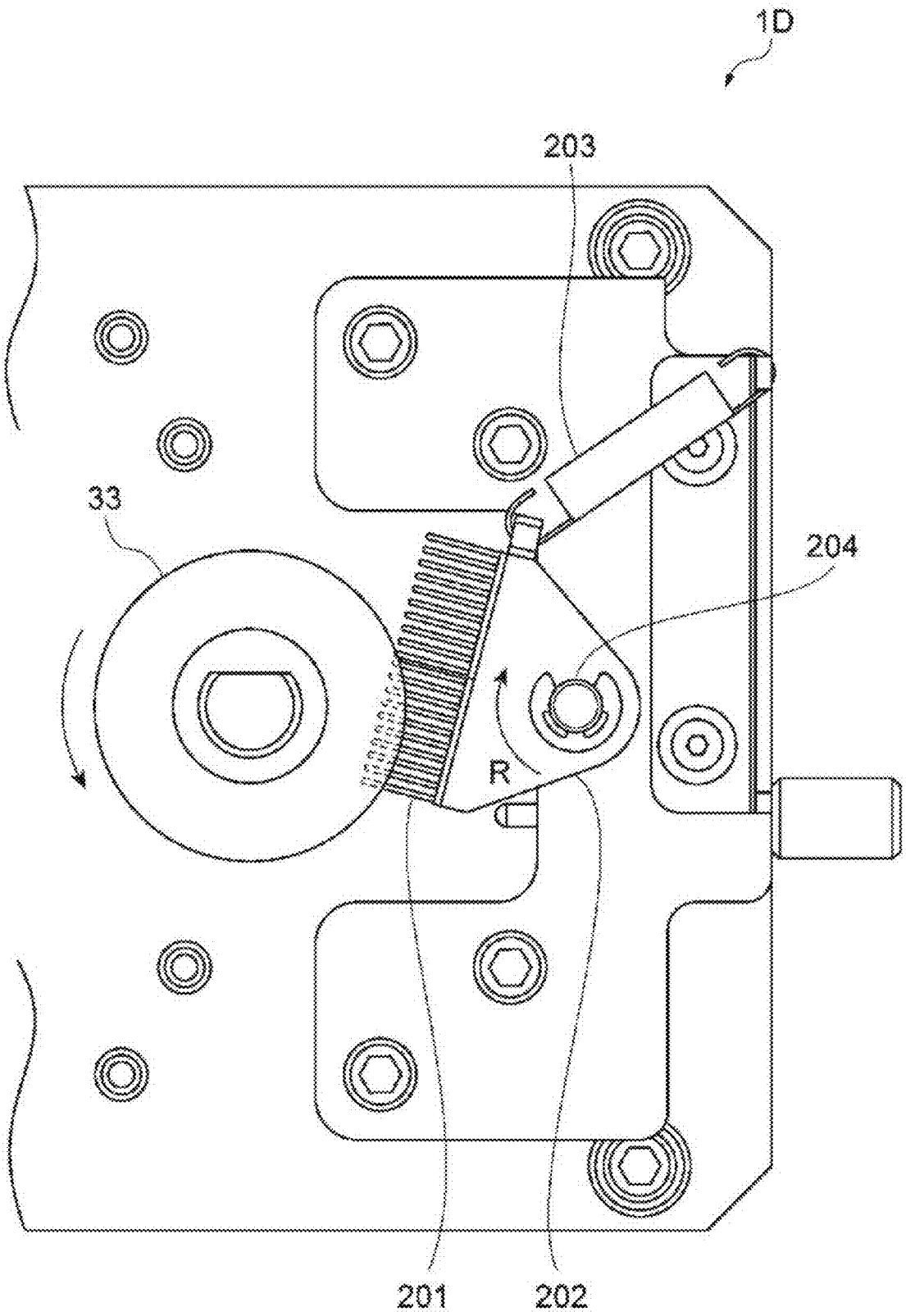
FIG. 37 is a lateral view of the transfer device of FIG. 36, illustrated in a state in which the secondary transfer roller is reverse rotated.

With reference to FIGS. 36 and 37, an example image forming apparatus 1D comprises a rotatable component to be cleaned and a cleaning component to clean the component to be cleaned by making contact with the component to be cleaned.

The image forming apparatus 1D includes a secondary transfer roller 33, e.g., the rotatable component to be cleaned, the cleaning component 201, a holding component 202, and a first elastic component 203.

The cleaning component 201 cleans the secondary transfer roller 33 by contacting the secondary transfer roller 33. The cleaning component 201 may include, for example, a roll brush, a bar brush, a foam component having elasticity, a pad-like component or the like.

The holding component 202 movably holds the cleaning component 201 within a region in which the cleaning component 201 is not separated from the secondary transfer roller 33. The holding component 202 is rotatably pivoted through a rotary shaft 204. The rotary shaft 204 is disposed in parallel with the rotary shaft of the secondary transfer roller 33.

Accordingly, when the secondary transfer roller 33 is rotated, the holding component 202 and the cleaning component 201 are also rotated (rotationally moved) due to a frictional force between the secondary transfer roller 33 and the cleaning component 201.

A direction in which the cleaning component is rotated (rotationally moved) in response to a forward rotation of the secondary transfer roller 33 may be defined as a forward movement direction F and a direction opposite to the forward movement direction F, in which the cleaning component is rotated (rotationally moved) in response to a reverse rotation of the secondary transfer roller 33, may be defined as a reverse movement direction R.

The holding component 202 is restricted from moving in the reverse movement direction R by a movement restrictor (not shown). The movement restrictor may include a stopper or the like, for example, that is brought into contact with the holding component 202 from the side of the reverse movement direction R when the holding member 202 is rotated by a predetermined angle in the reverse movement direction R.

The first elastic component 203 pushes the cleaning component 201 by the elastic force in the reverse movement direction R. The first elastic component 203 is connected to a frame of the image forming apparatus 1D and the holding component 202, and pushes the cleaning component 201 through the holding component 202. A frictional force generated between the secondary transfer roller 33 and the cleaning component 201 during the forward rotation of the secondary transfer roller 33 is defined as a forward frictional force. The elastic force of the first elastic component 203 is adjusted to balance with the forward frictional force. The first elastic component 203 may be any suitable component that possesses elasticity, for example, a stretchable component, such as a coil spring, a leaf spring or the like, and a component made of an elastic material, such as sponge or the like, may be used. The first elastic component 203 may be disposed on a side of the reverse movement direction R of the holding component 202 if the first elastic component 203 exerts a force in a contracting direction, or on a side of the forward movement direction F of the holding component 202 if first elastic component 203 exerts a force in an expanding direction. In the drawings, a coil spring exerting a force in a contracting direction is used as the first elastic component 203, and the first elastic component 203 is disposed on a side of the reverse movement direction R of the holding component 202.

An operation of the image forming apparatus 1D will be described.

When the secondary transfer roller 33 is forward rotated, a forward frictional force is generated between the secondary transfer roller 33 and the cleaning component 201. The holding component 202 thereby follows the movement of the secondary transfer roller 33 to rotate in the forward movement direction F about the rotary shaft 204. Then the holding component 202 and the cleaning component 201 are stopped at a position at which the elastic force of the first elastic component 203 and the forward frictional force are balanced. The secondary transfer roller 33 is thereby cleaned by the cleaning component 201.

When the secondary transfer roller 33 is stopped or reverse rotated, the balance between the elastic force of the first elastic component 203 and the frictional force generated between the secondary transfer roller 33 and the cleaning component 201 is lost. In response, the holding component 202 and the cleaning component 201 are rotated in the reverse movement direction R about the rotary shaft 204. With the movement restrictor, the rotation of the holding component 202 and the cleaning component 201 in the reverse movement direction R is stopped. The cleaning component 201 is thereby made to contact with the secondary transfer roller 33 at a position different from the position of contact with the secondary transfer roller 33 during the forward rotation of the secondary transfer roller 33.

As described above, the cleaning component 201 may be movably held by the holding component 202 within a region not separated from the secondary transfer roller 33, when the secondary transfer roller 33 is rotated. Accordingly, the cleaning component 201 follows the movement of the secondary transfer roller 33 and the position to make contact with the secondary transfer roller 33 changes, thereby suppressing plastic deformation of the cleaning component 201, as compared with a case where the cleaning component 201 is fixed. This suppresses the lowering of cleaning property caused by deterioration of the cleaning component 201 over time.

When the secondary transfer roller 33 is rotated, the cleaning component 201 is moved in the forward movement direction F. As the cleaning component 201 is pushed by the first elastic component 203 in the reverse movement direction R, when the secondary transfer roller 33 is stopped or reverse rotated, the cleaning component 201 is moved in the reverse movement direction R. With this, the position of the cleaning component 201 to contact the secondary transfer roller 33 can be changed depending on whether the secondary transfer roller 33 is forward rotated or not forward rotated.

During the forward rotation of the secondary transfer roller 33, the position of the cleaning component 201 to contact the secondary transfer roller 33 is a position at which the elastic force of the first elastic component 203 and the forward frictional force are balanced. Accordingly, even if the cleaning component 201 is subjected to a plastic deformation due to deterioration over time, as the balance between the elastic force and the forward frictional force remains unchanged, the position of the cleaning component 201 to contact the forward-rotated secondary transfer roller 33 can be maintained at a non-plastically deformed position or a less-plastically deformed position. For example, the position of the cleaning component 201 to contact the secondary transfer roller 33 can be moved or changed in response to plastic deformation of the cleaning component 201, to further suppress the lowering of cleaning property of the cleaning component 201 due to deterioration over time.

In some examples, the holding component 202 may be rotatably pivoted, and the cleaning component 201 can be moved more easily.

Figure 38:
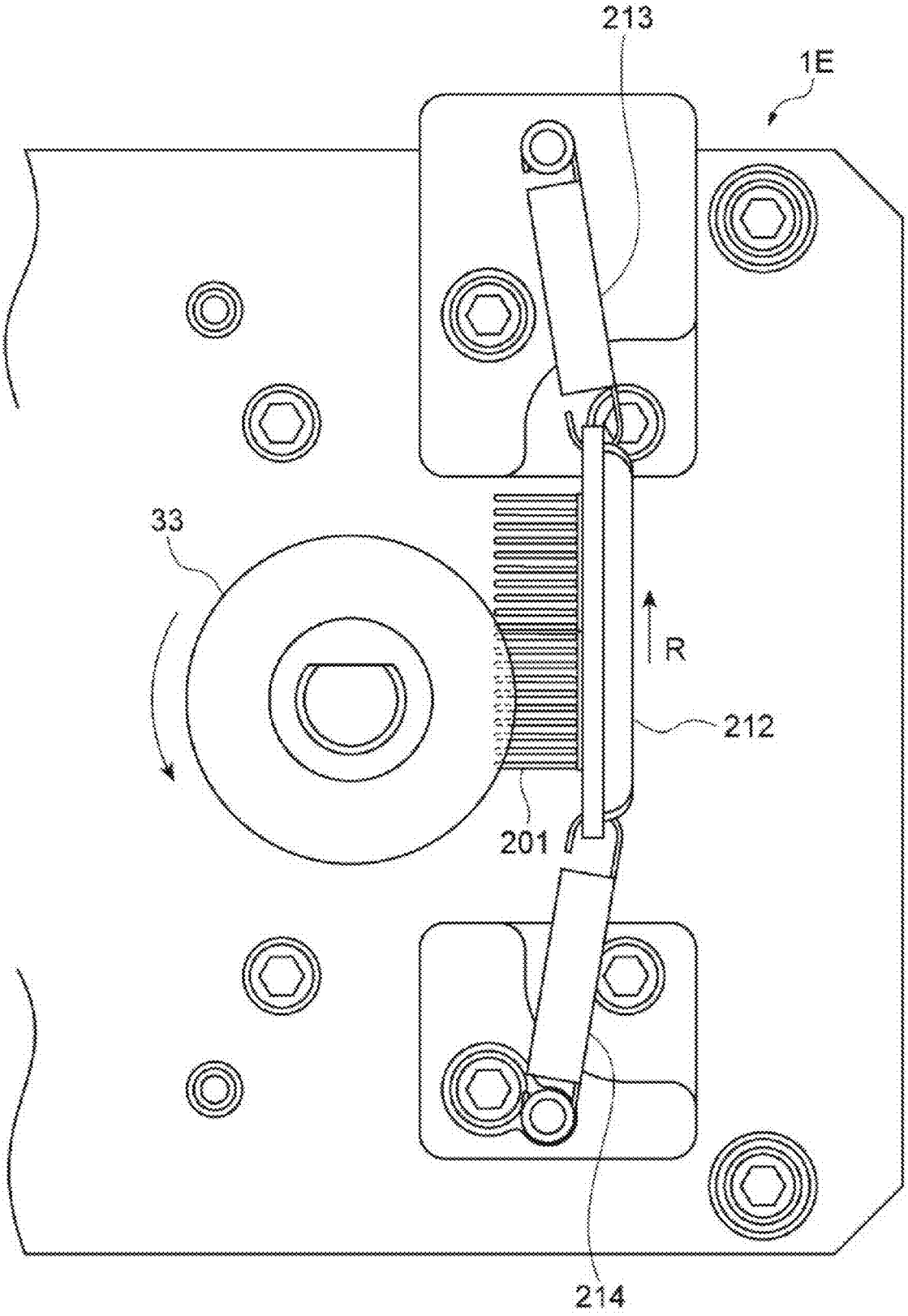
FIG. 38 is a lateral view of an example transfer device, illustrated in a state in which a secondary transfer roller is forward rotated.
Figure 39:
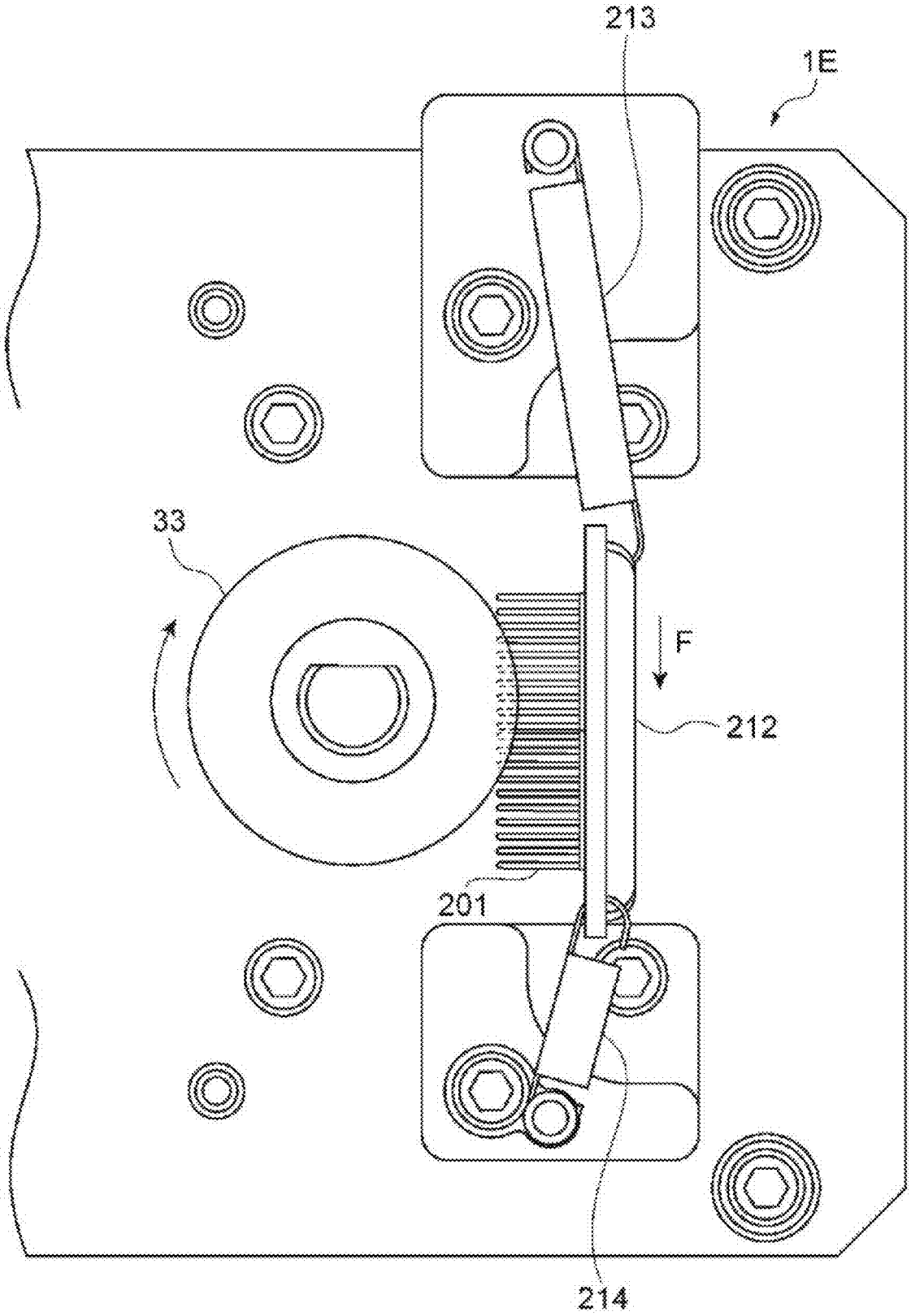
FIG. 39 is a lateral view of an example transfer device of FIG. 38, illustrated in a state in which the secondary transfer roller is reverse rotated.

With reference to FIGS. 38 and 39, an example transfer device differs from the example of FIGS. 36 and 37, in the structure to move the cleaning component.

As shown in FIG. 38 and FIG. 39, an example image forming apparatus 1E includes a secondary transfer roller 33, e.g., the rotatable component to be cleaned, a cleaning component 201, a holding component 212, a first elastic component 213, and a second elastic component 214.

The holding component 212 movably holds the cleaning component 201 within a region in which the cleaning component 201 is not separated from the secondary transfer roller 33. The holding component 212 is bridged by the first elastic component 213 and the second elastic component 214. The holding component 212 is capable of moving when the first elastic component 213 and the second elastic component 214 expand or contract. Accordingly, when the secondary transfer roller 33 is rotated, the holding component 212 and the cleaning component 201 are moved due to a frictional force between the secondary transfer roller 33 and the cleaning component 201. A direction in which the cleaning component 201 is moved in response to a forward rotation of the secondary transfer roller 33 may be defined as a forward movement direction F and a direction opposite to the forward movement direction F, in which the cleaning component 201 is moved in response to a reverse rotation of the secondary transfer roller 33, may be defined as a reverse movement direction R.

The first elastic component 213 pushes the cleaning component 201 by the elastic force in the reverse movement direction R. Namely, the first elastic component 213 is connected between a frame of the image forming apparatus 1E and an end of the holding component 212 on the side of the reverse movement direction R, and pushes the cleaning component 201 through the holding component 212 in the reverse movement direction R.

The second elastic component 214 pushes the cleaning component 201 by the elastic force in the forward movement direction F. The second elastic component 214 is connected between the frame of the image forming apparatus 1E and an end of the holding component 212 on the side of the forward movement direction F, and pushes the cleaning component 201 through the holding component 212 in the forward movement direction F.

The elastic forces of the first elastic component 213 and the second elastic component 214 are adjusted such that a difference between the elastic force of the first elastic component 213 and the elastic force of the second elastic component 214 balances with the forward frictional force that is generated between the secondary transfer roller 33 and the cleaning component 201 during the forward rotation of the secondary transfer roller 33. The first elastic component 213 and the second elastic component 214 may include a structure that possesses elasticity such as, for example, a stretchable component, such as a coil spring, a leaf spring or the like, and/or a component made of an elastic material, such as sponge or the like, may be used.

An operation of the image forming apparatus 1E will be described.

When the secondary transfer roller 33 is forward rotated, the forward frictional force is generated between the secondary transfer roller 33 and the cleaning component 201. The holding component 212 and the cleaning component 201 thereby follow the movement of the secondary transfer roller 33 to rotate in the forward movement direction F. Then the holding component 212 and the cleaning component 201 are stopped at a position at which the difference between the elastic force of the first elastic component 213 and the elastic force of the second elastic component 214 and the forward frictional force are balanced. The secondary transfer roller 33 is thereby cleaned by the cleaning component 201.

When the secondary transfer roller 33 is stopped or reverse rotated, the balance between the difference between the elastic force of the first elastic component 213 and the elastic force of the second elastic component 214 and the frictional force generated between the secondary transfer roller 33 and the cleaning component 201 is lost. Then, the movement of the holding component 212 and the cleaning component 201 in the reverse movement direction R is stopped at a position at which the elastic force of the first elastic component 213 and the elastic force of the second elastic component 214 are balanced. The cleaning component 201 is thereby made to contact with the secondary transfer roller 33 at a position different from the position of contact with the secondary transfer roller 33 during the forward rotation of the secondary transfer roller 33.

As described above, the cleaning component 201 is moved in response to the rotation of the secondary transfer roller 33, providing a similar effect as the example described above, with reference to FIGS. 36 and 37.

Figure 40:
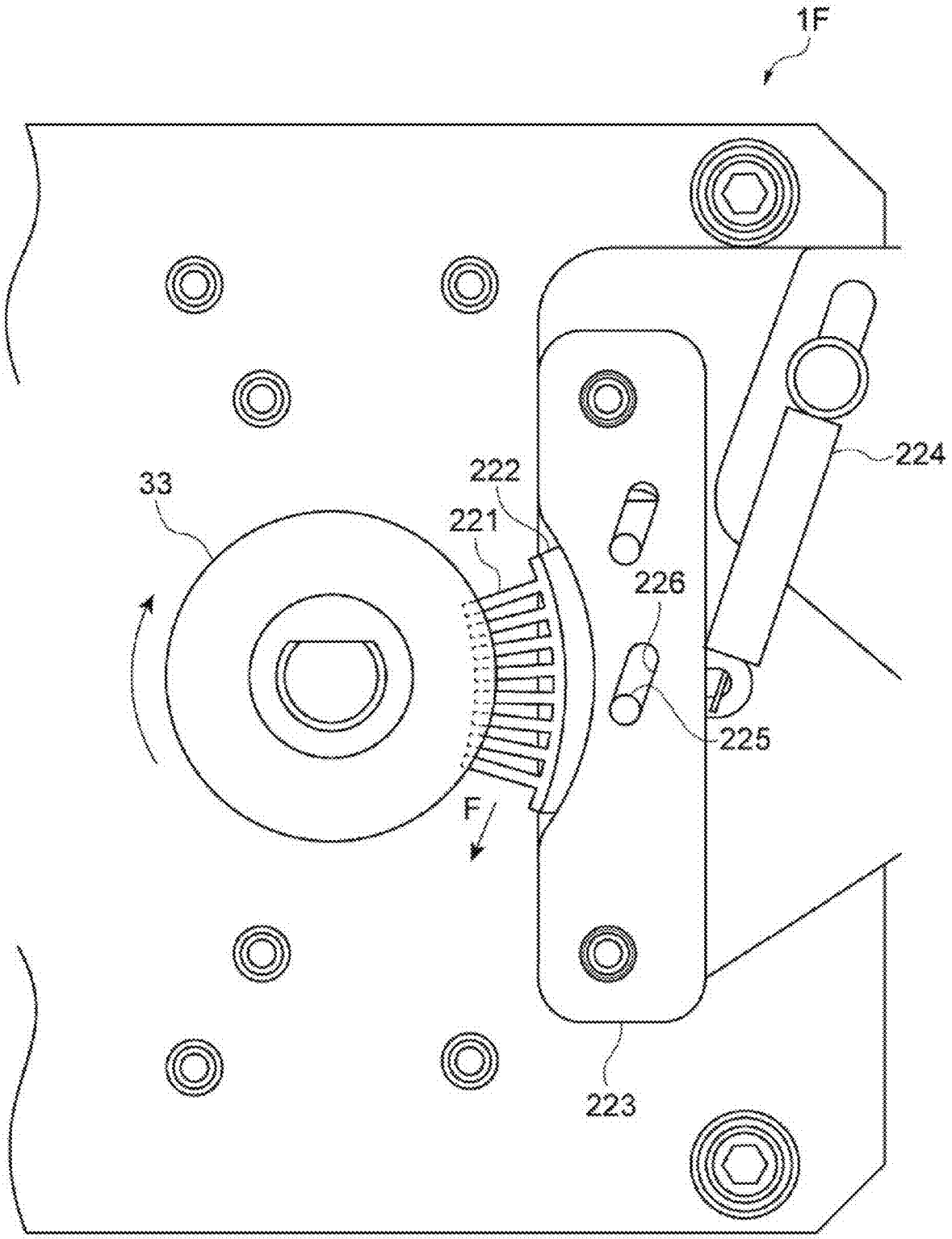
FIG. 40 is a lateral view of an example transfer device, illustrated in a state in which a secondary transfer roller is forward rotated.
Figure 41:
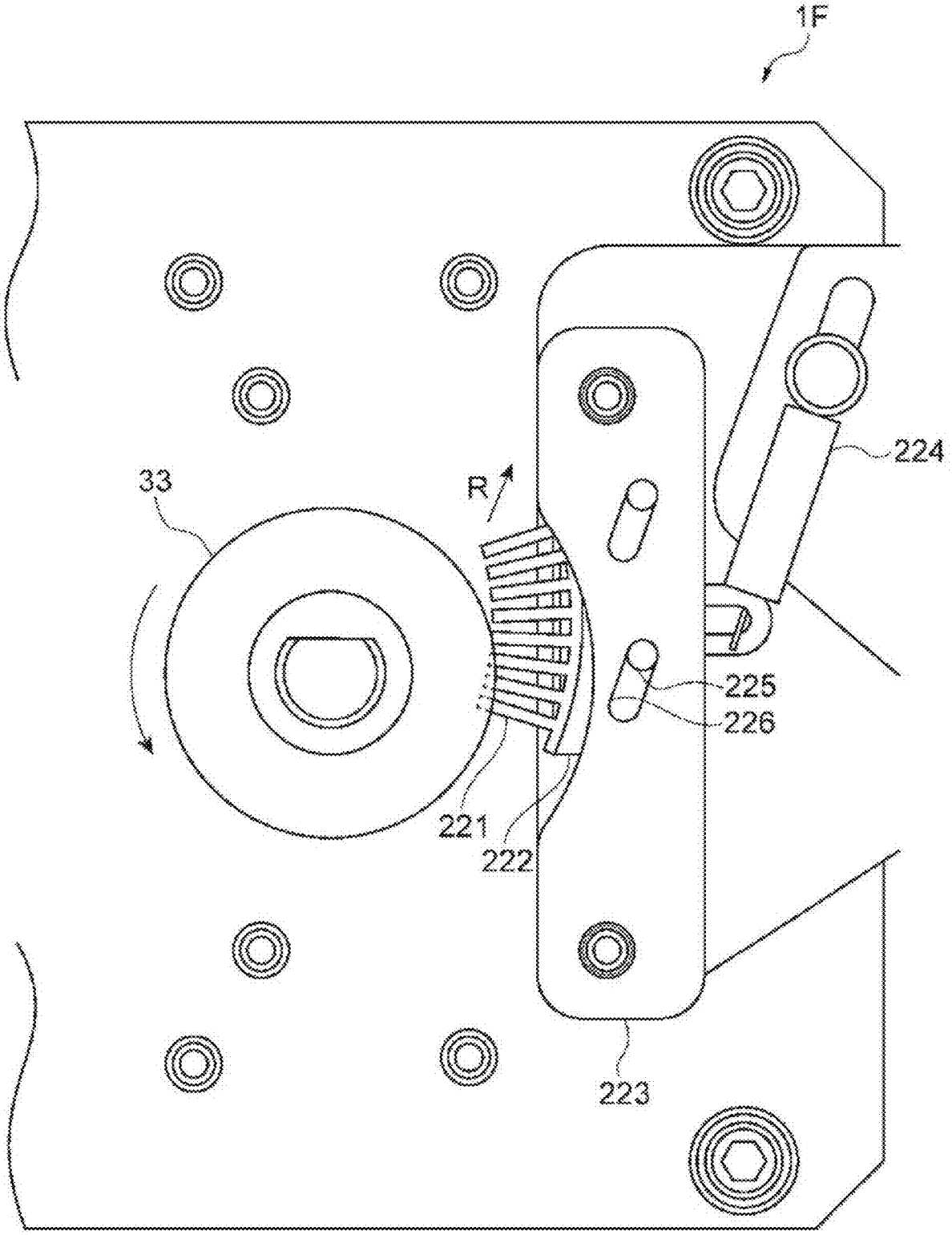
FIG. 41 is a lateral view of an example transfer device of FIG. 38, illustrated in a state in which the secondary transfer roller is reverse rotated.

With reference to FIGS. 40 and 41, an example image forming apparatus 1F differs from the example illustrated in FIGS. 36 and 37, in the structure to move the cleaning component.

As shown in FIG. 40 and FIG. 41, the example image forming apparatus 1F includes a secondary transfer roller 33, e.g., the rotatable component to be cleaned, a cleaning component 221, a holding component 222, a holding plate 223, and a first elastic component 224.

The cleaning component 221 is similar to the cleaning component 201 of FIG. 36, however the tip end surface on the side of the secondary transfer roller 33 is formed into a curved shape that conforms with the surface of the secondary transfer roller 33.

The holding component 222 movably holds the cleaning component 221 within a region in which the cleaning component 221 is not separated from the secondary transfer roller 33. The holding component 222 is formed with a plurality of projections 225 to be movably held by the holding plate 223.

The holding plate 223 is a component to movably hold the holding component 222, and is fixed to a frame (not shown) of the image forming apparatus 1F. The holding plate 223 is formed with a plurality of guide holes 226. The plurality of guide holes 226 extend in parallel with each other, and the plurality of projections 225 are respectively inserted into the plurality of guide holes 226.

When the plurality of projections 225 are inserted into the plurality of guide holes 226, the holding plate 223 and the cleaning component 221 are movably held by the holding plate 223. When the secondary transfer roller 33 is rotated, the holding component 222 and the cleaning component 221 are moved along the guide holes 226, due to a frictional force between the secondary transfer roller 33 and the cleaning component 221. Accordingly, the guide holes 226 function as a guide to provide a moving path of the cleaning component 221.

A direction in which the cleaning component 221 is moved in response to a forward rotation of the secondary transfer roller 33 may be defined as a forward movement direction F and a direction opposite to the forward movement direction F, in which the cleaning component 221 is moved in response to a reverse rotation of the secondary transfer roller 33, may be defined as a reverse movement direction R. The guide holes 226 extend in a direction that approaches the secondary transfer roller 33 toward the forward movement direction F. The guide holes 226 restrict, with their end edges, movements of the holding component 222 in the forward movement direction F and the reverse movement direction R. Accordingly, the guide holes 226 also function as movement restrictors to restrict movements of the holding component 222 in the forward movement direction F and the reverse movement direction R.

The first elastic component 224 pushes the cleaning component 221 by the elastic force in the reverse movement direction R. The first elastic component 224 is connected to a frame of the image forming apparatus 1F and the holding component 222, and pushes the cleaning component 221 through the holding component 222. The elastic force of the first elastic component 224 is adjusted to balance with a forward frictional force that is generated between the secondary transfer roller 33 and the cleaning component 221 during the forward rotation of the secondary transfer roller 33. The first elastic component 224 may include a structure that possesses elasticity such as, for example, a stretchable component, such as a coil spring, a leaf spring or the like, and/or a component made of an elastic material, such as sponge or the like, may be used. The first elastic component 224 may be disposed on a side of the reverse movement direction R of the holding component 222 if exerting a force in a contracting direction, and may be disposed on a side of the forward movement direction F of the holding component 222 if exerting a force in an expanding direction. In the drawings, a coil spring exerting a force in a contracting direction is used as the first elastic component 224, and the first elastic component 224 is disposed on a side of the reverse movement direction R of the holding component 222.

An operation of the example image forming apparatus 1F will be described.

When the secondary transfer roller 33 is forward rotated, the forward frictional force is generated between the secondary transfer roller 33 and the cleaning component 221. The holding component 222 thereby follows the movement of the secondary transfer roller 33 and moves in the forward movement direction F along the guide holes 226. Then the holding component 222 and the cleaning component 221 are stopped at a position at which the elastic force of the first elastic component 224 and the forward frictional force are balanced. The secondary transfer roller 33 is thereby cleaned by the cleaning component 221.

When the secondary transfer roller 33 is stopped or reverse rotated, the balance between the elastic force of the first elastic component 224 and the frictional force generated between the secondary transfer roller 33 and the cleaning component 221 is lost. The holding component 222 and the cleaning component 221 are moved in the reverse movement direction R along the guide holes 226. The movement of the holding component 222 and the cleaning component 221 in the reverse movement direction R is stopped when the projections 225 abut against one end edges of the guide holes 226. The cleaning component 221 is thereby made to contact with the secondary transfer roller 33 at a position different from the position of contact with the secondary transfer roller 33 during the forward rotation of the secondary transfer roller 33.

As described above, the holding component 222 includes guide holes 226 to serve as a moving path of the cleaning component 221. Accordingly, the cleaning component 221 can be prevented from moving away from the secondary transfer roller 33 in response to the rotation of the secondary transfer roller 33.

As the guide holes 226 extend in a direction that approaches the secondary transfer roller 33 toward the forward movement direction F, the cleaning component 221 approaches the secondary transfer roller 33 in response to the forward rotation of the secondary transfer roller 33. As the guide holes 226 extend in a direction that is distanced away from the secondary transfer roller 33 toward the reverse movement direction R, the cleaning component 221 is moved away from the secondary transfer roller 33 when the secondary transfer roller 33 is stopped or reverse rotated. This enables to suppress plastic deformation of the cleaning component 221 when the secondary transfer roller 33 is not forward rotated.

As the movement of the cleaning component 221 in the reverse movement direction R is restricted by the end edges of the guide holes 226, the cleaning component 221 can be prevented from moving away from the secondary transfer roller 33 when the secondary transfer roller 33 is stopped or reverse rotated.

The image forming apparatus according to the above-described examples may be modified.

For example, while the example image forming apparatuses of FIGS. 36 to 41 may be adapted similarly to the example of FIG. 21, by substituting the secondary transfer roller 33 with the transfer roller 33A of FIG. 21.

In addition, the component to be cleaned may be, for example, the photosensitive drum 40, the transfer roller 33A of FIG. 21, or the like.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An image forming apparatus comprising:

a transfer roller;

an image carrier to carry a plurality of adjusting toner images spaced apart along an axial direction of the image carrier and to form a transfer nip region between the image carrier and the transfer roller; and a bar brush comprising a base substrate located at a fixed position relative to the transfer roller, and bristles extending from the base substrate to contact the transfer roller, wherein the bristles have free ends that form a tip end surface of the bar brush, wherein the tip end surface has a curved shape that conforms with a surface of the transfer roller when the bristles are not in contact with the transfer roller, and wherein the bar brush is disposed discontinuously along an axial direction of the transfer roller in alignment with the plurality of adjusting toner images.

2. The image forming apparatus according to claim 1, wherein the bristles are provided substantially vertically in the base substrate, and wherein the base substrate is bent to the curved shape that conforms with the surface of the transfer roller.

3. The image forming apparatus according to claim 2, wherein a bite amount of the bristles with respect to the transfer roller is larger at an upstream side than at a downstream side of the transfer roller.

4. The image forming apparatus according to claim 1, wherein the bar brush is aligned with a position along the axial direction of the transfer roller, where an adjusting toner image is to pass through the transfer nip region during an image adjustment operation.

5. The image forming apparatus according to claim 4, wherein the transfer roller comprises a cylindrical metal core and a cylindrical foam layer disposed around the cylindrical metal core, wherein in a cross section of the foam layer, a diameter of cells in the foam layer is 500 μm or less, and wherein a static coefficient of friction of the foam layer to the image carrier is approximately 10.6 or less at a temperature of approximately 30° C. and a humidity of approximately 85%.

6. The image forming apparatus according to claim 4, wherein the image carrier includes a photosensitive body, and wherein the image forming apparatus comprises a bias application device to apply a transfer bias to the transfer roller, to transfer a toner image formed on the photosensitive body to a transfer material that passes through the transfer nip region.

7. The image forming apparatus according to claim 4, further comprising:

a plurality of photosensitive bodies to primarily transfer successive toner images to the image carrier;

a transfer device including the transfer nip region between the transfer device and the image carrier, the transfer nip region to convey a transfer material to secondarily transfer the toner images primarily transferred on the image carrier onto the transfer material, wherein the transfer device includes a support roller and the transfer roller to hold the image carrier between the support roller and the transfer roller, wherein the support roller is disposed on a side of the image carrier to which the toner images are not transferred, and the transfer roller is disposed on a side of the image carrier to which the toner images are transferred; and a bias application device to apply a transfer bias to the support roller or the transfer roller of the transfer device to transfer the toner images to the transfer material.

8. The image forming apparatus according to claim 7, wherein, in a normal mode, the toner images are formed on the image carrier, the toner images are transferred to the transfer material, and a normal-mode polarity is applied to the transfer roller, and wherein, in an image adjustment mode, an image adjustment is performed on the image carrier based on the plurality of adjusting toner images carried on the image carrier and the bias application device is to apply, to the transfer roller, a reverse bias of a polarity opposite to the normal-mode polarity.

9. The image forming apparatus according to claim 7, wherein, in a cleaning mode, the bias application device alternately applies positive and negative biases to the transfer roller.

10. An image forming apparatus comprising:

a rotatable cylindrical component to be cleaned; and a bar brush comprising a base substrate located at a fixed position relative to the component to be cleaned and bristles extending from the base substrate to contact the component to be cleaned, wherein the bristles have free ends that form a tip end surface of the bar brush, wherein the tip end surface has a curved shape that conforms with a surface of the component to be cleaned when the bristles are not in contact with the surface to be cleaned, wherein the cylindrical component to be cleaned comprises a cylindrical metal core and a cylindrical foam layer disposed around the cylindrical metal core, wherein, in a cross section of the foam layer, a diameter of cells in the foam layer is 500 μm or less, and wherein a static coefficient of friction of the foam layer to the image carrier is approximately 10.6 or less at a temperature of approximately30° C. and a humidity of approximately 85%.

11. The image forming apparatus of claim 10, wherein the bristles are provided substantially vertically in the base substrate, and wherein the base substrate is bent to the curved shape that conforms with the surface of the component to be cleaned.

12. The image forming apparatus according to claim 10, further comprising an image carrier to carry an adjusting toner image when an image adjustment operation is carried out, wherein the component to be cleaned includes a transfer roller to form a transfer nip region between the transfer roller and the image carrier, and wherein the bar brush is aligned with a position along an axial direction of the transfer roller where the adjusting toner image passes through the transfer nip region when the image adjustment operation is carried out.

13. The image forming apparatus according to claim 12, wherein the image carrier is to carry a plurality of adjusting toner images, including the adjusting toner image, the plurality of adjusting toner images to be spaced apart along the axial direction of the image carrier, and wherein the bar brush is disposed discontinuously along the axial direction of the transfer roller in alignment with the plurality of adjusting toner images.

14. The image forming apparatus according to claim 12, wherein the image carrier includes a photosensitive body, and wherein the image forming apparatus comprises a bias application device to apply a transfer bias to the transfer roller, to transfer a toner image formed on the photosensitive body to a transfer material that passes through the transfer nip region.

15. The image forming apparatus according to claim 12, further comprising:

a plurality of photosensitive bodies to primarily transfer successive toner images to the image carrier;

a transfer device including the transfer nip region between the transfer device and the image carrier, the transfer nip region to convey a transfer material to secondarily transfer the toner images primarily transferred on the image carrier onto the transfer material, wherein the transfer device includes a support roller and the transfer roller to hold the image carrier between the support roller and the transfer roller, wherein the support roller is disposed on a side of the image carrier to which the toner images are not transferred, and the transfer roller is disposed on a side of the image carrier to which the toner images are transferred; and a bias application device to apply a transfer bias to the support roller or the transfer roller of the transfer device to transfer the toner images to the transfer material.

16. The image forming apparatus according to claim 15, wherein, in a normal mode, the toner images are formed on the image carrier, the toner images are transferred to the transfer material, and a normal-mode polarity is applied to the transfer roller, and wherein, in an image adjustment mode, an image adjustment is performed on the image carrier based on the plurality of adjusting toner images carried on the image carrier and the bias application device is to apply, to the transfer roller, a reverse bias of a polarity opposite to the normal-mode polarity.

17. The image forming apparatus according to claim 15, wherein, in a cleaning mode, the bias application device alternately applies positive and negative biases to the transfer roller.

18. The image forming apparatus according to claim 10, wherein a bite amount of the bristles with respect to the component to be cleaned is larger at an upstream side than at a downstream side of the component to be cleaned.

* * * * *